United States Patent [19]

Tanaka et al.

[11] Patent Number: 4,863,846

[45] Date of Patent: Sep. 5, 1989

[54] SILVER HALIDE PHOTOGRAPHIC LIGHT-SENSITIVE MATERIAL

[75] Inventors: Shigeo Tanaka, Tachikawa; Mitsuhiro Okumura, Sagamihars; Makoto Kajiwara; Masanobu Miyoshi, both of Odawara, all of Japan

[73] Assignee: Konica Corporation, Tokyo, Japan

[21] Appl. No.: 209,606

[22] Filed: Jun. 21, 1988

[30] Foreign Application Priority Data

| | | | |
|---|---|---|---|
| Jun. 27, 1987 | [JP] | Japan | 62-160548 |
| Jul. 21, 1987 | [JP] | Japan | 62-182018 |
| Jul. 21, 1987 | [JP] | Japan | 62-182019 |
| Jul. 25, 1987 | [JP] | Japan | 62-186355 |

[51] Int. Cl.[4] ..... G03C 1/02

[52] U.S. Cl. ..... 430/572; 430/576; 430/583; 430/603; 430/608; 430/611

[58] Field of Search ..... 430/572, 603, 608, 576, 430/583, 611

[56] References Cited

U.S. PATENT DOCUMENTS

| | | | |
|---|---|---|---|
| 3,615,632 | 10/1971 | Shiba et al. | 430/572 |
| 3,772,031 | 11/1973 | Berry et al. | 430/603 |
| 3,988,513 | 10/1976 | Matsuyama et al. | 430/583 |
| 4,518,689 | 5/1985 | Noguchi et al. | 430/583 |

*Primary Examiner*—Paul R. Michl
*Assistant Examiner*—Thorl Chea
*Attorney, Agent, or Firm*—Finnegan, Henderson, Farabow, Garrett, & Dunner

[57] ABSTRACT

A silver halide photographic light-sensitive material is disclosed which is decreased in variation of light-sensitivity caused by a change in environmental humidity and a prolonged storage of the photographic material. The photographic material comprises a support and photographic component layers including at least one silver halide emulsion layer in which the silver halide emulsion layer contains a compound selected from the group of the compounds represented by the following formulas [I], [II], [III], [IV] or [V], and at least one of the photographic component layer is added with inorganic sulfur;

Formula [I]

Formula [II]

Formula [III]

Formula [IV]

Formula [V]

29 Claims, No Drawings

SILVER HALIDE PHOTOGRAPHIC LIGHT-SENSITIVE MATERIAL

FIELD OF THE INVENTION

This invention relates to a silver halide photographic light-sensitive material (hereinafter called simply a light-sensitive material, more particularly, to a silver halide photographic light-sensitive material which is high in sensitivity and improved in the stability of the raw photographic material on standing and sensitivity fluctuation caused by a humidity fluctuation at the time of exposure to light.

BACKGROUND OF THE INVENTION

In addition to the strong demands for silver halide photographic light-sensitive materials to make sensitivity and image quality higher especially in excellent graininess and sharpness, there have further been the strong demands for a proper low replenishment-rate process for the reduction of environmental pollution, a rapid process for answering the demands for short-time photofinishing services, and so forth. These demands may mostly be answered in the case that the high sensitization of silver halide grains may be achieved. It is, therefore, not too much to say that the increase in sensitization of silver halide grains has been the very issue of the most important for the industry concerned.

There have heretofore been a number of studies on the high sensitization of silver halide grains. To be more concrete, there have been the studies such as those of the methods of chemical sensitization and spectral sensitization. Among them, the following methods have been well known.

The well-known highly sensitizing method techniques of a chemical sensitization include, for example, those using a sulfur sensitization, a noble-metal sensitization such as a gold sensitization, a palladium sensitization, a platinum sensitization, an iridium sensitization and a selenium sensitization, a reduction sensitization or the like, each of which may be used independently or in combination.

As for the well-known spectral sensitizing dyes applicable to spectral sensitization, there are optical sensitizers including, for example, such a cyanine or merocyanine dye as a zeromethine dye, a monomethine dye, dimethine dye, a trimethine dye and so forth, each of which may be used independently or in combination to be used for a supersensitization, for example.

These techniques are also described in, for example, U.S. Pat. Nos. 2,688,545, 2,912,329, 3,397,060, 3,615,635 and 3,628,964, British Pat. Nos. 1,195,302, 1,242,588 and 1,293,862, West German OLS Pat. Nos. 2,030,326 and 2,121,780, Japanese Patent Examined Publication Nos. 4936-1968 and 14030-1969, and so forth.

Among these techniques, a spectral sensitization technique is indispensable to practically applicable light-sensitive materials and, more particularly, to color light-sensitive materials, because these light-sensitive materials contain the silver halide grains intrinsically sensitive to blue-light and, besides, to green-light or red-light.

One of the ways of obtaining a high sensitivity through a spectral sensitization is to select the conditions for a suitable combination of the above-mentioned chemical sensitization and spectral sensitization. However, even if only this way is taken, it is still not satisfactory to answer the aforementioned demands for light-sensitive materials.

One of the other ways is to select a suitable sensitizing dye. However, there are a number of requirements which should be satisfied by sensitizing dyes applied to photographic light-sensitive materials. Namely, not only a high spectral sensitivity should simply be obtained, but also, in the case of adding such a dye into a silver halide emulsion, any fog should not be increased, spectral charachteristics should be excellent, the excellent characteristics at the time of exposure including an excellent latent image stability, a few dependability on temperature and humidity at the time of exposure and so forth should be obtained, a few fog increase and a few variation in sensitivity and gradations should be retained in the preservation of raw products which are light-sensitive materials before an exposure and development are applied thereto, the so-called dye contamination caused by the dyes remaining in a light-sensitive material even after a development process should be minimized, a preparation stability should be excellent and so forth. It is very difficult to select suitable sensitizing dyes which can satisfy all of the above-mentioned requirements.

As for one of the further ways, it has been known that a supersensitization is useful. Such supersensitization is described in, for example, 'Photographic Science and Engineering', Vol. 13, pp. 13–17, 1969; ibid., Vol. 18, pp. 418–430, 1974; T. H. James, 'The Theory of the Photographic Process', 4th Ed., Macmillan Company, 1977, p. 259; or the like, from which it has been known that a high sensitivity may be obtained by choosing suitable sensitizing dyes and supersensitizers.

From the results of the experiments conducted by the inventors, it was found that, when a sensitivity is made higher so as to satisfy the aforementioned demands for light-sensitive materials, the sensitivity was lowered and the fogginess was increased both seriously during the period of preservation; the reason is still not clarified though. The deteriorations of the characteristics of a raw product is a defect that is fatal for a light-sensitive material for which is strongly demanded to make the characteristics thereof uniform.

The other techniques of improving the preservation stability of such raw products are disclosed in, for example, Japanese Patent Publication Open to Public Inspection (hereinafter called Japanese Patent O.P.I. Publication) Nos. 43320-1973, 176637-1983, 225143-1985, 225145-1985, 232545-1985, 112143-1986, 91652-1986 and 203447-1986, and so forth. Any of these techniques is not satisfactory to improve both of the sensitivity variations of raw samples in preservation and the fog variations, while retaining a high sensitivity.

Meanwhile, in recent years, an automatic photofinishing machine compact in size which is so-called 'Mini-Lab' by which a photofinishing from color negative development to color print can be performed in a narrow space. As such a 'Mini-Lab' is getting popular, it has been innegligible that the fluctuation in sensitivity of a light-sensitive materials caused by fluctuation of environmental humidity at the time of exposure mentioned above.

At such a Mini-Lab as mentioned above, the numbers of light-sensitive materials to be processed are comparatively smaller than those of large-scale photofinishing laboratories. It is, therefore, difficult to keep the characteristics of processing solutions constant. It takes a long time to use up a bulk of color paper loaded. The temperature and humidity conditions are apt to be fluctuated at the time of printing, because processing apparatuses are often installed close to the store front.

Mini-Labs have, therefore, such a defect that high-quality images may not easily be obtained.

The present inventors devoted themselves to studying on the above-mentioned problems confronting Mini-Labs and so forth and, resultingly, the inventors found that, when a color paper being in a humid-equilibrium at a certain humidity is moved to a place at a different humidity, it will require about one hour to have stable characteristics even in the portion of color paper exposed directly to the air and, at this time, the fluctuation of sensitivity was several tens of percentage. The inventors also understood that these findings may not be neglected as the factors of the characteristic fluctuation.

The humidity influence at the time of exposure is described in detail in T. H. James, 'The Theory of the Photographic Process', 4th Ed., Chap. 2, Macmillan Co., 1977. There is the description of a process in which pAg of an emulsion layer is lowered. In this process, photographic characteristics are seriously deteriorated and almost no sensitivity fluctuation inhibition effect may be displayed.

SUMMARY OF THE INVENTION

An objects of the invention are to provide a silver halide photographic light-sensitive material having high sensitivity and improved in the stability on standing and in sensitivity fluctuation caused by a humidity fluctuation at the time of exposure to light.

The above objects of the invention have been accomplished by a silver halide photographic light-sensitive material comprising a support having thereon photographic component layers including at least one silver halide emulsion layer wherein the silver halide emulsion layer contains a compound slected from the group of the compounds represented by the following formulas I, II, III, IV or V, and at least one of said photographic component layers is added with inorganic sulfur;

Formula [I]

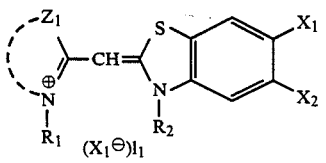

wherein $Z_1$ represents a group of atoms necessary to complete a benzothiazole nucleus or a naphthothiazole nucleus; $X_1$ and $X_2$ each represent a hydrogen atom, a halogen atom or an alkyl group, an alkoxy group, an aryl group or a hydroxyl group; $R_1$ and $R_2$ each represent an alkyl group; and $X_1^{\theta}$ represents an anion; $l_1$ is an integer of 0 or 1, Formula [II]

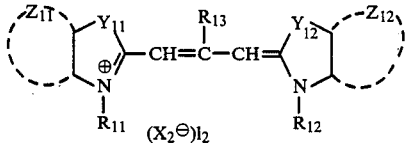

wherein $Z_{11}$ and $Z_{12}$ each represent a group of atoms necessary to complete a benzene ring or a naphthalene ring; $R_{11}$ and $R_{12}$ each represent an alkyl, alkenyl, or aryl group; $R_{13}$ represents a hydrogen atom or an alkyl group having one to three carbon atoms; $Y_{11}$ and $Y_{12}$ each represent an oxygen atom, a sulfur atom, a selenium atom, a tellurium atom, an N-$R_{14}$ group or an N-$R_{15}$ group, in which $R_{14}$ and $R_{15}$ each represents a hydrogen atom, an alkyl, alkenyl, or aryl group, $X_2^{\theta}$ represents an anion; $l_2$ is an integer of 0 or 1, Formula [III]

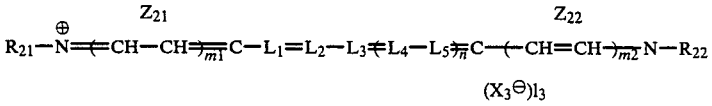

Formula [IV]

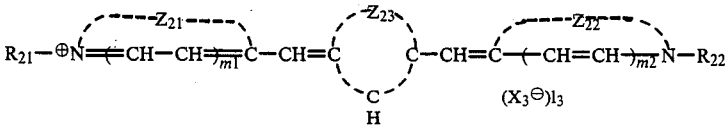

wherein $R_{21}$ and $R_{22}$ each represent an alkyl group or an aryl group; $L_1$, $L_2$, $L_3$, $L_4$ and $L_5$ each represent a methine group; $Z_{21}$ and $Z_{22}$ each represent an atom or a group necessary to complete an oxazole ring, a quinoline ring, thiazole ring or selenazole ring, $Z_{23}$ represents a group of hydrogen and carbon atoms necessary to complete a six-member ring; $X_3^{\theta}$ represents an anion; $m_1$, $m_2$, n and $l_3$ each are an integer of 0 or 1, provided that n is 1 when the ring completed by $Z_{11}$ or $Z_{22}$ is an oxazole, thiazole or selenazole ring and that $l_3$ is 0 when a compound produces an intramolecular salt, Formula [V]

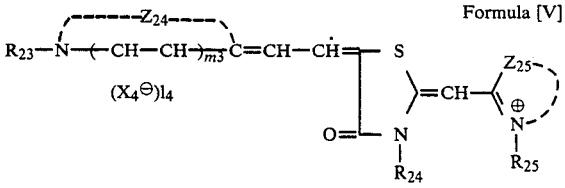

wherein $Z_{21}$ represents a group of atoms necessary to complete a quinoline ring; $Z_{25}$ represents a group of atoms necessary to complete a thiazole ring; a benzothiazole ring, a naphthothiazole ring, a benzoxazole ring, a naphthoxazole ring, benzoselenazole ring or a naphthoselenazole ring; $R_{23}$, $R_{24}$ and $R_{25}$ each represent an alkyl group; $X_4^{\theta}$ represents an acid anion; and $m_3$ and $l_4$ are integer of 0 or 1, respectively.

DETAILED DESCRIPTION OF THE INVENTION

In a silver halide emulsion layer of the photographic material of the invention, a compound represented Formula [I] to [IV] or [V] is contained as a spectral sensitizer.

The compounds represented by Formula [I] will be described in more detail.

In Formula [I], $Z_1$ represents a group of atoms necessary to complete a benzothiazole or naphthothiazole nucleus which is allowed to have a substituent.

The substituents include, for example, a halogen atom, an alkyl group, an alkoxy group, an aryl group, a hydroxyl group and so forth.

As for the halogen atoms represented by $X_1$ and $X_2$, a chlorine atom is particularly preferable. As for the alkyl groups represented by $X_1$ and $X_2$, those having 1 to 6 carbon atoms are preferable. As for the alkoxy groups represented by $X_1$ and $X_2$, those having 1 to 6 carbon atoms in the alkyl portions thereof. As for the aryl groups represented by $X_1$ and $X_2$, they include, for example, a phenyl group, a naphthyl group and so forth.

The alkyl groups represented by $R_1$ and $R_2$ include, preferably, those having 1 to 4 carbon atoms, which further include those having a substituent. The substituents include, for example, a carboxyl group, a sulfo group and so forth. As for the particularly preferable alkyl groups represented by $R_1$ and $R_2$ include a sulfoalkyl group and a carboxyalkyl group each having 1 to 4 carbon atoms in the alkyl portions thereof.

Among the spectral sensitizing dyes of the invention, which are represented by Formula [I], the further preferable ones are represented by the following Formula [Ia].

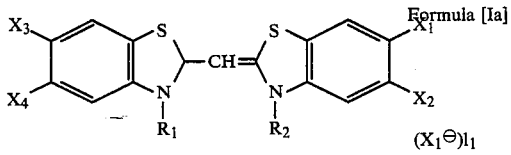

Wherein $X_1$, $X_2$, $X_3$ and $X_4$ each represent a hydrogen atom, a halogen atom, an alkyl group, an alkoxy group, a hydroxyl group and an aryl group and, among them, the halogen atoms, alkyl groups or the alkoxy groups are particularly preferable. As for the alkyl groups, those having 1 to 6 carbon atoms are preferable. As for the alkoxy groups, those having 1 to 6 carbon atoms in the alkyl portions thereof.

The substituents represented by $X_1$, $X_2$, $X_3$ and $X_4$ are allowed to be the same with or the different from each other.

$R_1$, $R_2$ and $X_1^{\theta}$ are synonymous with those denoted in Formula [I], respectively.

In the compounds represented by Formula [Ia], the halogen atoms represented by $X_1$, $X_2$, $X_3$ and $X_4$ include a chlorine atom, a bromine atom, a fluorine atom and so forth and, more preferably, a chlorine atom. The alkyl groups include, preferably, those having 1 to 4 carbon atoms, such as a methyl group, an ethyl group, a propyl group, a butyl group and so forth and, particularly, a methyl group. The alkoxy groups include, for example, a methoxy group, an ethoxy group, a propyloxy group, a butyloxy group and so forth and, more preferably, the methoxy group. The aryl groups represented by $X_1$, $X_2$, $X_3$ and $X_4$ include, preferably in particular, a phenyl group.

In the compounds represented by Formula [Ia], the alkyl groups represented by $R_1$ and $R_2$ include, for example, a methyl group, an ethyl group, a propyl group, a butyl group, and a pentyl group. They may be branched or straight-chained and these alkyl groups may have a substituent. Such substituents include, for example, a sulfo group, a hydroxyl group, a carboxyl group, an alkoxycarbonyl group and an alkylsulfonylamino group. It is, however, particularly preferable that one of $R_1$ and $R_2$ is sulfoalkyl group and the other is a carboxyalkyl group.

The above-given groups are also allowed to complete a salt together with an alkali metal ion, an ammonium ion or the like.

The typical examples of the compounds represented by Formulas [I] and [Ia] will be given below. It is, however, to be understood that the compounds applicable to the invention shall not be limited thereto.

Compounds Represented by Formula [I]

| | $Z_1$ | $X_1$ | $X_2$ | $R_1$ | $R_2$ | $l_1$ | $X_1^{\ominus}$ |
|---|---|---|---|---|---|---|---|
| BD-1 | 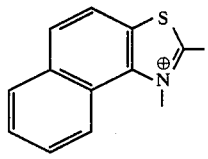 | H | H | $-(CH_2)_3SO_3^{\ominus}$ | $-(CH_2)_3SO_3^{\ominus}$ | O | — |
| BD-2 | 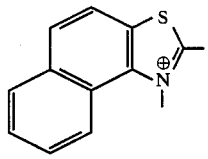 | H | Cl | $-(CH_2)_3SO_3^{\ominus}$ | $-(CH_2)_3SO_3^{\ominus}$ | O | — |
| BD-3 | 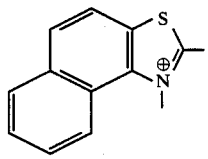 | H | $-OCH_3$ | $-(CH_2)_2SO_3^{\ominus}$ | $-(CH_2)_2SO_3^{\ominus}$ | O | — |

Compounds represented by Formula [Ia]

-continued

| Exemplified Compound | $X_{11}$ | $X_2$ | $X_3$ | $X_4$ | $R_1$ | $R_2$ | $l_1$ | $X_1^{\ominus}$ |
|---|---|---|---|---|---|---|---|---|
| BD-4 | H | H | H | Cl | $-(CH_2)_2SO_3-$ | $-(CH_2)_2SO_3H$ | O | |
| BD-5 | H | Cl | H | Cl | $-(CH_2)_2SO_3-$ | $-(CH_2)_2SO_3H$ | O | |
| BD-6 | H | Cl | H | Cl | $-(CH_2)_3SO_3-$ | $-(CH_2)_3SO_3H$ | O | |
| BD-7 | H | Cl | H | Cl | $-(CH_2)_4SO_3-$ | $-(CH_2)_4SO_3H$ | O | |
| BD-8 | H | Cl | H | Cl | $-(CH_2)_4SO_3-$ | $-(CH_2)_3SO_3H$ | O | |
| BD-9 | H | Cl | H | Cl | $-(CH_2)_3SO_3-$ | $-(CH_2)_2SO_3H$ | O | |
| BD-10 | H | Cl | H | Cl | $-CH_2CH(SO_3^-)-CH_3$ | $-(CH_2)_3SO_3H$ | O | |
| BD-11 | H | Cl | H | Cl | $-CH_2CH_2COO-$ | $-(CH_2)_3SO_3H$ | O | |
| BD-12 | H | Cl | H | Cl | $-(CH_2)_2SO_3-$ | $-CH_2COOH$ | O | |
| BD-13 | H | Cl | H | Cl | $-CH_2COO-$ | $-(CH_2)_3SO_3H$ | O | |
| BD-14 | H | Cl | H | Cl | $-CH_2COO-$ | $-(CH_2)_4SO_3H$ | O | |
| BD-15 | H | Cl | H | Cl | $-CH_2CH_2NHSO_2CH_3$ | $-(CH_2)_2SO_3H$ | 1 | $Br^-$ |
| BD-16 | H | Cl | H | Cl | $-CH_2COO-$ | $-(CH_2)_3OH$ | O | |
| BD-17 | H | Cl | H | Cl | $-(CH_2)_3SO_3-$ | $-(CH_2)_3OH$ | O | |
| BD-18 | H | Cl | H | $CH_3$ | $-(CH_2)_3SO_3-$ | $-(CH_2)_3SO_3H$ | O | |
| BD-19 | H | Cl | H | $CH_3$ | $-(CH_2)_2SO_3-$ | $-(CH_2)_3SO_3H$ | O | |
| BD-20 | H | Cl | H | $CH_3$ | $-(CH_2)_3SO_3-$ | $-(CH_2)_2SO_3H$ | O | |
| BD-21 | H | Cl | H | $CH_3$ | $-CH_2COO-$ | $-(CH_2)_3SO_3H$ | O | |
| BD-22 | H | Cl | H | $CH_3$ | $-CH_2COO-$ | $-(CH_2)_4SO_3H$ | O | |
| BD-23 | H | Cl | H | $CH_3$ | $-(CH_2)_3SO_3-$ | $-CH_2COOH$ | O | |
| BD-24 | H | Cl | H | $CH_3$ | $-(CH_2)_2SO_3-$ | $-(CH_2)_3OH$ | O | |
| BD-25 | H | Cl | H | $CH_3$ | $-(CH_2)_2SO_3-$ | $-(CH_2)_2NHSO_2CH_3$ | O | |
| BD-26 | H | Cl | $CH_3$ | $CH_3$ | $-(CH_2)_3SO_3-$ | $-(CH_2)_2SO_3H$ | O | |
| BD-27 | H | Cl | $CH_3$ | $CH_3$ | $-(CH_2)_2SO_3-$ | $-(CH_2)_3SO_3H$ | O | |
| BD-28 | H | Cl | $CH_3$ | $CH_3$ | $-(CH_2)_3SO_3-$ | $-CH_2COOH$ | O | |
| BD-29 | H | Cl | $CH_3$ | $CH_3$ | $-CH_2COO-$ | $-(CH_2)_3SO_3H$ | O | |
| BD-30 | H | $CH_3$ | H | $CH_3$ | $-(CH_2)_3SO_3-$ | $-(CH_2)_3SO_3H$ | O | |
| BD-31 | H | $CH_3$ | H | $CH_3$ | $-(CH_2)_3SO_3-$ | $-CH_2COOH$ | O | |
| BD-32 | H | $CH_3O$ | H | $CH_3$ | $-(CH_2)_3SO_3-$ | $-(CH_2)_3SO_3H$ | O | |
| BD-33 | H | $CH_3O$ | H | $CH_3$ | $-(CH_2)_3SO_3-$ | $-CH_2COOH$ | O | |
| BD-34 | H | $CH_3O$ | H | $CH_3$ | $-CH_2COO-$ | $-(CH_2)_3SO_3H$ | O | |
| BD-35 | H | $CH_3O$ | H | H | $-CH_2COO-$ | $-(CH_2)_3SO_3H$ | O | |
| BD-36 | H | $CH_3O$ | H | H | $-(CH_2)_3SO_3-$ | $-(CH_2)_3SO_3H$ | O | |
| BD-37 | H | $CH_3$ | H | $CH_3$ | $-C_2H_5$ | $-C_2H_5$ | 1 | $I^-$ |
| BD-38 | H | Cl | H | Cl | $-C_2H_5$ | $-C_2H_5$ | 1 | $I^-$ |

The above-given compounds are generally known and may readily by synthesized in the methods described in, for example, British Pat. No. 660408, U.S. Pat. No. 3149105, Japanese Patent Publication Open to Public Inspection (hereinafter called Japanese Patent O.P.I. Publication) No. 4127-1975, or F. M. Hamer, 'The Cyanine Dyes and Related Compounds', Interscience Publishers, N.Y., 1969, pp. 32–76.

The sensitizing dyes each represented by Formula [I] are added in an amount of, preferably, from $1\times10^{-4}$ mol to $2\times10^{-3}$ mol and, more preferably, from $2\times10^{-4}$ mol to $1\times10^{-3}$ mol, per mol of silver halides used.

The sensitizing dyes relating represented by Formula [I] may be used in combination with other blue-sensitive sensitizing dyes, provided that the advantages of the invention may not be harmed. The sensitizing dyes, which are preferably applicable to those relating to the invention, include a simple cyanine dye having a basic heterocyclic ring nucleus such as a pyridine nucleus, an imidazole nucleus, an oxazole nucleus, a thiazole nucleus or a selenazole nucleus which may be condensed with a benzene ring or a naphthalene ring; and a simple merocyanine dye having an acidic heterocyclic nucleus such as a rhodanine nucleus, a 2-thiohydantoine nucleus or a 2-thioselenazolidine-2,4-dione nucleus, and a basic heterocyclic nucleus such as the similar heterocyclic nucleus to those of the above-given cyanine dyes.

The sensitizing dyes represented by Formula [I] are added into a silver halide emulsion in such a manner very often that a solution of the sensitizing dyes and a solvent capable of readily mixing up with water, such as water, methanol, ethanol, acetone, dimethylformamide or the like is prepared in advance, and the solution is added into the silver halide emulsion.

The invention has an advantage that, in a photographic light-sensitive material, the sensitivity fluctuation caused by humidity can be reduced by adding inorganic sulfur to a silver halide emulsion layer containing the compounds represented by Formula [I] and/or other photographic component layers.

In the compounds used in the invention, which are represented by Formula [II], a benzene or naphthalene ring completed by $Z_{11}$ and $Z_{12}$ may be substituted with a variety of substituents. These substituents preferably include, for example, a halogen atom, an aryl group, an alkyl group or an alkoxy group.

$Y_{11}$ and $Y_{12}$ each represent an oxygen atom, a sulfur atom, a selenium atom, a tellurium atom, an $-NR_{14}$ or $NR_{15}$ group, in which $R_{14}$ and $R_{15}$ each represent a hydrogen atom, a substituted or unsubstituted alkyl, alkenyl or aryl group. Among these atoms or group, oxygen atom is most preparable.

$R_{11}$ and $R_{12}$ each represent an alkyl group, an alkenyl group or an aryl group and, more preferably, an alkyl group. The most preferable group is an alkyl group having 1 to 5 carbon atoms.

$R_{13}$ represents a hydrogen atom or an alkyl group having 1 to 3 carbon atoms and, more preferably, a hydrogen atom, a methyl group or an ethyl group. $X_2^{\theta}$ represents an anion, and $l_2$ is an integer of 0 or 1.

The sensitizing dyes used in the invention, which are represented by Formula [II], may readily be synthesized in the methods described in, for example, F. M. Hamer, 'The Chemistry of Heterocyclic Compounds', Vol. 18, and A. Weissburger, 'The Cyanine Dyes and Related Compounds', Interscience Co., N.Y., 1964.

An optimum concentration of the sensitizing dyes represented by the afore-given Formula [II] may be determined in any methods well known by the skilled in the art. For example, one and the same emulsion is divided into some parts. Sensitizing dyes having the different concentration from each other are contained into the parts of the emulsion, and the characteristics thereof are measured, respectively, so that the optimum concentration is determined.

In the invention, an amount of the sensitizing dyes added shall not be limitative, however, it is preferably from $2\times10^{-6}$ mol to $1\times10^{-2}$ mol and, more preferably, from $5\times10^{-6}$ mol to $5\times10^{-3}$ mol per mol of silver halides used.

The typical sensitizing dye compounds represented by Formula [II] will be given below. It is, however, to be understood that the sensitizing dyes used in the invention shall not be limited thereto.

[GD-1]

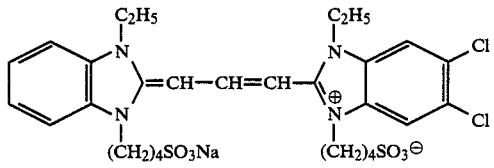

[GD-2]

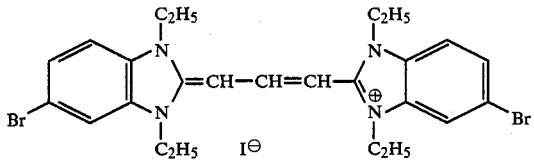

[GD-3]

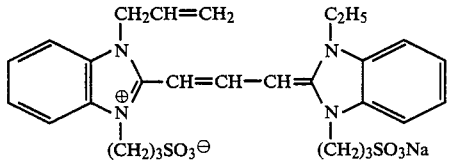

[GD-4]

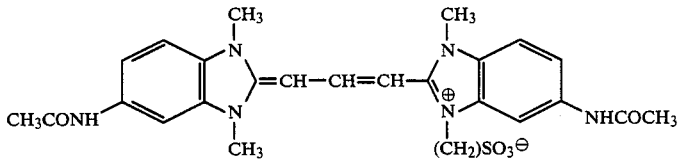

[GD-5]

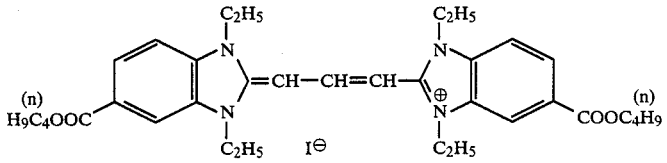

[GD-6]

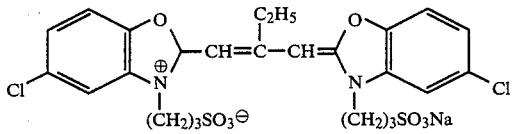

[GD-7]

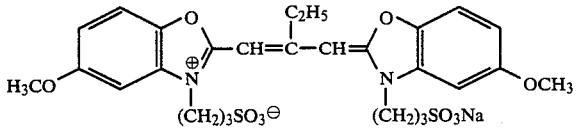

[GD-8]

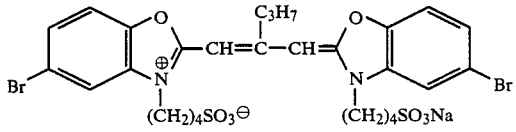

-continued
[GD-9]
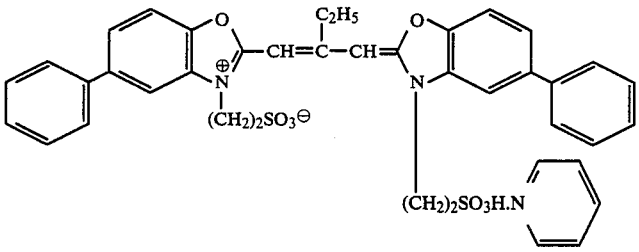
[GD-10]
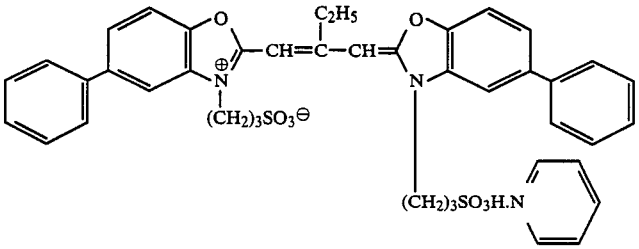
[GD-11]
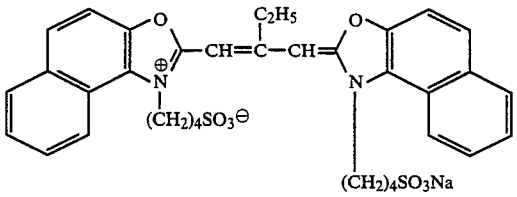
[GD-12]
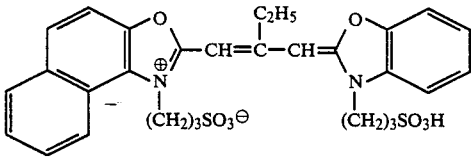
[GD-13]
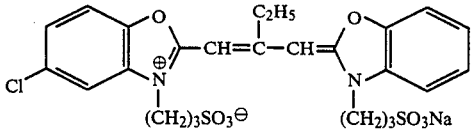
[GD-14]
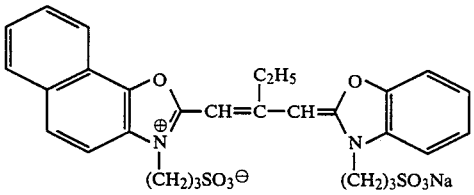
[GD-15]
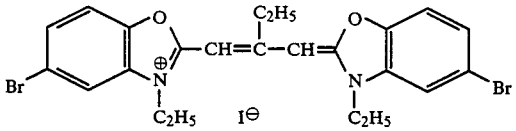
[GD-16]
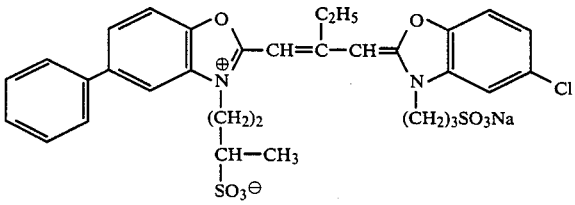

-continued
[GD-17]
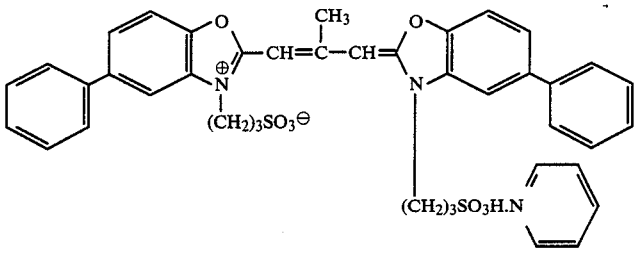
[GD-18]
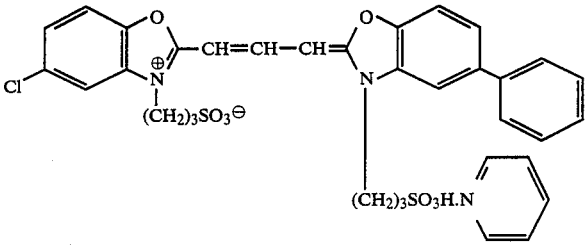
[GD-19]
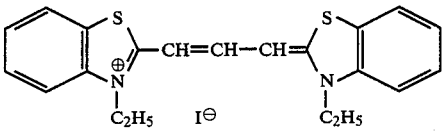
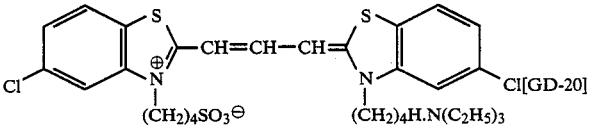
[GD-20]
[GD-21]
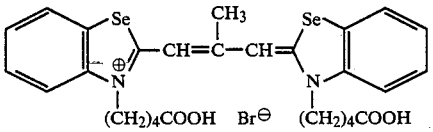
[GD-22]
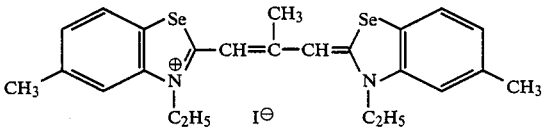
[GD-23]
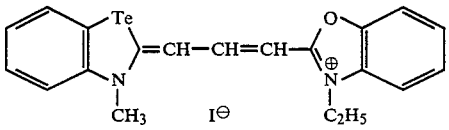
[GD-24]
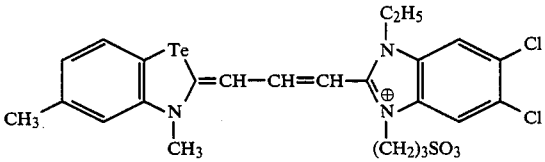
[GD-25]
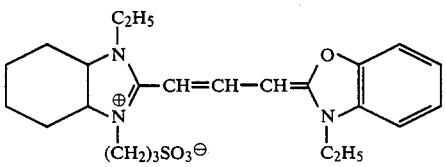

-continued

[GD-26]

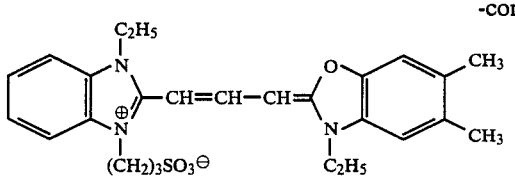

[GD-27]

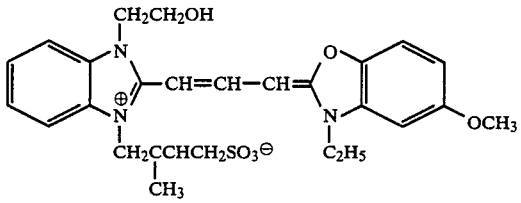

[GD-28]

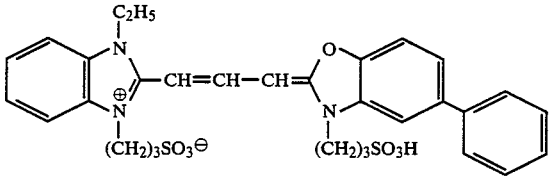

[GD-29]

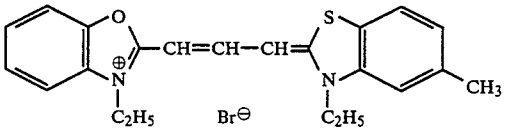

[GD-30]

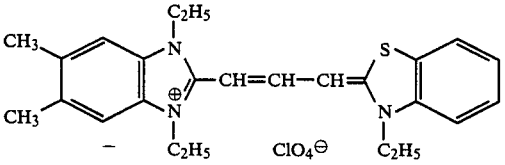

When $Y_{11}$ and $Y_{12}$ denoted in Formula [II] represent oxygen atoms, the sensitizing dyes used in the invention are high in spectral sensitizability when they are used in combination with inorganic sulfur and very effective on the improvement of raw sample preservability.

In Formulas [III] and [IV], the alkyl groups represented by $R_{21}$ and $R_{22}$ may either be branched or have an unsaturated link. More preferable ones are those having not more than 10 carbon atoms and which may also have either atoms or substituents, such as sulfo, aryl, carboxy, primary, secondary or tertiary amine, alkoxy, aryloxy, hydroxy, alkoxycarbonyl, acyloxy, a halogen, and so forth. The typical examples thereof include those groups of methyl, ethyl, sulfobutyl, benzyl, phenethyl, carboxymethyl, dimethylaminopropyl, methoxyethyl, phenoxypropyl, methylsulfonylethyl, cyclohexyl, octyl, decyl, carbamoylethyl, sulfophenethyl, sulfobenzyl, 2-hydroxy-3-sulfopropyl, ethoxycarbonylethyl, 2,3-disulfopropoxypropyl, sulfopropoxyethoxyethyl, trifluoroethyl, carboxybenzyl, cyanopropyl, p-carboxyphenethyl, ethoxycarbanylmethyl, pivaloylpropyl, propionylethyl, anisyl, acetoxyethyl, benzoyloxypropyl, chloroethyl, N-ethylaminocarbonylpropyl, allyl, 2-butyl, cyanoethyl or the like.

The aryl groups represented by $R_{21}$ and $R_{22}$ include, for example, a phenyl group, a carboxyphenyl group, a sulfophenyl group, and so forth.

When the methine groups represented by $L_1$, $L_2$, $L_3$, $L_4$ and $L_5$ have a substituent, they are represented by Formula (—CR=) in which the substituents represented by R include, for example, alkyl groups such as a methyl group, an ethyl group, a carboxymethyl group or a benzyl group, alkoxy groups such as a methoxy group or an ethoxy group, aryl groups such as a phenyl group or a tolyl group, and so forth, each of which has carbon numbers of the order of from 1 to 8 and may be either straight-chained or branched.

Among the thiazole nuclei, selenazole nuclei and oxazole nuclei each completed with $Z_{21}$ and $Z_{22}$ denoted in Formulas [II] and [IV], the typical examples thereof include the following nuclei. Namely, the nuclei of thiazole, 4-methylthiazole, 5-phenylthiazole, 4,5-dimethylthiazole, benzothiazole, 5-chlorobenzothiazole, 6-chlorobenzothiazole, 3-methylbenzothiazole, 6-methylbenzothiazole, 5-bromobenzothiazole, 5-carboxybenzothiazole, 5-ethoxycarbonylbenzothiazole, 5-hydroxybenzothiazole, 5-butylbenzothiazole, 5-pivaloylaminobenzothiazole, 6-benzoylaminobenzothiazole, 5-acetylbenzothiazole, 6-acetylaminobenzothiazole, 5-phenylbenzothiazole, 6-methoxybenzothiazole, 5-iodobenzothiazole, 5-methoxy-6-methylbenzothiazole, tetrahydrobenzothiazole, 5-phenoxybenzothiazole, 5-phenethylbenzothiazole, 5-cyanobenzothiazole, naphtho[1,2-d]thiazole, naphtho[2,1-d]thiazole, naphtho[2,3-d]thiazole, 5-ethoxynaphtho[1,2-d]thiazole, 8-methoxynaphtho[2,1-d]thiazole, 5-methoxythionaphtheno[6,7-d]thiazole, 4,5-dihydronaphtho[2,1-d]thiazole, thieno[2,3-d]thiazole, 4-methyl slenazole, 4-phenyl selenazole, benzo selenazole, 5-chlorobenzo selenazole, 5-methylbenzo selenazole, 5-methoxybenzo selenazole, 5,6-dimethylbenzo selenazole, tetrahydrobenzo selenazole, naphtho[1,2-d]selenazole, naphtho[2,1-d]selenazole, 4-methyl oxazole, 5-methyl oxazole, 5-phenyl oxazole, 4,5-dimethyl oxazole, benzo oxazole, 5-chlorobenzo oxazole, 5-methylbenzo oxazole, 5-phenylbenzo oxazole, 5-methoxybenzo oxazole, 5,6-dimethylbenzo oxazole, 5-phenethylbenzo oxazole, 5-carboxybenzo oxazole, 5-hydroxybenzo oxazole, 5-phenoxybenzo oxazole, 5-acetylbenzo oxazole, 5-methyl-6-chlorobenzo oxazole, naphtho[1,2-d]oxazole, naphtho[2,1-d]oxazole, naphtho[2,3-d]oxazole and so forth.

n represents an integer of 1, when the ring completed by $Z_{21}$ or $Z_{22}$ is oxazole, thiazole or selenazole ring. When the ring completed by $Z_{21}$ or $Z_{22}$ is quinoline ring, n represents an integer of 0 or 1.

The anions represented by $X_3$ denoted in Formulas [III] and [IV] include, for example, chlorine ion, bromine ion, iodine ion, perchloric acid ion, fluoroboric acid ion, p-toluenesulfonic acid ion, ethylsulfonic acid ion, nitric acid ion and so forth.

Among the sensitizing dyes represented by the above-given Formulas [III] and [IV], the particularly useful sensitizing dyes may be represented by the following Formulas [IIIa] and [IVa].

Formula [IIIa]

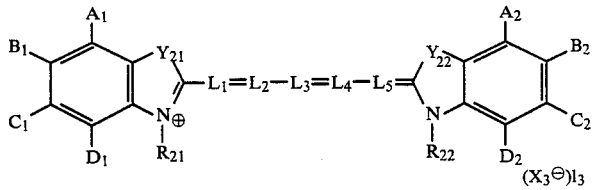

Formula [IVa]

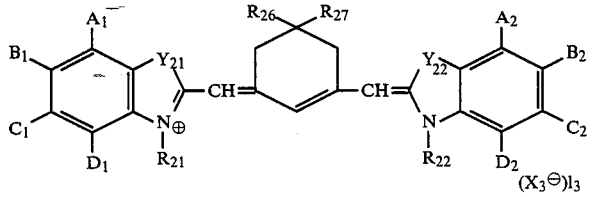

wherein $Y_{21}$ and $Y_{22}$ represent an oxygen atom, a sulfur atom or a selenium atom, respectively; $R_{26}$ and $R_{27}$ represent a lower alkyl group, respectively;

$A_1$, $A_2$, $B_1$, $B_2$, $C_1$, $C_2$, $D_1$ and $D_2$ represent a hydrogen atom, a halogen atom, an alkyl group, an alkoxy group, a phenyl group, a cyano group, a nitro group or an alkoxycarbonyl group, respectively, provided that at least one combination of $A_1$ and $B_1$, $B_1$ and $C_1$, $C_1$ and $D_1$, $A_2$ and $B_2$, $B_2$ and $C_2$, and $C_2$ and $D_2$ may be so condensed as to complete a benzene ring.

The alkyl groups represented by $A_1$, $A_2$, $B_1$, $B_2$, $C_1$, $C_2$, $D_1$ and $D_2$ denoted in Formulas [IIIa] and [IVa] include, for example, lower alkyl groups such as a methyl group, an ethyl group, a butyl group and a trifluoromethyl group, each of which has carbon atoms of the order of from 1 to 5 and is straight-chained or branched; the alkoxy groups represented thereby include, for example, alkyloxy groups such as a methoxy group and an ethoxy group, each of which has carbon atoms of the order of from 1 to 5 and is straight-chained or branched; the halogen atoms include, for example, a fluorine atom, a chlorine atom, a bromine atom or an iodine atom; The phenyl groups include, for example, a phenyl group, a hydroxyphenyl group and a carboxyphenyl group, each of which has not any substituent; and the alkoxycarbonyl groups include, for example, a methoxycarbonyl group and an ethoxycarbonyl group.

$R_1$, $R_2$, $L_1$, $L_2$, $L_3$, $L_4$, $L_5$, $X_3^{\ominus}$, and $l_3$ are symonymous with those denoted in the above-given Formulas [III] and [IV], respectively.

In the invention, when the quinoline ring comprising $Z_{24}$ denoted in Formula [V]0 has a substituent, such substituents include, for example, a halogen atom, an alkyl group, an alkoxy group, a hydroxy group, a cyano group, a carboxy group, an alkoxycarbonyl group, an alkylamino group, an acylamino group, an acyl group, a phenyl group, a cyclohexyl group and so forth. The quinoline rings comprising the $Z_4$ include, for example, those of 2-quinoline, 6-chloro-2-quinoline, 6-methyl-2-quinoline, 6-methoxy-2-quinoline, 7-methyl-2-quinoline, 8-methyl-2-quinoline, 6-hydroxy-2-quinoline, 4-quinoline, 6-methyl-4-quinoline, 6-ethyl-4-quinoline, 6-ethoxy-4-quinoline, 6-chloro-4-quinoline, 6-hydroxy-4-quinoline, 6-phenyl-4-quinoline, 7-methyl-4-quinoline, 8-methyl-4-quinoline and so forth.

The thiazole ring, benzothiazole ring, naphthothiazole ring, benzoxazole ring, naphthoxazole ring, benzoselenazole ring or naphthoselenazole ring each comprising $Z_{25}$ each have a substituent, such substituents include, for example, a halogen atom, an alkyl group, an alkoxy group, a hydroxy group, a cyano group, a carboxy group, an alkoxycarbonyl group, an alkylamino group, an acylamino group, an acyl group, a phenyl group, a cycloalkyl group and so forth.

The typical examples of the thiazole rings comprising $Z_{25}$ include those of thiazole, 4-phenylthiazole, 4,5-diphenylthiazole, 4-methylthiazole, 5-methylthiazole, 4-chloro-thiazole, 4-methoxythiazole and so forth. The benzothiazole rings include those of benzothiazole, 5-chlorobenzothiazole, 5-phenylbenzothiazole, 5-methylbenzothiazole, 5-methoxy-benzothiazole and so forth. The naphthothiazole rings include those of α-naphthothiazole, β-naphthothiazole, 5-methoxy-β-naphthothiazole, 5-methyl-β-naphthothiazole, 8-methoxy-α-naphthothiazole, 8-chloro-α-naphthothiazole and so forth.

The benzoxazole rings comprising $Z_{25}$ include, for example, those of benzoxazole, 5-chlorobenzoxazole, 5-phenylbenzoxazole, 5-methylbenzoxazole, 5-methoxybenzooxazole, and so forth. The naphthoxazole rings include, for example, thos of α-naphthoxazole, β-naphthoxazole, 5-methoxy-β-naphthoxazole, 5-methyl-β-naphthoxazole, 8-methoxy-α-naphthoxazole, 8-chloro-α-naphthoxazole and so forth.

The benzoselenazole rings comprising $Z_{25}$ include, for example, those of benzoselenazole, 5-chlorobenzoselenazole, 5-phenylbenzoselenazole, 6-phenylbenzoselenazole, 5-methylbenzoselenazole, 5-methoxybenzoselenazole and so forth. The naphthoselenazole rings include, for example, those of α-naphthoselenazole, β-naphthoselenazole, 5-methoxy-β-naphthoselenazole, 5-methyl-β-naphthoselenazole, 8-methoxy-α-naphthoselenazole, 8-chloro-α-naphthoselenazole and so forth.

The alkyl groups represented by $R_{23}$, $R_{24}$ and $R_{25}$ denoted in Formula [V] may be straight-chained or branched. They include, for example, a methyl group, an ethyl group an n-propyl group, a 1-propyl group, an n-butyl group and so forth.

The acid anions represented by $X_4^{\ominus}$ denoted in Formula [V] include, for example, those of chlorine ion, bromine ion, iodine ion, perchloric acid ion, fluoroboric acid ion, p-toluenesulfinic acid ion, ethylsulfonic acid ion, methylsulfonic acid ion, nitric acid ion and so forth.

When the compounds represented by Formula [V] form an intramilecular salt, $l_4$ is zero.

Among the sensitizing dyes relating to the invention, the preferable ones are represented by the above-given Formulas [IIIa] and [IVa] in which at least one of $Y_{21}$ and $Y_{22}$ represents a sulfur atom.

The typical examples of the sensitizing dyes relating to the invention will be given below. It is, however, to be understood that the sensitizers relating to the invention shall not be limited thereto.

RD-1

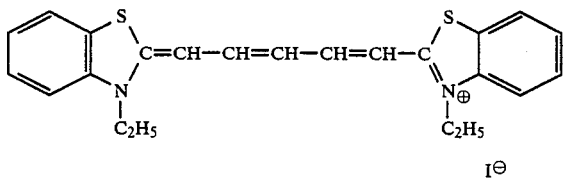

RD-2

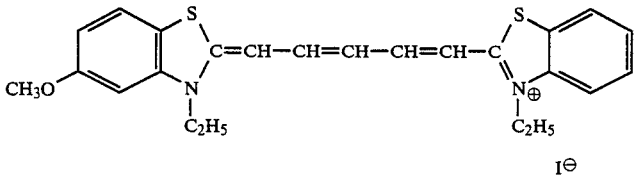

RD-3

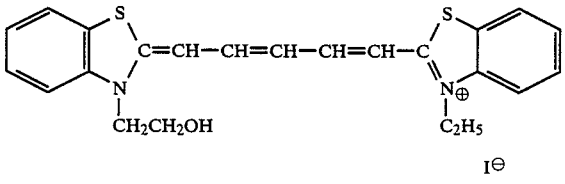

RD-4

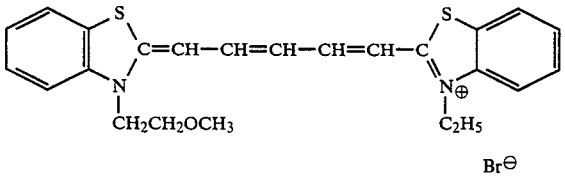

RD-5

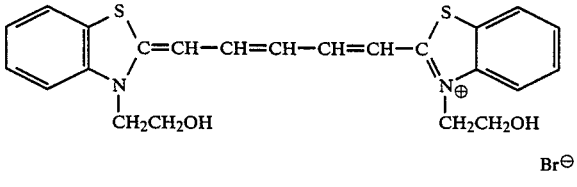

RD-6

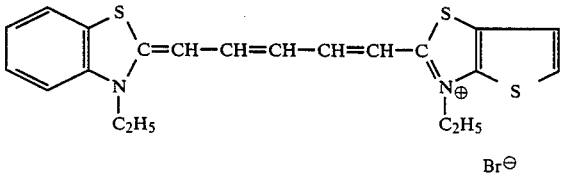

-continued
RD-7
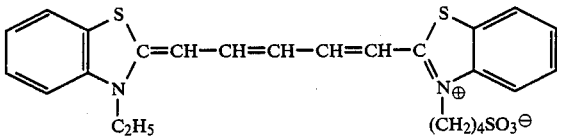
RD-8
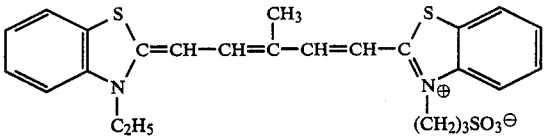
RD-9
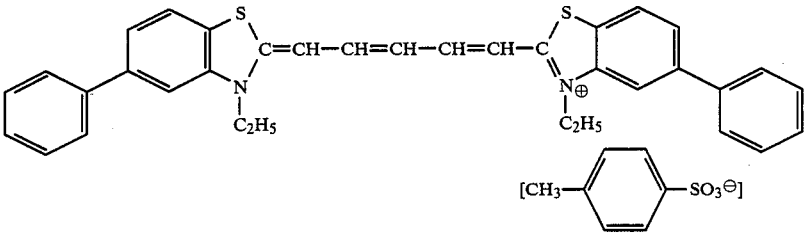
RD-10
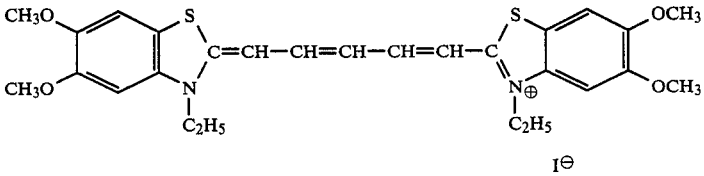
RD-11
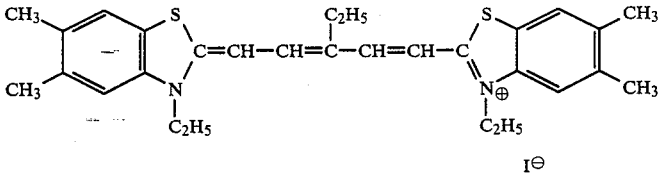
RD-12
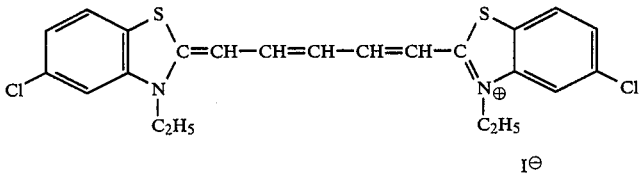
RD-13
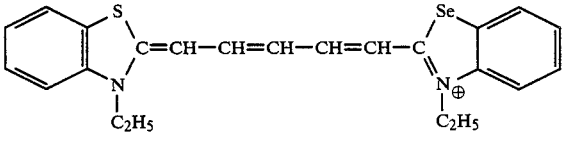
RD-14
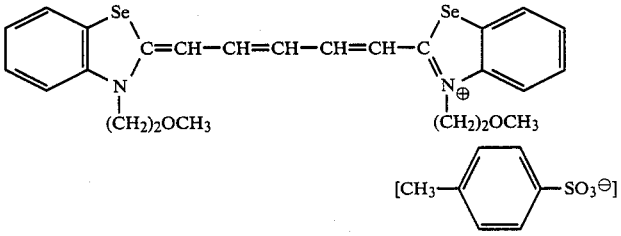

-continued
RD-15
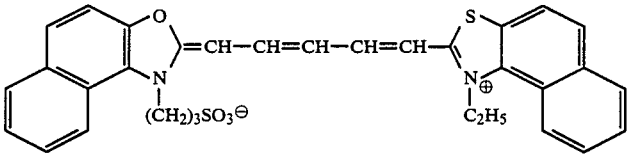
RD-16
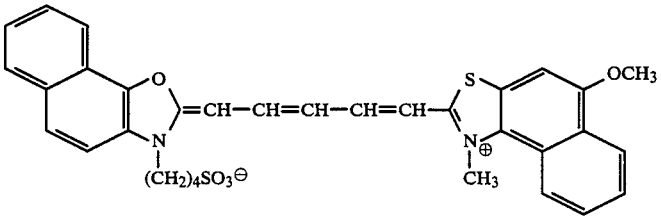
RD-17
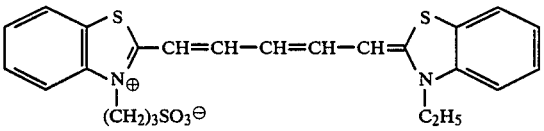
RD-18
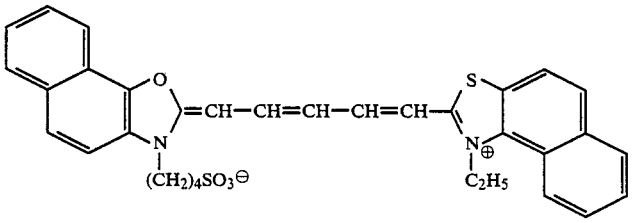
RD-19
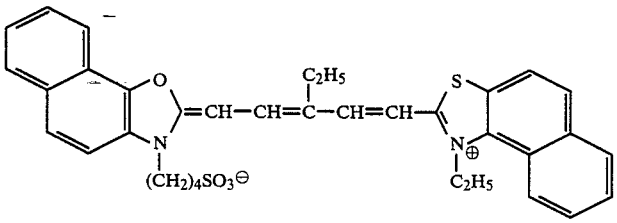
RD-20
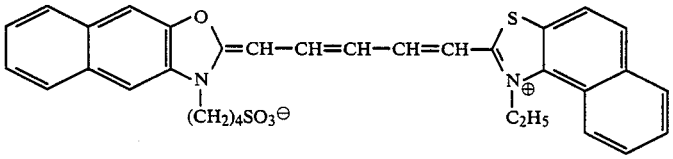
RD-21
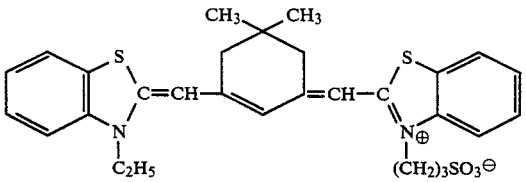
RD-22
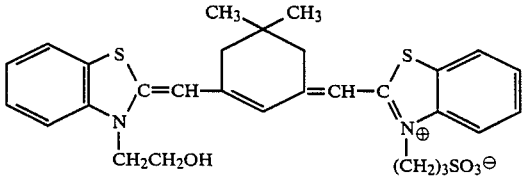

-continued
RD-23
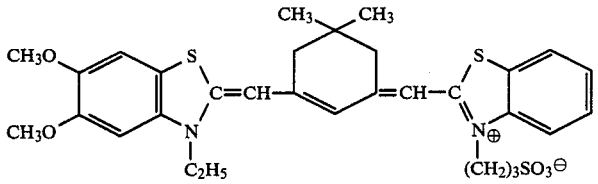
RD-24
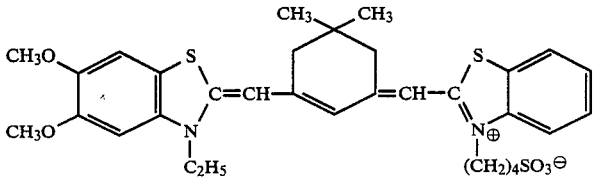
RD-25
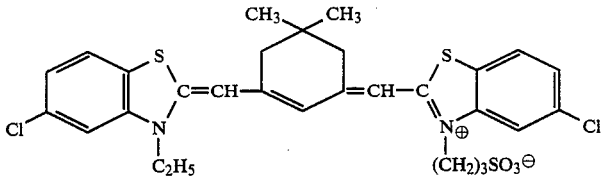
RD-26
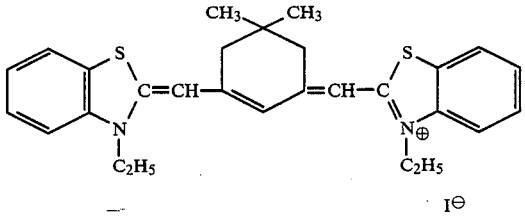
RD-27
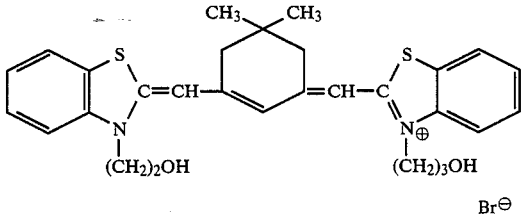
RD-28
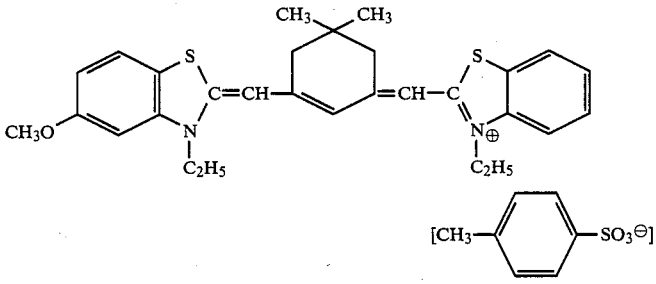
RD-29
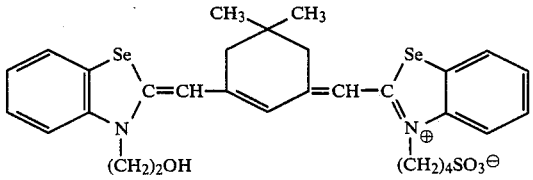

-continued
RD-30
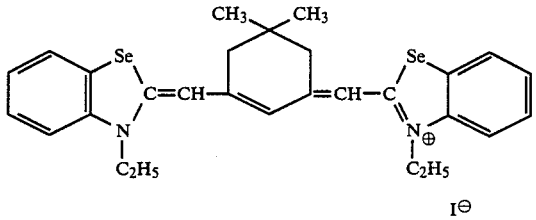
RD-31
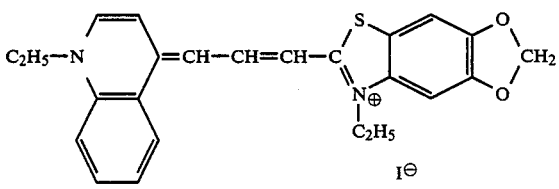
RD-32
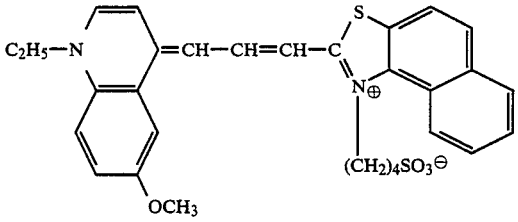
RD-33
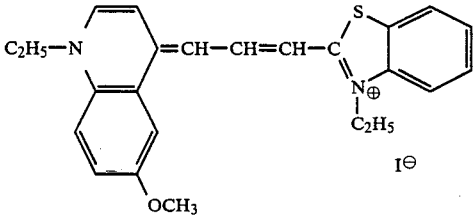
RD-34
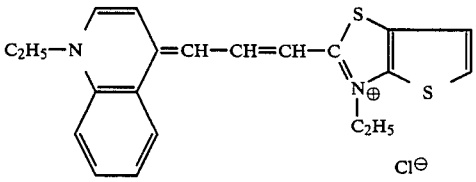
RD-35
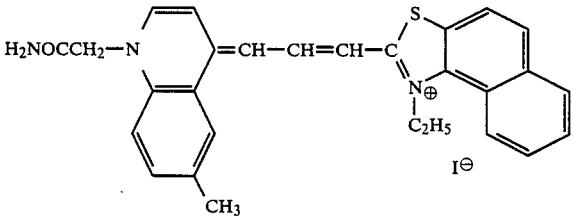
RD-36
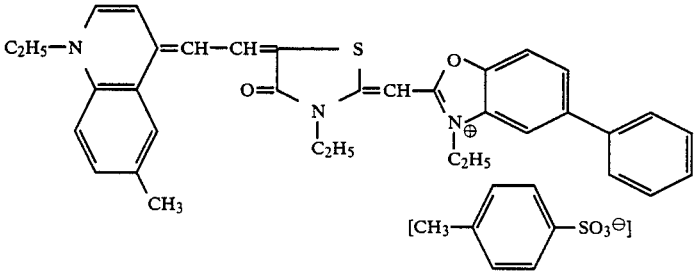

-continued
RD-37
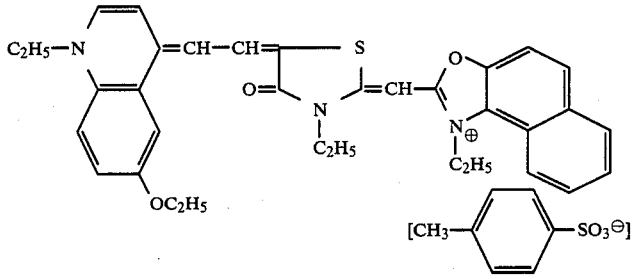
RD-38
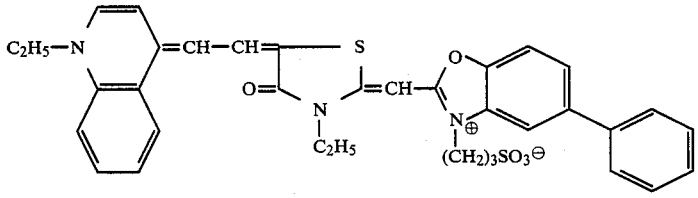
RD-39
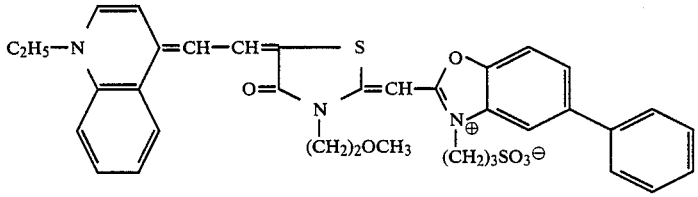
RD-40
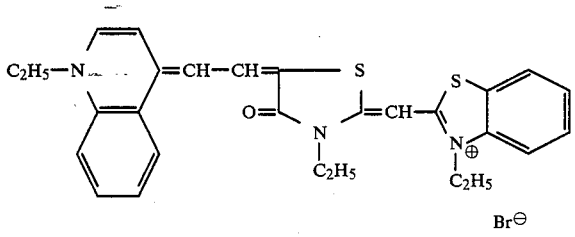
RD-41
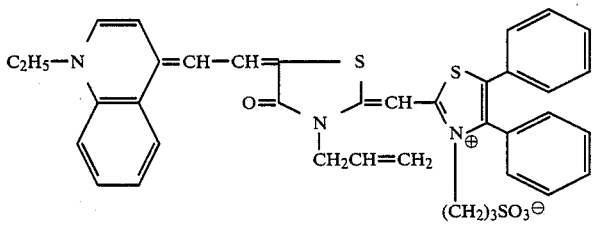
RD-42
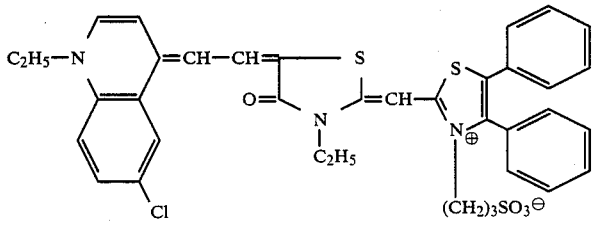

-continued

RD-43

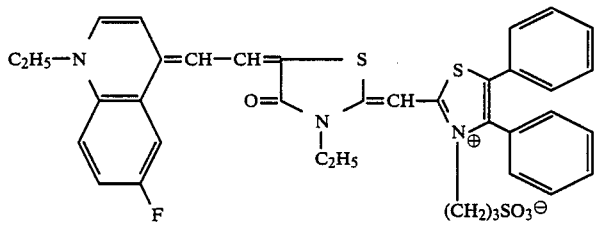

The sensitizing dyes of the invention may be added into an emulsion in any mothods well known in the art. For example, these sensitizing dyes may be dispersed directly into an emulsion, or they are dissolved in such a water-soluble solvent such as pyridine, methyl alcohol, ethyl alcohol, methyl cellosolve, acetone or the mixtures thereof, or they are diluted with water or dissolved in water so as to add them in the form of a solution into the emulsion. It is also allowed to use a supersonic oscillation in the course of the dissolution. Besides the above, it is also allowed to use such a method as mentioned in U.S. Pat. No. 3,469,987 and so forth, in which such dyes are dissolved in a volatile organic solvent and the resulted solution is dispersed in a hydrophilic colloid and the resulted dispersion is then added into an emulsion; and such a method as mentioned in Japanese Patent Examined Publication No. 24185-1971 and so forth, in which water-insoluble dyes are dispersed in a water-soluble solvent without dissolving the dyes and the resulted dispersion is added into an emulsion. Dyes may be added in the form of dispersion prepared in an acid dissolution dispersion method into an emulsion. Besides the above, they may also be added into an emulsion in such a method as described in, for example, U.S. Pat. Nos. 2,912,345, 3,342,605, 2,996,287 and 3,425,835, and so forth. The time of adding the sensitizing dyes used in the invention, into an emulsion may be at any point of time from the time of forming silver halide grains until the time before an emulsion is coated over to a support in the course of manufacturing a light-sensitive material.

To be more concrete, it is allowed to add such dyes at any point of time selected from the points of time consisting of a point of time before silver halide grains are formed, a point of time during the silver halide grains are being formed, a point of time between a time after the silver halide grains are formed and a time before a chemical sensitization is commenced, a point of time when a chemical sensitization is commenced, a point of time during the chemical sensitization is being carried out, a point of time when the chemical sensitization is completed, and a point of time between a time after the chemical sensitization is completed and a time before an emulsion is coated over. The dyes may also be added severally. The sensitizing dyes of the invention and other sensitizing dyes may further be used in combination, that is so-called a supersensitization combination. In this case, it is allowed to add them in an emulsion in such a manner that each of the sensitizing dyes is dissolved in the same or different solvent, and the resulted solutions are mixed together before the solutions are added into the emulsion, or the resulted solutions are added separately into the emulsion. In the case of adding them separately, the adding order and adding intervals may be determined at will according to the purposes of using such emulsions.

Furthermore, the sensitizing dyes represented by Formula [III], [IV] or [V] are preferably to be used with a supersensitizer to provide a high sensitizer effect on the silver halide emulsion of the invention.

The substance named herein a 'supersensitizer' means those not capable of displaying any spectral sensitizing by themselves but displaying a 'Sepuersensitization' of which has been well-known in the art when they are jointly used with the sensitizing dyes relating to the invention.

These supersensitizers include, for example, an aromatic organic acid formaldehyde condensation product such as those described in U.S. Pat. No. 3,437,510, a cadmium salt, an azaindene compound, an aminostilbene compound substituted with a nitrogen-containing heterocyclic group such as those described in U.S. Pat. Nos. 2,933,390 and 3,635,721, and so forth.

Particularly preferable supersensitizers relating to the invention include, for example, the condensation polymer of the compounds represented by the following Formula [VI] and hexamethylenetetraamine or the compounds represented by the following Formula [VII].

Formula [IV]

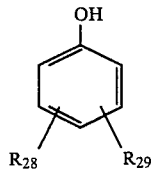

wherein $R_{28}$ and $R_{29}$ represent a hydrogen atom, a hydroxyl group, a carboxyl group, a halogen atom, an alkyl group having 1 to 5 carbon atoms such as a methyl group, an ethyl group, a butyl group and so forth, or alkoxy groups such as a methoxy group, an ethoxy group and so forth.

Formula [VII]

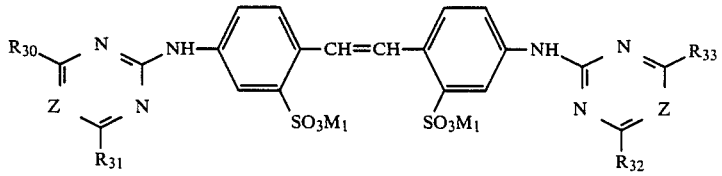

-continued wherein —Z= represents —CH= or —N=; $R_{30}$, $R_{31}$, $R_{32}$ and $R_{33}$ each represent a hydrogen atom, a halogen atom, a sulfonic acid group including the salts thereof, or a mono-valent organic group and, more preferably, halogen atoms such as a chlorine atom, a bromine atom and so forth, a hydroxyl group, an alkylamino group, an alkoxy group, an alkylthio group, an arylamino group, an aryloxy group and an arylthio group, respectively; $M_1$ represents mono-valent cations such as those of sodium ion, potassium ion, ammonium ion and so forth; the alkyl components of the above-given alkylamino group, alkoxy group and alkylthio group include, for example, methyl, ethyl, hydroxyethyl, butyl and so forth; and the aryl components of the above-given arylamino group, aryloxy group and arylthio group include, for example, phenyl, naphthol and so forth.

The typical examples of the supersensitizers relating to the invention will be given below. It is, however, to be understood that the invention shall not be limited thereto.

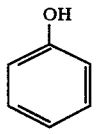

A condensation polymer of hexamethylene tetramine and the following compound B-1

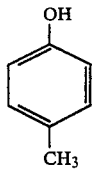

A condensation polymer of hexamethylene tetramine and the following compound B-2

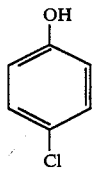

A condensation polymer of hexamethylene tetramine and the following compound B-3

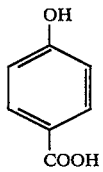

A condensation polymer of hexamethylene tetramine and the following compound B-4

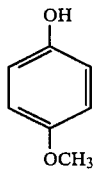

A condensation polymer of hexamethylene tetramine and the following compound B-5

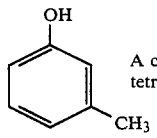

A condensation polymer of hexamethylene tetramine and the following compound B-6

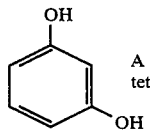

A condensation polymer of hexamethylene tetramine and the following compound B-7

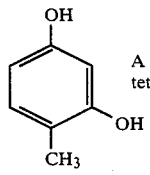

A condensation polymer of hexamethylene tetramine and the following compound B-8

-continued
B-9
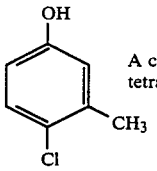
A condensation polymer of hexamethylene tetramine and the following compound
B-10
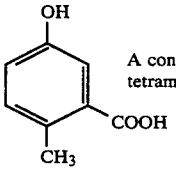
A condensation polymer of hexamethylene tetramine and the following compound
B-11
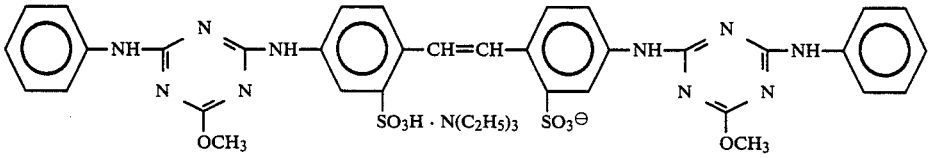
B-12
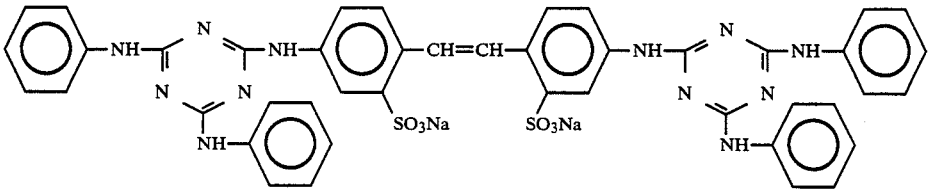
B-13
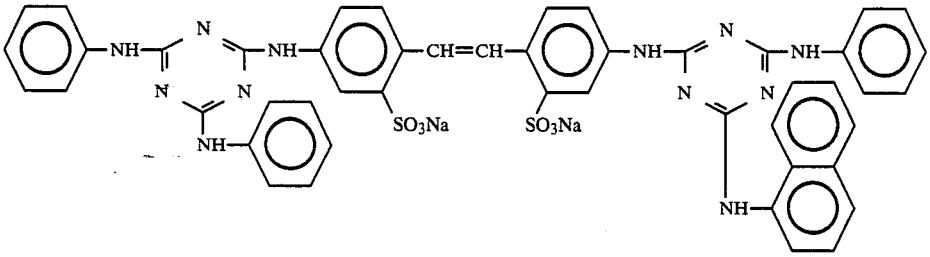
B-14
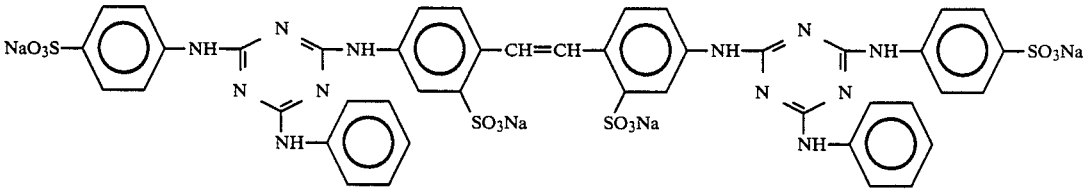
B-15
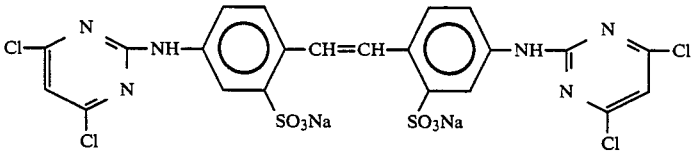
B-16
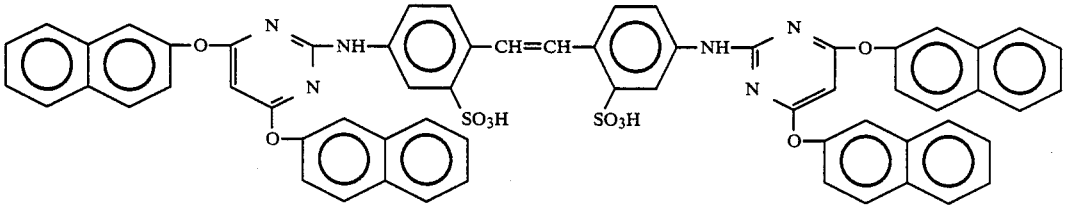

-continued

B-17

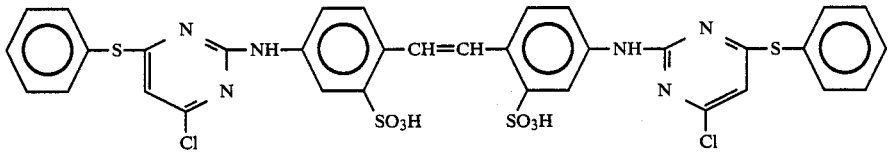

B-18

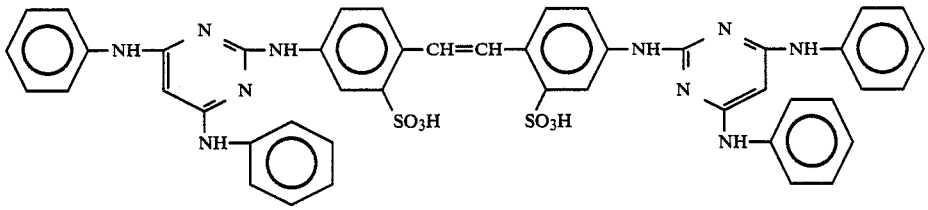

The sensitizing dyes relating to the invention and the supersensitizers may be added into a hydrophilic colloid containing silver halide grains in such a manner that they are dissolved in water or an organic solvent which may freely be mixed with water, such as methanol, ethanol, fluorinated alcohol, 1,4-butanediole, dimethylformamide, dioxane, benzene, chloroform, pyridine, ligroin, acetone, triethyleneglycolmonomethyl ether, triethanolamine, methylcellosolve, ethylcellosolve, phenylcellosolve and so forth, and the resulted solution is to be added to the colloid. These sensitizing dyes and the supersentitizers may be used independently or in combination.

They may be added into the hydrophilic colloid at any points of time during the chemical sensitization of an emulsion or after the completion of the chemical sensitization thereof, before or after a stabilizer or an antifogging agent is added into the colloid, and between one of the above-mentioned points of time and the time before a coating is made.

As for the order of adding the sensitizing dyes relating to the invention and the supersensitizers, either of the two may be added first or the two may be added at the same time. Further, they may be added in the form of the mixed solution thereof.

There is no special limitation to the amounts thereof to be added. However, the sensitizing dyes relating to the invention may usually be added an an amount of from about $1\times10^{-6}$ to $1\times10^{-3}$ mol per mol of the silver halide used and should preferably be added in an amount of $5\times10^{-6}$ to $5\times10^{-4}$ mol. The supersensitizers relating to the invention may usually be added in an amount of $1\times10^{-2}$ grams per mol of the silver halide and should preferably be added in an amount of $5\times10^{-2}$ grams.

Next, the description of inorganic sulfur capable of being used with the sensitizing dyes relating to the invention will be made below.

In the invention, the term, 'inorganic sulfur', means the so-called simple substance of sulfur not forming a compound together with any other element. In the industrial field of this art, 'inorganic sulfur' of the invention does not include any sulfur-containing compounds known as a photographic additive such as sulfides, sulfuric acid or the salts thereof, sulfurous acid or the salts thereof, thiosulfuric acid or the salts thereof, sulfonic acid or the salts thereof, a thioether compound, a thiourea compound, a mercapto compound a sulfur-containing heterocyclic compound and so forth.

It has been known that simple sulfur, which is used in the invention as the inorganic sulfur, has several allotropes, and they are allowed to use any one of the allotropes.

Among the allotropes, those stable at room temperature are α-sulfur belonging to those of the rhombic system which are preferably used in this invention.

When adding the 'inorganic sulfur' relating to the invention, is may be added in the form of a solid as it is. It is, however, rather preferable to add it in the form of a solution. Such inorganic sulfur is not soluble with water, but it has been known that it is soluble with carbon disulfide, sulfur chloride, benzene, diethylether, ethanol or the like. It is preferable to add the inorganic sulfur upon dissolving with the above-given solvent. Among the solvents for the inorganic sulfur, in particular, ethanol is more preferably be used, from the viewpoints of handling convenience, photographic influence and so forth.

The suitable amount of the inorganic sulfur added may be depended on the kinds, expected effects and so forth of a silver halide emulsion to be applied. However, such amount is within the range of from $1\times10^{-5}$ mg to 10 mg per mol of the silver halide used and, more preferably, from $1\times10^{-3}$ mg to 5 mg.

The points of time for adding such inorganic sulfur may be any points in a silver halide photographic light-sensitive material preparing steps, namely, any step selected from the group consisting of a silver halide grain forming step, a chemical sensitizing step that is also called a chemical ripening step, a coating solution preparing step and a coating and drying step. To be more concrete, such inorganic sulfur may be added at the time before or after the nuclei of silver halide crystals are produced. Thus crystals may be grown in the presence of inorganic sulfur. Besides the above, inorganic sulfur may also be added at the time either before or after the excessive salts are removed after crystal growth was completed.

In the step of chemical sensitization, inorganic sulfur is added at any point of time selected from the group consisting of the points of time when a chemical sensitization is commenced, i.e., when a chemical sensitizer is added, when the chemical sensitization is kept go on, and when the chemical sensitization is completed, i.e., when a chemical sensitization stopper is added.

In the coating solution preparing step, the coating solution is prepared by mixing up a silver halide emulsion, a coupler dispersion and, if required, a variety of additives such as an aqueous gelatin solution, a surface active agent, a thickener, a hardener, a dyestuff, a development inhibitor and so forth, and the prepared coating solution is then added at any point of time, namely, between the time after a chemical sensitization is completed and the time before a coating is made.

In each of the above-mentioned steps, the preferable point of time of adding inorganic sulfur is before the step of stopping the chemical sensitization is completed.

In this case, an amount of the inorganic sulfur to be suitably added may be varied according to the kinds or the expected effects of a silver halide emulsion to be applied. It is, however, added in an amount of from $1\times10^{-5}$ mg to 10 mg per mol of the silver halide used and, more preferably, from $1\times10^{-3}$ mg to 5 mg.

In the invention, the whole amount of inorganic sulfur may be added either at a time for one case or at several times separately for the other case. One of the preferable examples of the latter case may be given as that inorganic sulfur is added in the step of starting the chemical sensitization of a silver halide emulsion and further inorganic sulfur is then added in the step of completing the chemical sensitization thereof.

In the latter case, a suitable amount of inorganic sulfur further added depends on what kind of silver halide emulsion is to be used, what effect is to be expected, and so forth. However, the amount of inorganic sulfur to be added is within the range of from $1\times10^{-5}$ mg to 9.9 mg per mol of a silver halide used and preferably from $1\times10^{-3}$ mg to 4.9 mg. In the latter case, the whole amount of inorganic sulfur to be added is within the range of from $2\times10^{-5}$ mg to 10 mg per mol of a silver halide used and preferably from $2\times10^{-3}$ mg to 5 mg.

In the case that a silver halide emulsion is prepared by making inorganic sulfur present therein before the step of stopping a chemical sensitization is completed. Inorganic sulfur may be added at any points of time and in any steps before the step of stopping a chemical sensitization is completed. To be more concrete, it is allowed to add at any point of time selected from any point of time before silver halide grains are formed or during they are being formed, any point of time a time after the silver halide grains are formed to a time before a desalting step, any point of time from a time after the desalting step is completed to a time before a chemical sensitization is commenced, any point of time when the chemical sensitization is commenced, being processed or stopped, and any point of time from a time after the chemical sensitization is stopped to a time before the chemical sensitization is completed; preferably, any point of time from a time when the chemical sensitization commencing step is commenced to a time when the chemical sensitization stopping step is completed; and, more preferably, any point of time from a time about 10 minutes before the stopping step is commenced to a time about 30 minutes after the stopping step is commenced.

The above-mentioned chemical sensitization commencing step means a step in which a necessary operation for a chemical sensitization is carried out. For example, there include the operations of dissolving an emulsion, raising an emulsion temperature, casting additives which are necessary for commencing the chemical sensitization, and so forth. In the chemical sensitization commencing step, the point of time when a chemical sensitization is commenced is defined as a point of time when a chemical sensitizer is added in.

The above 'chemical sensitization stopping step' means that a step in which an opration necessary for stopping a chemical sensitization is carried out. Such an operation include a casting of an additive necessary for stopping a chemical sensitization such as a chemical sensitization stopper, and the above-mentioned step include a course between the completion of casting the additive and the next step such as a cold-storage of emulsions, a coating solution preparation and so forth. Inorganic sulfur may be added at any point of time substantially in the course of the chemical sensitization stopping step and, to be more concrete, at the same time of or within 10 minutes before or after adding the chemical sensitization stopper and, more preferably, at the same time or 5 minutes before or after adding it.

Inorganic sulfur may be added into silver halide emulsions and, besides, the other photographic component layers than the emulsions, such as a protective layer, an interlayer, a filter layer and so forth.

When adding inorganic sulfur into the photographic component layers, it is preferred to add it in an amount of from 1.5 times to 3 times more than that added into silver halide emulsion layers.

In the invention, such a chemical sensitizer as a chalcogen sensitizer may be used. Chalcogen sensitizer is a generic name of a sulfur sensitizer, a selenium sensitizer, and tellurium sensitizer and, for photographic use, a sulfur sensitizer and a selenium sensitizers are preferably used. As for the sulfur sensitizers, those having been well-known may be used and which include, for example, a thiosulfate, allylthiocarbazide, thiourea, allylisothiocyanate, cystine, a p-toluenethiosulfonate and rhodanine. Besides the above, it is also allowed to use such sulfur sensitizers as those described in, for example, U.S. Pat. Nos. 1,574,944, 2,410,689, 2,278,947, 2,728,668, 3,501,313 and 3,656,955; West German Patent (OLS) Publication No. 1,422,869; Japanese Patent O.P.I. Publication Nos. 24937-1981 and 45016-1980; and so forth. The amount of a sulfur sensitizer added is varied considerably according to the various conditions such as pH values, temperatures, silver halide grain sizes and so forth. It is preferable that the rough standard thereof is of the order of from $10^{-7}$ mol to $10^{-1}$ mol per mol of the silver halide used.

It is also allowed to use a selenium sensitizer in place of the sulfur sensitizers. The applicable selenium sensitizers include, for example, aliphatic isoselenocyanates such as allylisoselenocyanate, selenoureas, selenoketones, selenoamides, selenocarboxylates and the esters thereof, selenophosphates, and selenides such as diethylselenide, diethyldiselenide and so forth. The typical examples thereof are described in for example, U.S. Pat. Nos. 1,574,944, 1,602,592 and 1,623,499, and so forth. Furthermore, it is allowed to use a reduction sensitization in combination therewith. As for the redusing agents, there is no special limitation thereto, however, the examples thereof may be given as stannous chloride, thiourea dioxide, hydrazine, polyamine and so forth which have so far been well-known. Besides the above, it is further allowed to use such a noble-metal compounds as a gold compound, a platinum compound, a palladium compound and so forth.

In the invention, the requirements for carrying out a chemical sensitization may be varied according to the silver halide grains used or photographic characteristics expected, however, the temperature requirement is from 35° C. to 70° C., the pH requirement is from 5.0 to 7.0 and pAg requirement is from 6.0 to 8.5, respectively, as the rough standards thereof. The time required for a chemical sensitization may be usually determined in such a manner that the photographic characteristics are checked up timestepwise in advance under the above-mentioned requirements for a chemical sensitization and, from which the period of time is selectively determined so as to display the most preferable photographic characteristics such as a low fogginess, a high sensitivity, a high contrast and so forth. For the determination of the period of time, it is very often that the preparation stability, the working efficiency in the preparation steps and so forth are taken into consideration. Therefore, a rough yardstick thereof is a period of time from some tens of minutes to some hours.

The above-mentioned chemical sensitization may be stopped in operation in the methods having been known in the art. These well-known methods include, for example, the methods in which a temperature is lowered, a pH is lowered, a chemical sensitization stopping agent is used or the like. Taking the stability of emulsions into consideration, the method using the chemical sensitization stopping agents is preferably used. The known chemical sensitization stopping agents include halides such as potassium bromide, sodium chloride and so forth and the organic compounds having been known as an antifogging agent or a stabilizer such as 7-hydroxy-5-methyl-1,3,4,7a-tetrazaindene and so forth. They may be used independently or in combination with a plurality of compounds.

There is no special limitation to the silver halide compositions of light-sensitive silver halide grains used in the invention. Such silver halides may include silver chloride, silver bromide, silver iodide, silver chlorobromide, silver iodobromide and silver chloroiodobromide. It is also allowed to use the mixture of these grains.

From the viewpoint that the effects of the invention can become more remarkable when using the sensitizing dyes relating to the invention and inorganic sulfur in combination, the silver halide grains used in the invention has a silver chloride content of not less than 90 mol% and, preferably, not less than 95 mol%; a silver bromide content of not more than 10 mol% and, preferably, not more than 5 mol%; and a silver iodide content of, preferably, zero. Further preferable silver halide grains used in the invention are those of silver chlorobromide having a silver bromide content of from zero to 5 mol% or silver chloride. In the invention, a high sensitization and a raw product preservability can be much improved at the same time when silver halide grains having a silver chloride content of not less than 90 mol% are gold-sensitized.

The compositions of silver halide grains used in the invention may be either those in which the grains are uniform from the inside through the outside thereof, or those in which the compositions of the inside and the outside thereof are different from each other. In the case of the latter, the composition may be varied either continuously or discontinuously.

There is no special limitation to the grain sizes of silver halide grains used in the invention, however, taking the rapid processability, sensitivity, other photographic characteristics and so forth into consideration, the grain sizes thereof should be within the range of, preferably, from 0.2 to 1.6 μm and, more preferably, from 0.25 to 1.2 μm.

In the technical field of the art, the above-mentioned grain sizes may be measured in various methods generally used. The typical methods include thos described in, for example, R. P. Loveland, 'Particle-Size Measurement', ASTM Symposium on Light Microscopy, 1955, pp. 94–122; or Mees and James, 'The Theory of the Photographic Process', 3rd Ed., The Macmillan Company, 1966. Chapter 2.

The above-mentioned grain sizes may be measured by making use of the projective areas of grains or a direct approximate values thereof.

When grains are substantially in the uniform shape, a considerably accurate grain distribution may be expressed in terms of the diameters or projective areas of the grains.

The grain size distribution of the silver halide grains relating to the invention may be either of multidisperse type or of unidisperse type and, preferably, of the monodisperse type. More preferably, the variation coefficient in the grain distribution of silver halide grains should be not more than 0.22 and, more preferably, monodisperse silver halide grains having a variation coefficient of not more than 0.15.

The variation coefficient used herein means a coefficient indicating a grain size distribution and shall be defined by the following formula.

$$\text{Variation coefficient } (S/r) = \frac{\text{Standard deviation of grain size distribution}}{\text{Average grain size}}$$

$S$ = Standard deviation of grain size distribution $$S = \sqrt{\frac{\Sigma(r - ri)^2 ni}{\Sigma ni}}$$

$$(r) = \text{Average grain size} = \frac{\Sigma niri}{\Sigma ni}$$

wherein ri represents the grain sizes of individual grains, and ni is the number of grains. The term, 'grain size', used herein means a grain diameter when silver halide grains are in the globular shape, and the diameter of a circular image equivalent in area to the image area of the projective image of grains when the grains are in the cubic shape or the other shapes than the circular shape.

The silver halide grains used in the invention may be any ones obtained in an acid process, neutral process or ammonia process. Such grains may be grown up at a time or after seed grains are prepared.

A process of preparing the seed grains and a process of growing grains may be the same with or the different from each other.

As for the methods of reacting a soluble silver salt with a soluble halide, it is allowed to use any one of a normal precipitation method, a reverse precipitation method, a double-jet precipitation method, the combination method thereof and so forth. However, the grains obtained in the double-jet precipitation methods are preferable to use. As for one of the double-jet precipitation methods, it is allowed to use a pAg-controlled-double-jet precipitation method described in Japanese Patent O.P.I. Publication No. 48521-1979 and so forth.

If required, it is also allowed to use such a silver halide solvent as thioether and so forth.

It is further allowed to use any shapes of the silver halide grains relating to the invention.

One of the preferable examples is a cube having a {100} plane as the surface of the grain crystal. It is also allowed to use the grains having the octahedral, tetradeca hedral, dodeca hedral or the like shape prepared in the methods described in, for example, U.S. Pat. Nos. 4,183,756 and 4,225,666, Japanese Patent O.P.I. Publication No. 26589-1980, Japanese Patent Examined Publication No. 42737-1980, The Journal of Photographic Science, 21, 39, 1973, and so forth.

The grains having twin-crystalline faces may also be used.

As for the silver halide grains relating to the invention, the grains in one and single form and the grains in variously mixed forms may also be used.

In the courses of forming grains and/or growing them, the silver halide grains used in the emulsions of the invention may be added with metal ions by making use of a cadmium salt, a zinc salt, a lead salt, a thallium salt, an iridium salt or the complex salts thereof, a rhodium salt or the complex salts thereof, or an iron salt or the complex salts thereof, so that the metal ions may be contained in the inside and/or the surface of the grains. Further, a reduction-sensitization nucleus may be provided to the inside and/or surface of grains by placing the grains in a suitable reducible atmosphere.

Unnecessary soluble salts may be removed from the emulsions of the invention upon completing the growth of silver halide grains, or may be contained as they are in the emulsions.

Such salts may be removed in the method described in Research Disclosure No. 17643.

The silver halide grains used in the emulsions of the invention may be either those capable of forming a latent image mainly on the surface thereof or those capable of forming a latent image mainly inside the grains. However, the preferable grains are those capable of forming a latent image mainly on the surface thereof.

It is allowed to add the compounds so-called antifogging agents or stabilizers into the silver halide emulsion of the invention, for the purposes of applying an optimum chemical sensitization and preventing the lowering of sensitivity or the occurrence of fog during the reservation or development process of the light-sensitive material.

Among these compounds, the well-known ones include, for example, many kinds of heterocyclic compounds, mercapto compounds and so forth, such as 4-hydroxy-6-methyl-1,3,3a,7-tetrazaindene, 3-methylbenzothiazole, 1-phenyl-5-mercaptotetrazole. As for the compounds capable of keeping a high sensitivity and lowering fogginess caused in raw product preservation, a purine derivative compound [SI] and the mercapto type compounds represented by the following Formula [SII] may preferably be used.

Formula [SII]

Zo—SM wherein Zo represents a heterocyclic residual group; and M represents a hydrogen atom, an alkali-metal atom or ammonium.

More preferably, the mercapto type compounds represented by the following Formula [So] should be used.

Formula [So]

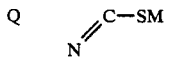

Wherein Q represents a group of atoms necessary to complete a 5- or 6-membered heterocyclic ring or a 5- or 6-membered heterocyclic ring condensed with a benzene ring; and M represents a hydrogen atom or a cation.

The mercapto compounds represented by Formula [So] will now be described below.

In Formula [So], Q represents a group of atoms necessary to complete a 5- or 6-membered heterocyclic ring or a 5- or 6-membered heterocyclic ring condensed with a benzene ring. Such heterocyclic rings completed with Q include, for example, an imidazole ring, a tetrazole ring, a thiazole ring, an oxazole ring, a selenazole ring, a benzimidazole ring, a naphthoimidazole ring, a benzothiazole ring, a naphthothiazole ring, a benzoselenazole ring, a naphthoselenazole ring, a benzoxazole ring and so forth.

The cations represented by M include, for example alkali metals such as sodium, potassium and so forth, an ammonium group and so forth.

The more preferable mercapto compounds represented by Formula [So] are represented by the following Formulas [SA], [SB], [SC] and [SD], respectively.

Formula [SA]

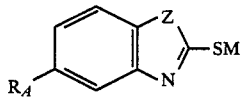

wherein $R_A$ represents a hydrogen atom, an alkyl group, an alkoxy group, an aryl group, a halogen atom, a carboxyl group or the salts thereof, a sulfo group and the salts thereof, or an amino group; Z represents —NH—, —O— or —S—; and M is synonymous with that denoted in Formula [SI].

Formula [SB]

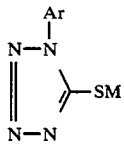

wherein Ar represents

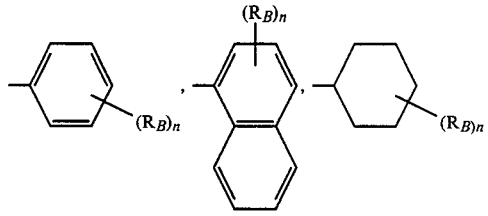

$R_B$ represents an alkyl group, an alkoxy group, a carboxyl group or the salts thereof, a sulfo group or the salts thereof, a hydroxyl group, an amino group, an acylamino group, a carbamoyl group or a sulfonamido group; n is an integer of 0 to 2; and M is synonymous with that denoted in Formula [SI].

In the above-given Formulas [SA] and [SB], the alkyl groups represented by $R_A$ and $A_B$ include, for example, a methyl group, an ethyl group, a butyl group and so forth; the alkoxy groups include, for example, a methoxy group, an ethoxy group and so forth; the salts of the carboxyl groups or sulfo groups include, for example, a sodium salt or an ammonium salt, respectively.

In the above-given Formula [SA], the aryl groups represented by $R_A$ include, for example, a phenyl group, a naphthyl group and so forth; and the halogen atoms include, for example, a chlorine atom, a bromine atom and so forth.

In the above-given Formula [SB], the acylamino groups represented by $R_B$ include, for example, a methylcarbonylamino group, a benzoylamino group and so forth; the carbamoyl groups include, for example, an ethylcarbamoyl group, a phenylcarbamoyl group and so forth; and the sulfonamido groups include, for example, a methylsulfonamido group, a phenylsulfonamido group and so forth, respectively.

The above-given alkyl, alkoxy, aryl, amino, acylamino, carbamoyl, sulfonamido and the like groups further include those having a substituent.

Formula [SC]

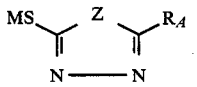

wherein Z represents

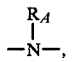

an oxygen atom or a sulfur atom; $R_A$ represents a hydrogen atom, an alkyl group, an aryl group, an alkenyl group, a cycloalkyl group, $—SR_{A1}$,

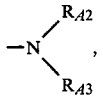

$—NHCOR_{A4}$, $—NHSO_2R_{A5}$, or a heterocyclic group; $R_{A1}$ represents a hydrogen atom, an alkyl group, an alkenyl group, a cycloalkyl group, an aryl group, $—COR_{A4}$ or $—SO_2R_{A5}$; $R_{A2}$ and $R_{A3}$ represent a hydrogen atom, an alkyl group or an aryl group, respectively; $R_{A4}$ and $R_{A5}$ represent an alkyl group or an aryl group, respectively; and M is synonymous with that denoted in Formula [SI].

In the above-given Formula [SC], the alkyl groups represented by $R_A$, $R_{A1}$, $R_{A2}$, $R_{A3}$, $R_{A4}$ and $R_{A5}$ include, for example, a methyl group, a benzyl group, an ethyl group, a propyl group and so forth; the aryl groups include, for example, a phenyl group, a naphthyl group and so forth, respectively.

The alkenyl groups represented by $R_A$ and $R_{A1}$ include, for example, a propenyl group and so forth; the cycloalkyl groups include, for example, a cyclohexyl group and so forth. The heterocyclic groups represented by $R_A$ include, for example, a furyl group, a pyridinyl group and so forth, respectively.

The alkyl and aryl groups represented by $R_A$, $R_{A1}$, $R_{A2}$, $R_{A3}$, $R_{A4}$ and $R_{A5}$, the alkenyl and cycloalkyl groups representd by $R_A$ and $R_{A1}$, and the heterocyclic groups represented by $R_A$, each further include those having a substituent.

Formula [SD]

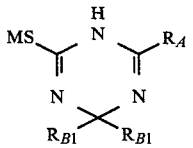

wherein $R_A$ and M represent the groups sunonymous with those represented by $R_A$ and M denoted in Formula [SC]; and $R_{B1}$ and $R_{B2}$ represent the groups synonymous with those represented by $R_{A1}$ and $R_{A2}$ denoted in Formula [SC], respectively.

The typical examples of the purine derivative compounds and the compounds represented by Formula [So] will be given below. It is, however, to be understood that the invention shall not be limited thereto.

S-1

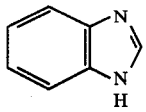

S-2

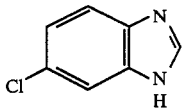

S-3

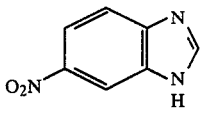

S-4

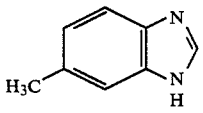

S-5

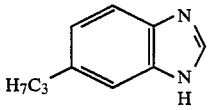

S-6

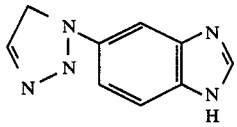

S-7

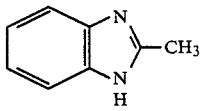

S-8

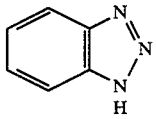

S-9

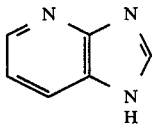

S-10

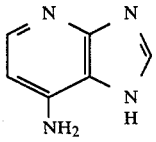

-continued
S-11
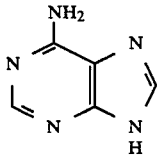
S-12
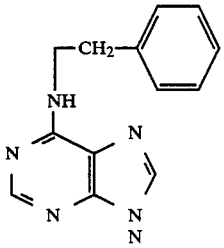
S-13
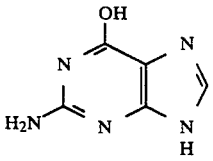
S-14
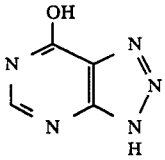
S-15
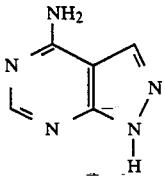
S-16
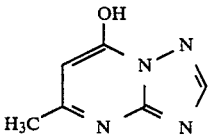
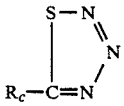
| Exemplified Compound No. | $R_c$ |
|---|---|
| S-17 | $-NH_2$ |
| S-18 | 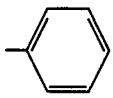 |
| S-19 | 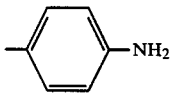 |
| S-20 | $-NO_2$ |
-continued
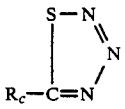
| Exemplified Compound No. | $R_c$ |
|---|---|
| S-21 | 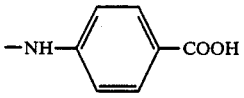 |
| S-22 | 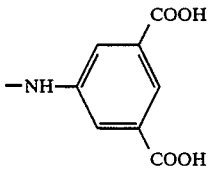 |
| S-23 | 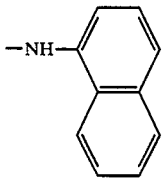 |
| S-24 | 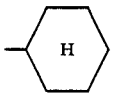 |
| S-25 | 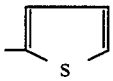 |
| S-26 | 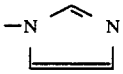 |
| S-27 | 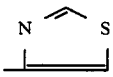 |
SA-1
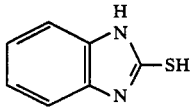
SA-2
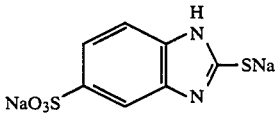
SA-3
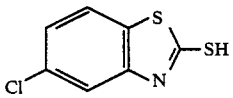
SA-4
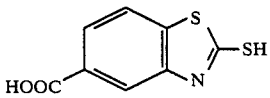

-continued
SA-5
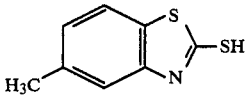
SA-6
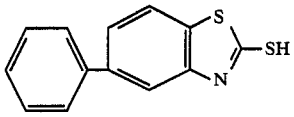
SA-7
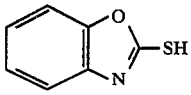
SA-8
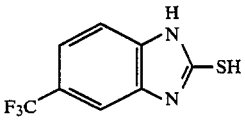
SB-1
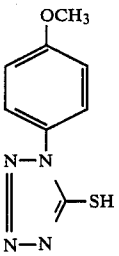
SB-2
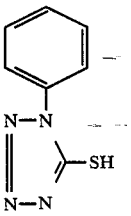
-continued
SB-3
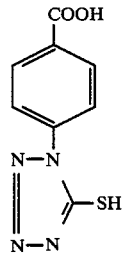
SB-4
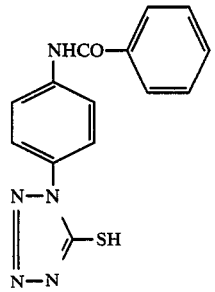
SB-5
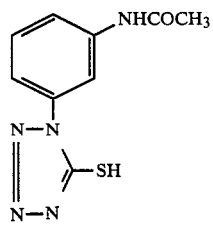
SB-6
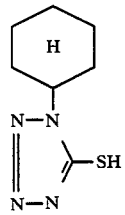
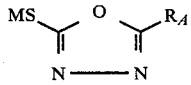
| Exemplified Compound No. | $R_A$ | M |
|---|---|---|
| SC-1 | $-C_2H_5$ | —H |
| SC-2 | $-CH_2-CH=CH_2$ | —H |
| SC-3 | $-CH=CH-CH_2-CH_3$ | —H |
| SC-4 | $-C_7H_{15}$ | —H |
| SC-5 | $-C_9H_{19}$ | —Na |
| SC-6 | 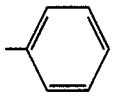 | —H |
| SC-7 | $-C_4H_9(t)$ | —H |
| SC-8 | 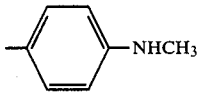 | —H |

-continued
| | | |
|---|---|---|
| SC-9 | 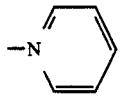 | —H |
| SC-10 | 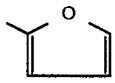 | —H |
| SC-11 | 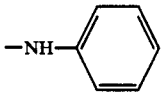 | —H |
| SC-12 | 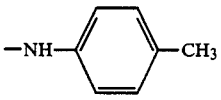 | —$NH_4$ |
| SC-13 | —$NHCOCH_3$ | —H |
| SC-14 | 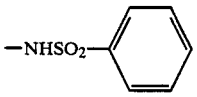 | —H |
| SC-15 | —$N(CH_3)_2$ | —H |
| SC-16 | 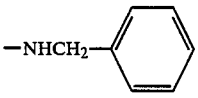 | —H |
| SC-17 | 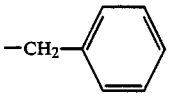 | —H |
| SC-18 | —S—$CH_3$ | —H |
| SC-19 | 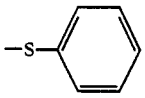 | —H |
| SC-20 | —SH | —H |
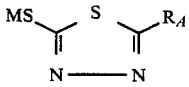
| Exemplified Compound No. | $R_A$ | M |
|---|---|---|
| SC-21 | —H | —H |
| SC-22 | —$C_2H_5$ | —H |
| SC-23 | —$C_4H_9$(t) | —H |
| SC-24 | —$C_6H_{13}$ | —H |
| SC-25 | 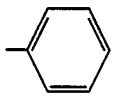 | —H |
| SC-26 | 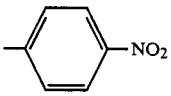 | —H |

-continued
| | | |
|---|---|---|
| SC-27 | 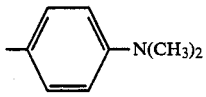 | —H |
| SC-28 | 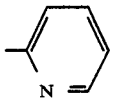 | —H |
| SC-29 | 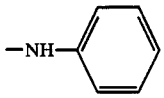 | —H |
| SC-30 | $-NH_2$ | —H |
| SC-31 | $-CH_2CH{=}CH_2$ | —H |
| SC-32 | —SH | —H |
| SC-33 | $-NHCOC_2H_5$ | —H |
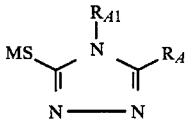
| Exemplified Compound No. | $R_A$ | $R_{A1}$ | M |
|---|---|---|---|
| SC-34 | $-C_2H_5$ | —H | —H |
| SC-35 | $-CH_3$ | $-CH_3$ | —H |
| SC-36 | $-CH_3$ | 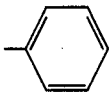 | —H |
| SC-37 | $-NHCOCH_3$ | $-CH_3$ | —H |
| SC-38 | 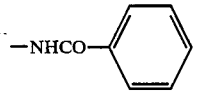 | 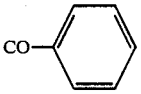 | —H |
| SC-39 | $-NHCOCH_3$ | $-COCH_3$ | —H |
| SC-40 | $-NHCOCH_3$ | 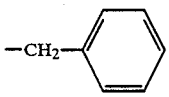 | —H |
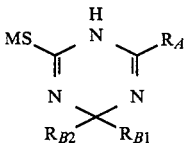
| Exemplified Compound No. | $R_A$ | $R_{B1}$ | $R_{B2}$ | M |
|---|---|---|---|---|
| SD-1 | $-C_2H_5$ | $-CH_3$ | $-CH_3$ | —H |
| SD-2 | 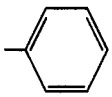 | $-CH_3$ | $-CH_3$ | —H |
| SD-3 | $-NH_2$ | —H | 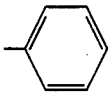 | —H |

-continued

| | | | | |
|---|---|---|---|---|
| SD-4 | 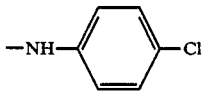 | —H | —$C_4H_9$ | —H |
| SD-5 | —$NHCOCH_3$ | —$CH_3$ | —$CH_3$ | —H |
| SD-6 | 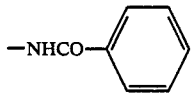 | —$CH_3$ | —$CH_3$ | —H |
| SD-7 | 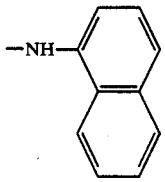 | —$CH_3$ | —$C_3H_7$(i) | —H |
| SD-8 | 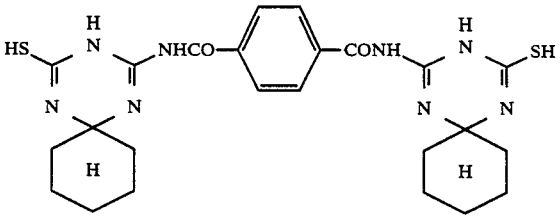 | | | |

The compounds represented by the above-given Formula [So] include those described in, for example, Japanese Patent Examine Publication No. 28496-1965; Japanese Patent O.P.I. Publication No. 89034-1975; 'Journal of Chemical Society', 49, p. 1748, 1927, and ibid., p. 4278, 1952; 'Journal of Organic Chemistry', 39, p. 2469, 1965; U.S. Pat. No. 2,824,001; 'Journal of Chemical Society', p. 1723, 1951; Japanese Patent O.P.I. Publication No. 111846-1981; British Patent No. 1,275,701; U.S. Pat. Nos. 3,266,897 and 2,403,927; and so forth. These compounds may be synthesized in accordance with the synthesizing methods described in the above-given literature.

The compounds relating to the invention which are represented by Formula [So] (hereinafter referred to as Compound [So]) may be added into a silver halide emulsion containing the silver halide grains relating to the invention in such a manner that the compound is dissolved in water or an organic solvent capable of freely mixing with water, such as methanol, ethanol or the like, and the resulted solution is added thereto. The compound [So] may be used either independently or in combination with two or more kinds of the compounds represented by Formula [So] or other stabilizers or antifogging agents than the compounds represented by Formula [So].

Compounds [So] may usually be added at a point of time when the chemical sensitization of silver halide is completed. It is also allowed to add them at any point of time selected from a point of time when silver halide grains are formed, a point of time between a time after silver halide grains are formed and a time before a chemical sensitization is carried out, a point of time when a chemical sensitization is commenced, being carried out or completed, and a point of time between a time when a chemical sensitization is completed and a time when a coating solution preparation step is being carried out. When a chemical sensitization is started and/or completed, Compound [So] may be added. It is, however most preferable to add at both time when the chemical sensitization is started and completed, from the viewpoint of increasing the effects of the invention.

There is no special limitation to the amounts of Compound [So] to be added. It is, however, usual to add in an amount of from $1\times10^{-6}$ mol to $1\times10^{-1}$ mol and, preferably, to add in an amount of from $1\times10^{-5}$ mol to $1\times10^{-2}$ mol, per mol of silver halides used.

In the invention, it is preferable to use a chlorotriazine type hardener represented by the following Formula [HDA] or [HDB] so as to harden a silver halide emulsion and to keep fogginess lower in preserving a raw product.

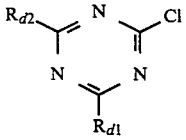

Formula [HDA]

wherein $R_{d1}$ represents a chlorine atom, a hydroxy group, an alkyl group, an alkoxy group, an alkylthio group, —OM group, in which M represents a univalent metal atom, —NR'R" group, in which R' and R" represent a hydrogen atom, an alkyl group or an aryl group, respectively), or —NHCOR''' group (in which R''' represents a hydrogen atom, an alkyl group or an aryl group), and $R_{d2}$ represents the groups synonymous with those representd by the above-denoted $R_{d1}$, except a chlorine atom.

Formula [HDB]

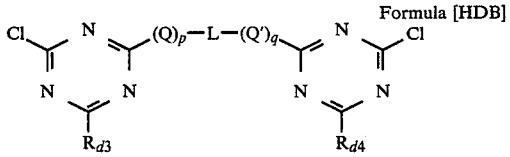

wherein $R_{d3}$ and $R_{d4}$ represent a chlorine atom, a hydroxy group, an alkyl group, an alkoxy group or —OM group in which M represents a univalent metal atom), respectively, Q and Q' represent a linkage group representing —O—, —S— or —NH—, respectively. L represents an alkylene group or an arylene group. p and q are an integer of 0 or 1, respectively.

The hardeners represented by Formula [HDA] or [HDB] may be added into a silver halide emulsion layer or other component layers in such a manner that the hardener is dissolved in water or a water-miscible solvent such as methanol, ethanol or the like and the ressulted solution is added into a coating solution for the above-mentioned component layers. Any methods of adding such hardeners such as those of a batch system or of an in-line system may be used. There is no special limitation to the points of time of adding them, however, it is peferable to add immediately before a coating is made.

These hardeners may be added in an amount of from 0.5 to 100 mg per g of gelatin coated and, more preferably, from 2.0 to 50 mg.

For the purpose of improving the stability of the silver halide photographic light-sensitive materials of the invention being allowed to stand (that means few variations in sensitivity and fogginess), it is more preferable to add the compounds represented by the following Formula [VIII].

Formula [VIII]

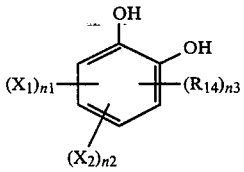

wherein $X_{11}$ and $X_{12}$ represent a hydrogen atom, a halogen atom, or a univalent group selected from the group consisting of a carboxylic acid group including the salts thereof, a sulfonic acid group including the salts thereof, a mercapto group, an alkylthio group, an acyl group, a carbamoyl group, acylamino group, an acyloxygroup, an alkyloxycarbonyl group, a sulfonamido group, an aminosulfonyl group, an alkylsulfonyl group, an alkylsulfinyl group,

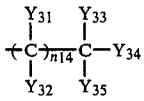

in which $Y_{31}$, $Y_{32}$, $Y_{33}$, $Y_{34}$ and $Y_{35}$ represent a hydrogen atom, a halogen atom, an amino group, a hydroxyl group, a carboxylic acid group including the salts thereof or a sulfonic acid group or the salts thereof, and $n_{14}$ is an integer of from 0 to 3, respectively; $R_{41}$ represents a halogen atom or a univalent group; $n_{11}$ and $n_{12}$ are an integer of from 0 to 4; $n_{13}$ is an integer of from 0 to 3, provided that a total of $n_1$ and $n_2$ is an integer of from 1 to 4, and a total of $n_{11}$, $n_{12}$ and $n_{13}$ is an integer of from 1 to 4, respectively.

The typical examples of the compounds represented by Formula [VIII] will be given ablow. It is, however, to be understood that the invention shall not be limited thereto.

VIII-1

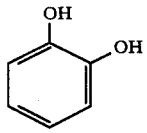

VIII-2

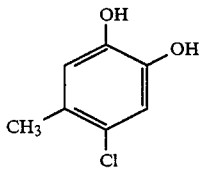

VIII-3

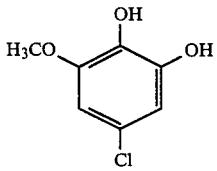

VIII-4

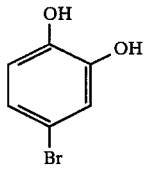

VIII-5

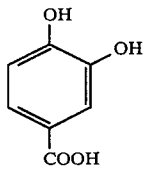

VIII-6

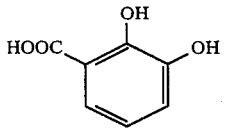

VIII-7

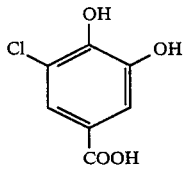

VIII-8

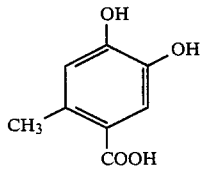

-continued
VIII-9
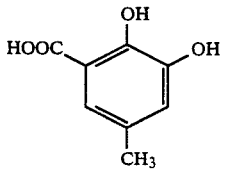
VIII-10
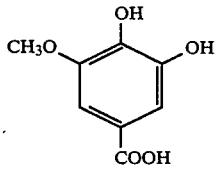
VIII-11
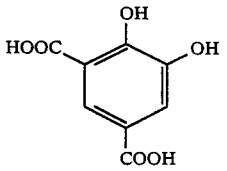
VIII-12
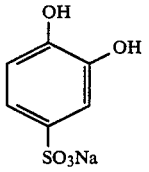
VIII-13
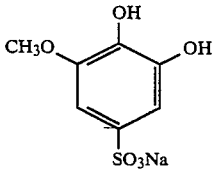
VIII-14
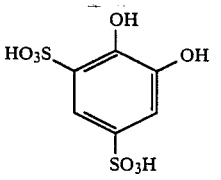
VIII-15
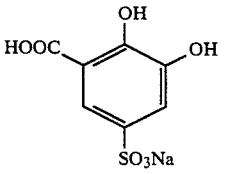
VIII-16
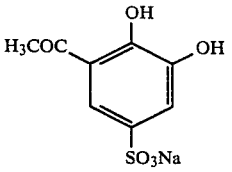
VIII-17
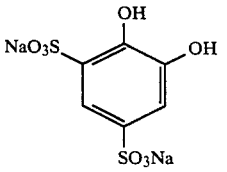
-continued
VIII-18
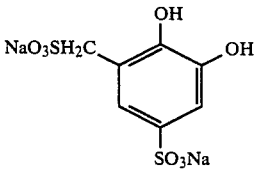
VIII-19
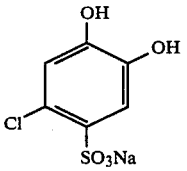
VIII-20
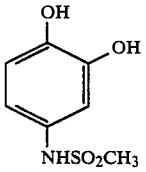
VIII-21
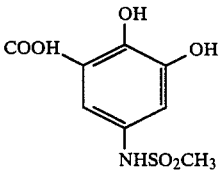
VIII-22
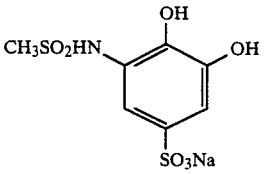
VIII-23
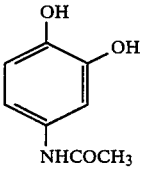
VIII-24
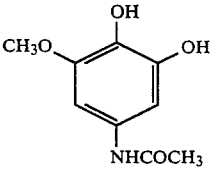
VIII-25
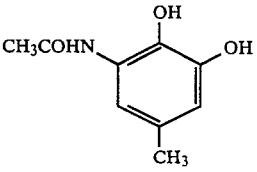
VIII-26
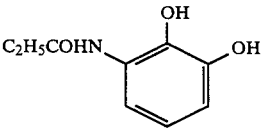

-continued

VIII-27

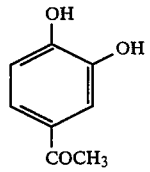

VIII-28

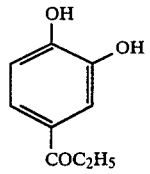

VIII-29

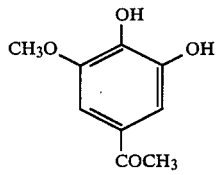

VIII-30

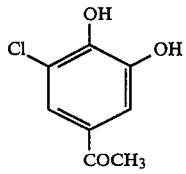

The compounds represented by Formula [VIII] may be added into the silver halide photographic light-sensitive materials of the invention in such a manner that the compound is dossolved in water or an organic solvent capable of being freely miscible with water, such as methanol, ethanol or the like, or, after the compound is dissolved in an organic solvent which may be used even if it is not miscible with water, the resulted solution is dispersed in a hydrophilic colloid, so that the dispersion may be added in the form of a solution or a dispersion into the light-sensitive materials. An amount of such compound added should preferably be in an amount of from $1.0\times10^{-5}$ to 1.0 mol per mol of silver halide used and, more peferably, from $1.2\times10^{-4}$ to $1.0\times10^{-1}$ mol. The compounds may be added at any points of time from a time when a silver halide emulsion is prepared to a time when a coating is made and, more preferably, from a time when the chemical sensitization of the silver halide emulsion is completed to a time before the emulsion is coated. Where is added may be a light-sensitive silver halide emulsion layer and/or any one of non-light-sensitive hydrophilic colloidal layers.

The silver halide photographic emulsions relating to the invention may be used not only in light-sensitive materials for black-and-white printing use but also in light-sensitive materials for color printing use. The advantages of the invention may be displayed more effectively in the latter application.

The silver halide photographic light-sensitive materials of the invention including the above-mentioned color print paper may be provided for monochromatic or multicolor use. In the case of multicolor silver halide photographic light-sensitive materials, they have usually such a structure that a support is laminated in suitable order thereon with suitable number of silver halide emulsion layers respectively containing magenta, yellow and cyan couplers to serve as the photographic couplers and non-light-sensitive layers, so as to perform a color reproduction in a color subtraction method. It is, however, allowed to change such layer number and layer arrangement order according to the characteristics aimed or the purposes of using light-sensitive materials.

In the case that the silver halide photographic light-sensitive material of the invention is a multicolor light-sensitive material, a particularly preferable layer arrangement is, typically, that a yellow dye image forming layer, an interlayer, a magenta dye image forming layer, an interlayer, a cyan dye image forming layer, an interlayer and a protective layer are arranged, in order from a support, over to the support.

In the case of applying the invention to a color light-sensitive material or in the like cases, a variety of dye-forming substances are used. The typical substances include, for example, dye-forming couplers.

As for yellow dye-forming couplers, publicly known acylacetanilid type couplers may preferably be used. Among these couplers, benzoylacetanilide type and pivaloylacetanilide type compounds may advantageously be used. The typical examples of the applicable yellow couplers are given in British Patent No. 1,077,874; Japanese Patent Examined Publication No 40747-1970; Japanese Patent O.P.I. Publication Nos. 1031-1972, 26133-1972, 94432-1973, 87650-1975, 3631-1976, 115219-1977, 99433-1979, 133329-1979 and 30127-1981; U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155 and 4,401,752; and so forth.

The diffusion-proof or ballast yellow couplers which may be used in the invention should preferably be represented by the following Formula [Y].

Formula [Y]

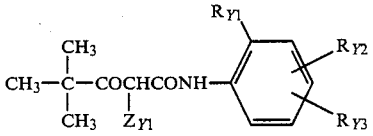

wherein $R_{Y1}$ represents a halogen atom or an alkoxy group; $R_{Y2}$ represents a hydrogen atom, a halogen atom or an alkoxy group which is allowed to have a substituent; $R_{Y3}$ represents an acylamino group, an alkoxycarbonyl group, an alkylsulfamoyl group, an arylsulfamoyl group, an arylsulfonamido group, an alkylureido group, an arylureido group, a succinimido group, an alkoxy group or an aryloxy group, each of which is allowed to have a substituent; and $Z_{Y1}$ represents a group capable of releasing upon coupling reaction with the oxidized product of a color developing agent.

In the invention, the couplers represented by the following Formulas [M] and [MI] may preferably be used as a magenta dye image forming coupler.

Formula [M]

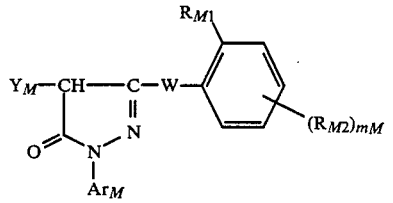

wherein $Ar_M$ represents an aryl group; $R_{M1}$ represents a hydrogen atom or a substituent; $R_{M2}$ represents a substituent; Y represents a hydrogen atom or a substituent capable of releasing upon reaction with the oxidized product of a color developing agent; W represents —NH—, —NHCO— in which the N atom couples to the carbon atom of a pyrazolone nucleus; and m is an integer of 1 or 2.

The preferable examples of the compounds represented by Formula [M] will be given as follows.

M-1

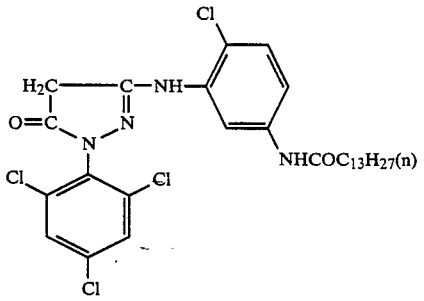

M-2

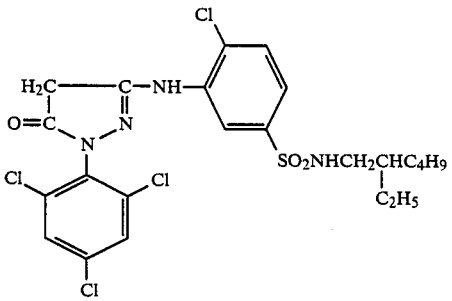

M-3

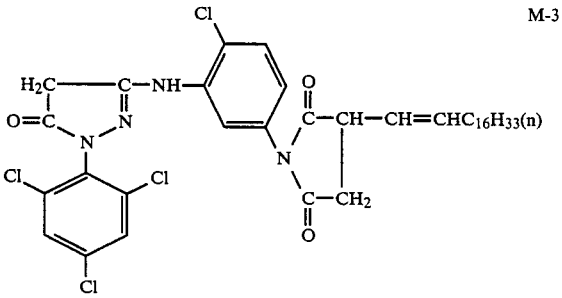

-continued

M-4

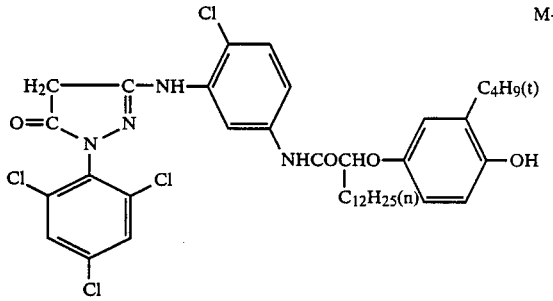

M-5

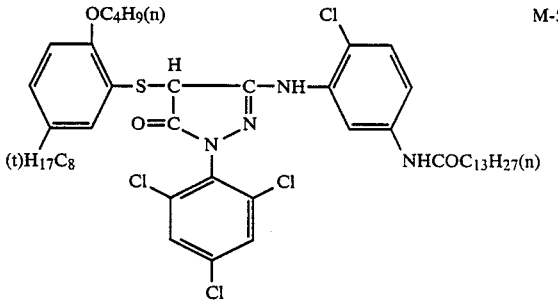

M-6

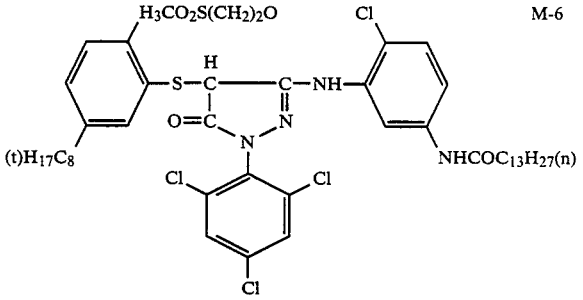

Formula [MI]

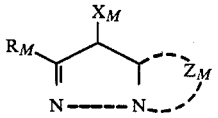

In the magenta couplers represented by the above-given Formula [MI] $Z_M$ represents a group of atoms necessary to complete a nitrogen-containing heterocyclic ring, and the rings completed by the $Z_M$ are allowed to have a substituent; $X_M$ represents a hydrogen atom or a substituent capable of releasing upon reaction of the oxidized product of a color developing agent; and $R_M$ represents a hydrogen atom or a substituent.

The substituents represented by the above-denoted $R_M$ include, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclic-oxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclicthio group.

The above-given groups are described in, for example, U.S. Pat. Nos. 2,600,788, 3,061,432, 3,062,653, 3,127,269, 3,311,476, 3,152,896, 3,419,391, 3,519,429, 3,555,318, 3,668,514, 3,888,680, 3,907,571, 3,928,044, 3,930,861, 3,930,866, 3,933,500 and so forth; Japanese Patent O.P.I. Publication Nos. 29639-1974, 111631-1974, 129538-1974, 13041-1975, 58922-1977, 62454-1978, 118034-1980, 38043-1981, 35858-1982 and 23855-1985; British Patent No. 1,247,493; Belgian Pat. Nos. 769,116 and 792,525; West German Pat. No. 2,156,111; Japanese Patent Examined Publication No. 60479-1971; Japanese Patent O.P.I. Publication Nos. 125,732-1984, 228,252-1984, 162,548-1984, 171,956-1984, 33,552-1985 and 43,659-1985; West German Pat. No. 1,070,030; U.S. Pat. No. 3,725,067; and so forth.

M-7

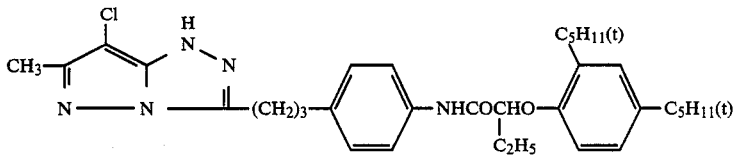

M-8

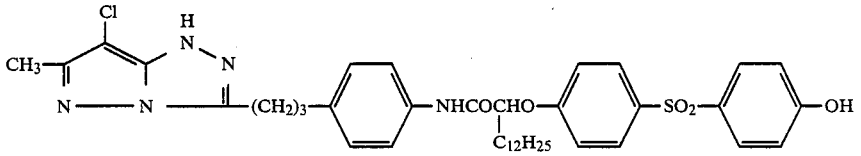

M-9

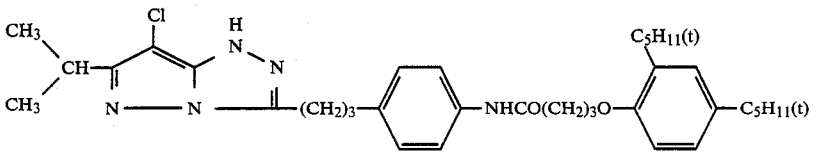

M-10

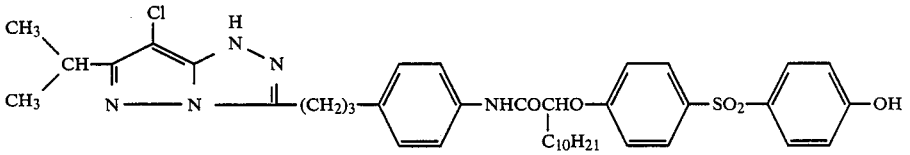

M-11

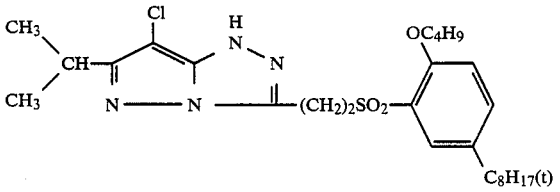

M-12

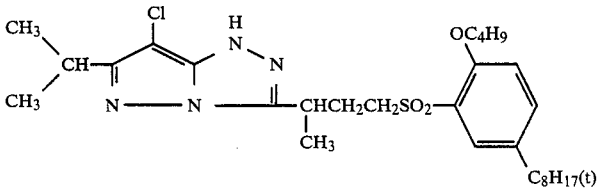

M-13

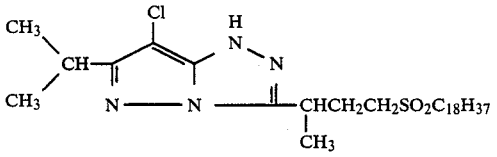

M-14

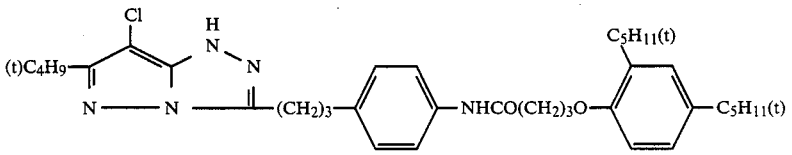

-continued

M-15

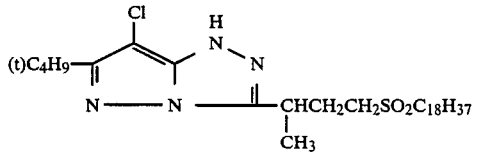

M-16

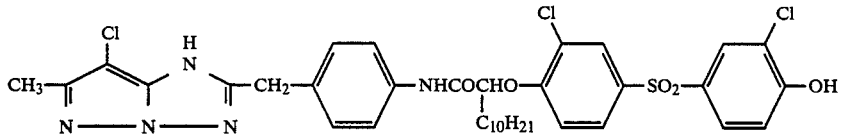

M-17

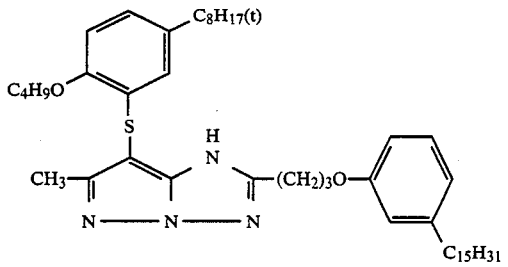

The cyan dye image forming couplers typically include a phenol type or naphthol type 4-equivalent or 2-equivalent cyan dye image forming couplers. They are described in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044; British Pat. Nos. 478,991, 945,542, 1,084,480, 1,377,233, 1,388,024 and 1,543,040; Japanese Patent O.P.I. Publication Nos. 37425-1972, 10135-1975, 25228-1975, 112038-1975, 117422-1975, 130441-1975, 6551-1976, 37647-1976, 52828-1976, 108841-1976, 109630-1978, 48237-1979, 66129-1979, 131931-1979, 32071-1980, 146050-1984, 31953-1984 and 117249-1985.

As for the cyan image forming couplers, the couplers represented by the following Formulas [E] and [F] should preferably be used.

Formula [E]

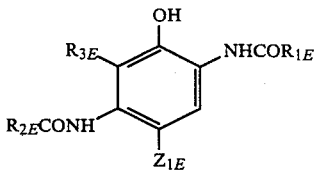

wherein $R_{1E}$ represents an aryl group, a cycloalkyl group or a heterocyclic group; $R_{2E}$ represents an alkyl group, an aryl group, a cycloalkyl group or a heterocyclic group; $R_{3E}$ represents a hydrogen atom, a halogen atom, an alkyl group or an alkoxy group; and $Z_{1E}$ represents a hydrogen atom, a halogen atom or a group capable of releasing upon reaction with the oxidized product of an aromatic primary amine type color developing agent.

Formula [F]

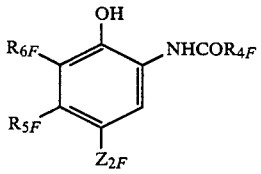

wherein $R_{4F}$ represents an alkyl group such as a methyl group, an ethyl group, a propyl group, a butyl group, a nonyl group or the like; $R_{5F}$ represents an alkyl group such as a methyl group, an ethyl group or the like; $R_{6F}$ represents a hydrogen atom, a halogen atom such as a fluoline atom, a chlorine atom, a bromine atom or the like, or an alkyl group such as a methyl group, an ethyl group or the like; and $Z_{2F}$ represents a hydrogen atom, a halogen atom or a group capable of releasing upon reaction with the oxidized product of an aromatic primary amine type color developing agent.

Further, The alkyl groups represented by $R_{4F}$ include, for example, substituted alkyl groups such as a methyl group and an ethyl group each substituted with an aryl group, an alkoxy group, an aryloxy group, a halogen atom or the like, each of which should preferably be used.

In the invention, the dye forming couplers are added in each of silver halide emulsion layers in an amount of, usually, from $1\times10^{-3}$ mol to 1 mol per mol of silver halides used and, preferably, from $1\times10^{-2}$ mol to $8\times10^{-1}$ mol. The silver halide grains relating to the invention may be used with any one of the above-mentioned yellow, magenta and cyan dye forming couplers in combination so as to satisfy the purposes.

It is desired that these dye forming couplers contain, in the molecules thereof, the so-called ballast group that has not less than 8 carbon atoms and does not diffuse any couplers. These dye forming couplers may be either the 4-equivalent type couplers which are necessary to reduce 4 silver ions for forming one molecular dye, or the 2-equivalent type couplers which are necessary to reduce only 2 silver ions.

In the dye-forming couplers, it is also allowed to contain a compound capable or releasing such a photographically useful fragment as a development accelerator, a bleach accelerator, a development assistant, a silver halide solvent, a toning agent, a hardener, a fogging agent, an antifogging agent, a chemical sensitizer, a spectral sensitizer and a desensitizer, upon coupling reaction with the oxidized product of a developing agent.

With these dye-forming couplers. It is also allowed to use in combination a coupler capable of releasing a development inhibitor in the course of a development process so as to improve the sharpness and graininess of images. In this case of DIR couplers, it is rather preferable that a dye formed of the coupler should be of the same system as that the dye formed of the dye-forming coupler used in the same emulsion layer. However, in the case where a color contamination is not so apparent, these DIR couplers may be those forming the different kinds of dyes. In place of or jointly using such DIR couplers, it is also allowed to use a DIR compound capable of making a coupling reaction with the oxidized product of a developing agent so as to release a development inhibitor at the same time when a colorless compound is produced.

The DIR couplers and DIR compounds used therein include those directly coupled with an inhibitor in the coupling position and those coupled with an inhibitor in the coupling position through a divalent group so that the inhibitor may be released upon intramolecular nucleophilic reaction, intramolecular electron transfer reaction or the like taken place in the groups released by a coupling reaction, (hereinafter called a timing DIR coupler and a timing DIR compound, respectively). It is allowed to use therein an inhibitor which becomes diffusible upon releasing or an inhibitor which is not so diffusible either independently or in combination according to the purposes. When a coupling reaction is taken place with the oxidized product of an aromatic primary amine developing agent, a colorless coupler incapable of forming any dyes may also be used in combination with a dye-forming coupler.

The dye-forming couplers, DIR couplers, DIR compounds, image stabilizers, antifogging agents, UV absorbing agents, fluorescent brightening agents and so forth may not be needed to make adsorb to the surface of silver halide crystal. Among them, hydrophobic compounds may be dispersed in a variety of methods such as a solid dispersion method, a latex dispersion method or an oil drop-in-water type emulsification-dispersion method and so forth. These methods may suitably be selected according to the chemical structures or the like of the hydrophobic compounds such as couplers and so forth.

As for the oil drop-in-water type emulsification-dispersion methods, it is allowed to use any of these methods having heretofore been known to disperse such a hydrophobic additives as couplers and so forth. In these methods, usually, these additives are dissolved in a high boiling organic solvent having a boiling point of not lower than 150° C. and/or, if required, a low-boiling and/or water-soluble organic solvent in combination. The resulted solution is added to a hydrophilic binder such as an aqueous gelatin solution and is then emulsified and dispersed together with a surface active agent by making use of such a dispersing means as a stirrer, homogenizer, colloid mill, flow-jet mixer, supersonic device or the like. The resulted emulsified dispersion is added to the subject hydrophilic colloidal layer. After or at the same time of the dispersion, it is also allowed to add a step of removing the low-boiling organic solvent.

When embodying the invention, the proportion of a high boiling organic solvent to a low boiling organic solvent may be from 1:0.1 to 1:50 and should preferably be from 1:1 to 1:20.

High boiling oil include, for example, organic solvents having a boiling point of not lower than 150° C. which do not react with the oxidized product of a developing agent, such as a phenol derivative, an alkyl phthalate, a phosphate, a citrate, a benzoate, an alkylamide, a fatty acid ester, a trimesic acid ester and so forth.

The low boiling or water-soluble organic solvents which may be used together with or in place of the high boiling solvents include, for exampl,e those described in U.S. Pat. Nos. 2,801,171 and 2,949,360, and so forth. The low boiling organic solvents which are substantially insoluble to water include, for example, ethyl acetate, propyl acetate, butyl acetate, buthanol, chloroform, carbon tetrachloride, nitromethane, nitroethane, benzene and so forth.

The water-soluble organic solvents include, for example, acetone, methylisobutyl ketone, β-ethoxyethyl acetate. methoxyglycol acetate, methanol, ethanol, acetonitrile, dioxane, dimethyl formamide, dimethyl sulfoxide, hexamethyl phosphoramide, diethyleneglycolmonophenylether, phenoxy ethanol and so forth.

In the silver halide color photographic light-sensitive materials of the invention, the hydrophilic colloids used for preparing an emulsion include, for example, proteins such as gelatin, a derivative gelatin, a graft polymer of gelatin and other macromolecular substances, albumin, cassein and so forth; derivatives such as those of hydroxyethyl cellulose, carboxymethyl cellulose and so forth; starch derivatives,; monomeric or polymeric synthesized hydrophilic macromolecular substances such as polyvinyl alcohol, polyvinyl imidazole, polyacryl amide and so forth.

When a development is carried out at a high temperature, known hardening agent may be used so as to enhance the strength of the coated layers of light-sensitive materials. Such hardeners include, for example, chromium salts such as chrome alum, chromium acetate and so forth, aldehydes such as formaldehyde, glyoxal, glutaraldehyde and so forth, N-methylol compounds such as dimethylol urea, methyloldimethyl hydantoine and so forth, dioxane derivatives such as 2,3-dihydroxy dioxane and so forth, active vinyl compounds such as 1,3,5-triacryloyl-hexahydro-s-triazine, 1,3-vinylsulfonyl-2-propanol and so forth, active halide compounds such as 2,4-dichloro-6-hydroxy-s-triazine and so forth, mucohalogenic acids such as mucochloric acid, mucophenoxy chloric acid and so forth. They may use independently or in combination.

With the purpose of improving coatability, publicly known thickening agent may be used for adjusting the viscosity of coating liquids and publicly known surface active agents may also be used for adjusting a surface tension, respectively. Such surface active agents include, for example, non-ionic surface active agents such as saponin of steroid type, alkylene oxide derivatives such as a polyethylene glycol, a polypropylene glycol condensate, a polyethyleneglycol alkyl ether, a polyethyleneglycol alkylaryl ether, a polyethyleneglycol ester, a polyethyleneglycol solbitane ester, a polyalkyleneglycol alkylamine, a polyalkyleneglycol alkylamide and a polyethylene oxide adduct of silicone, glycidol derivatives such as an alkenyl succinate polyglcyeride and an alkylphenol polyglyceride, fatty acid esters of polyalcohol, alkyl esters of sugar, and so forth; anionic surface active agents containing such an acidic group as a carboxy group, a sulfo group, a phospho group, a sulfate group, a phosphate group and so forth including alkyl carboxylates, alkyl sulfonates, alkylbenzene sulfonate, alkylnaphthalene sulfonates, alkyl sulfates, alkyl phosphates, N-acyl-N-alkyl taurines, sulfo succinates, sulfoalkylpolyoxyethylene alkylphenyl ethers, polyoxyethylene alkyl phosphates and so forth; amphoteric surface active agents such as amino acids, aminoalkyl sulfonic acids, aminoalkyl sulfates, aminoalkyl phosphates, alkyl betaines, amine oxides and so forth; and cationic surface active agents such as alkyl amine salts, aliphatic or aromatic quaternary ammonium salts, heterocyclic quaternary ammonium salts such as pyridinium, imidazolium and so forth, phosphonium or sulfonium containing an aliphatic substance or heterocyclic ring, and so forth.

The supports of the silver halide color photographic light-sensitive materials of the invention include, for example, baryta paper sheet, polyethylene-coated paper sheet, polypropylene paper sheet and transparent support members provided with a reflective layer or reflective substance in combination such as a glass plate, a polyester film made of cellulose acetate, cellulose nitrate, polyethyleneterephthalate or the like, polyamide film, polycarbonate film, polystyrene film and so forth and, in addition, a common transparent member may also be used. These supports are suitably selected so as to meet the purposes of using light-sensitive materials.

The silver halide emulsion layers and other photographic component layers each used in the invention may be coated in a variety of coating processes such as a dip-coating process, an air-doctor coating process, a curtain-coating process, a hopper-coating process and so forth. It is also allowed to use such a simultaneous multicoating process as described in U.S. Pat. Nos. 2,761,791 and 2,941,898.

In the invention, every emulsion layer may be arranged to any positions. In the case of full-color light-sensitive materials for printing use, for example, it is preferable to arrange a blue-sensitive siliver halide emulsion layer, a green-sensitive silver halide emulsion layer and a red-sensitive silver halide emulsion layer in the order from the side of a support. It is also allowed that each of the light-sensitive silver halide emulsion layers may be comprised of two or more layers.

In the light-sensitive materials of the invention, interlayers having a suitable thickness may be privided at will and, further, a variety of layers such as a filter layer, a non-curling layer, a protective layer, an antihalation layer and so forth may suitably be used in combination to serve as a component layer. These component layers are also allowed to similarly contain hydrophilic colloids which may be used as a binder in such an emulsion layer as mentioned above, and these component layers are further allowed to contain a variety of photographic additives which may also be contained in such an emulsion layer as mentioned above.

The light-sensitive materials of the invention may be processed in a variety of processes. Namely, a color development process is carried out in a color developing step, a bleaching step, a fixing step, a washing step if required, and/or a stabilizing step. Among the steps, a bleach-fixing step may be carried out with a monobath type bleach-fixer in place of the bleaching step using a bleacher and the fixing step using a fixer and, further, a monobath type processing step can be carried out with a monobath type processing solution for developing, bleaching and fixing, in which a color developing, bleaching and fixing can be completed in one and the same bath.

It is also allowed to carry out a prehardening step, the neutralizing step thereof, a stopping and fixing step, a post-hardening step and so forth in combination with the above-mentioned steps. Among these steps, the typical steps will be given below, in which either one of a washing, stabilizing, washing and stabilizing steps are to be carried out as the final step.

- Color developing step—Bleaching step—Fixing step
- Color developing step—Bleach-fixing step
- Prehardening step—Neutralizing step—color developing step—Stopping and fixing step—Washing step—

Bleaching step—Fixing step—Washing step—post-hardening step
- Color developing step—Washing step—auxiliary color developing step—Stopping step—Bleaching step—Fixing step
- Monobath processing step The color developing agent containined in a color developer is an aromatic primary amine color developing agent which contains an aminophenol type and p-phenylenediamine type derivative. These color developing agents are used in the form of such an organic or inorganic acid salt as a chloride, sulfate, p-toluene sulfonate, sulfite, oxalate, or benzene sulfonate.

These compounds are used in a concentration of from about 0.1 to about 30 g and, more preferably from about 1 to 15 g per liter of a color developer used. If the amount added is less than 0.1 g, no satisfactory color density may be obtained.

A processing temperature of a color developing tank is from 10° to 65° C. and, more preferably, from 25° C. to 45° C.

The above-given aminophenol type developing agents include, for example, o-aminophenol, p-aminophenol, 5-amino-2-oxy-toluene, 2-amino-3-oxy-toluene, 2-oxy-3-amino-1,4-dimethyl-benzene and so forth.

Particularly useful aromatic primary amine type color developing agent is an N,N-dialkyl-p-phenylenediamine type compound whose alkyl and phenyl groups may be either substituted or not. Among these compounds, particularly useful compounds include, for example, N,N-dimethyl-p-phenylenediamine hydrochloride, N-methyl-p-phenylenediamine hydrochloride, 2-amino-5-(N-ethyl-N-dodecylamino)-toluene, N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N-diethylaniline, 4-amino-N-(2-methoxyethyl)-N-ethyl-3-methylaniline, p-toluenesulfonate and so forth.

The above-given color developing agents may be used independently or in combination.

The color developers used in the invention are allowed to contain the alkalizers which have commonly been used, such as sodium hydroxide, potassium hydroxide, ammonium hydroxide, sodium carbonate, potassium carbonate, sodium sulfate, sodium metaborate, borax and so forth. Besides the above, they are also allowed to contain a variety of additives including, for example, halogenated alkali metals such as potassium chloride, sodium chloride development adjusters such as citrazinic acid and so forth, and preservatives such as N,N-diethylhydroxylamine or a sulfite.

The above-mentioned color developers are further allowed to contain such an organic development inhibitor such as those described in Japanese Patent O.P.I. Publication No. 95345-1983, provided that the effects of the invention may not be damaged. It is preferable to use adenine and guanine in an amount of from 0 to 0.02 g per liter of a color developer used.

A pH value of the developers of the invention is not lower than 9.5 and, more preferably, not higher than 13.

A temperature of color developers is generally from 15° to 45° C. and preferably, from 20° to 40° C.

Following a color developing step, a bleachin and fixing steps are carried out. The bleach-fixers used in the invention may be added with a variety of bleaching acclerators such as those described in, for example, Japanese Patent O.P.I. Publication No. 280-1971, Japanese Patent Examined Publication Nos. 8506-1970 and 556-1971, Belgian Patent No. 770,910, Japanese Patent Examined Publication Nos. 8836-1970 and 9854-1978, Japanese Patent O.P.I. Publication Nos. 71634-1979 and 42349-1974, and so forth.

Such bleach-fixers are used at a pH value of not lower than 4.0 and, generally, from not lower than pH 5.0 to not higher than pH 9.5. They are used, more desirably, from not lower than pH 5.5 to not higher than pH 8.0 and, most preferably, from not lower than pH 5.5 to not higher than 7.5.

Such bleach-fixing is made at a temperature of not higher than 80° C., that is, not less than 3° C. and, preferably, not less than 5° C. lower than a color developing temperature. It is desirable that the bleach-fixing is carried out at a temperature of not higher than 55° C. with inhibiting a evaporation and so forth. A bleach-fixing is carried out within 90 seconds and, more preferably, within 60 seconds.

After a color light-sensitive material is color developed and bleach-fixed, unnecessary processing chemicals are removed therefrom through a washing step.

EXAMPLES

The invention will now be described in detail with reference to the following examples thereof which are merely some of the embodiments of the invention. It is, therefore, to be understood that the invention shall not be limited thereto.

Example 1

A silver chlorobromide emulsion Em-1 was prepared in the following manner. Namely, into an aqueous gelatin solution which was being strongly stirred, one liter of an aqueous silver nitrate solution having a silver nitrate content of one mol per liter and one liter of an aqueous mixed halides solution having the halide content of one mol per liter (containing potassium bromide of 55 mol% and sodium chloride of 45 mol%) were added extending for 65 minutes.

Em-1 was added with sodium thiosulfate as a sulfur sensitizer. The emulsion was divided into two parts five minutes before a chemical sensitization was completed. One parts was added with sensitizing dye BS-6 and the other parts was added with Comparative dye A respectively in an amount of $3\times10^{-4}$ mol per mol of silver halide used. The resulted emulsions were further divided into two parts at the time when a chemical ripening process of each emulsion was completed. One parts thereof was added with stabilizer SB-5 in an amount of $5\times10^{-4}$ mol per mol of silver halide used, and the other parts was added with stabilizer SB-5 in the same amount of the above and inorganic sulfur in an amount of 0.1 mg per mol of the silver halide used.

Next, the following layers were coated over to a polyethylene-coated paper support, so that a silver halide color photographic light-sensitive materials were prepared, respectively. The amount of each compound is herein expressed as a value per square meter.

Layer 1

A silver halide emulsion layer containing 0.4 g of dibutyl phthalate dispersion dissolved therein with 0.70 g of yellow coupler YC-1 and 0.015 g of a color contamination inhibitor HQ-1, a blue-sensitive silver chlorobromide emulsion containing 0.45 g in terms of silver and 4 g of gelatin.

Layer 2

A protective layer containing 2 g of gelatin.

After thus prepared color papers were allowed to stand under the conditions of a temperature of 25° C. and each humidity of and 30%RH, 55%RH and 80%RH for one hour, they were exposed to light throng an optical wedge and developed in the process mentioned later. The densities of the obtained yellow dye images were measured with a densitometer, PDA-65, manufactured by Konishiroku Photo Ind. Co., Ltd. so as to obtain the sensitivity and fogginess of each sample. Each of the sensitivity thereof is indicated as a value relative to that of Samples 1 treated at 55%RH regarded as a value of 100.

TABLE 1-1

| No. | Blue-sensitive sensitizing dye | Inorganic sulfur | Sensitivity | Fog | |
|---|---|---|---|---|---|
| 1 | Comparative dye A | Not added | 100 | 0.14 | Comparative |
| 2 | " | Added | 98 | 0.11 | Comparative |
| 3 | BD-6 | Not added | 113 | 0.14 | Comparative |
| 4 | " | Added | 115 | 0.10 | Invention |

It can be found from Table 1-1 that, when sensitizing dye BD-6 relating to the invention is used, a high sensitivity can be obtained and a fog can also be lowered by the asddition of inorganic sulfur, and it can also be found that a high sensitivity can be embodied without damaging any merits of the invention in the combination of BD-6 relating to the invention and inorganic sulfur.

Next, Table 1-2 shows the sensitivity fluctuations caused by the humidity changes in terms of the values relative to the sensitivity value obtained at the relative humidity at 30%RH regarded as a value of 100.

TABLE 1-2

| No. | Blue-sensitive sensitizing dye | Inorganic sulfur | Sensitivity 30% RH | 55% RH | 80% RH |
|---|---|---|---|---|---|
| Comparative | | | | | |
| | Comparative | Not | | | |

TABLE 1-2-continued

| No. | Blue-sensitive sensitizing dye | Inorganic sulfur | Sensitivity 30% RH | 55% RH | 80% RH |
|---|---|---|---|---|---|
| 1 | dye A | added | 100 | 85 | 68 |
| 2 | " | Added | 100 | 83 | 64 |
| 3 Invention | BD-6 | Not added | 100 | 87 | 65 |
| 4 | BD-6 | Added | 100 | 90 | 72 |

From Table 1-2, it is found that, with comparative dye A, the sensitivities are lowered by 64 to 68% by the change of relative humidity from 30%RH to 80%RH and any improvement can be produced at all even if inorganic sulfur is added. It is also found that no improvement is found even if a blue-sensitive sensitizing dye was replaced by BD-6, however, it is proved to display an effect that a sensitivity fluctuation can be reduced by using BD-6 and inorganic sulfur in combination.

Comparative dye A

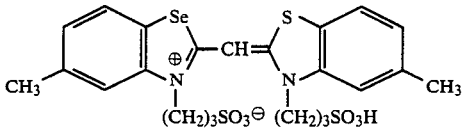

YC-1

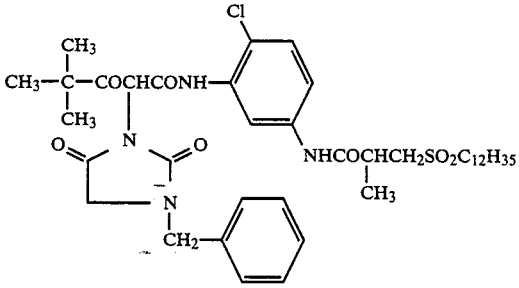

HQ-1

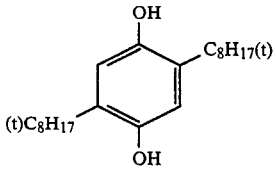

| [Processing step] | [Temperature] | [Time] |
|---|---|---|
| Color developing | 33° C. | 3 min. 30 sec. |
| Bleach-fixing | 33° C. | 1 min. 30 sec. |
| Washing | 30 to 34° C. | 3 min. |
| Drying | 60 to 68° C. | 1 min. |

| [Color developer composition] | |
|---|---|
| Water | 800 ml |
| Ethylene glycol | 15 ml |
| Benzyl alcohol | 18 ml |
| Hydroxylamine sulfate | 2.0 g |
| Calcium carbonate, anhydrous | 30.0 g |
| Potassium bromide | 0.5 g |
| Sodium chloride | 1.5 g |
| Potassium sulfite, anhydrous | 2.0 g |
| N—ethyl-N—β-methanesulfonamidethyl-3-methyl-4-aminoaniline sulfate | 4.5 g |
| Add pure water to make | 1 liter |
| Adjust pH with potassium hydroxide or sulfuric acid to | pH = 10.2 |

| [Bleach-fixer composition] | |
|---|---|
| Water | 750 ml |
| Iron (III) sodium ethylene-diaminetetraacetate | 50 g |
| Ammonium thiosulfate | 85 g |
| Sodium bisulfite | 10 g |
| Sodium metabisulfite | 2 g |
| Disodium iron ethylene-diaminetetraacetate | 20 g |
| Sodium bromide | 3 g |
| Add pure water to make | 1 liter |
| Adjust pH with aqueous ammonia or sulfuric acid to | pH = 7.0 |

Example 2

A silver halide emulsion Em-2 was prepared in the same manner as in Example 1, except that an aqueous mixed silver halide solution, which was to be mixed with a silver nitrate solution, was replaced by potassium bromide of 0.5 mol% and sodium chloride of 99.5 mol%.

Samples were prepared in the same manner as in Example 1, except that a silver halide emulsion was replaced by Em-2. The resulted samples were exposed to light in the ordinary manner and were then subjected to the later-mentioned development process. The densities of the resulted yellow dye images were measured to obtain the sensitivity and fogginess. Each sensitivity obtained is indicated by a value relative to the sensitivity value of Sample 5 obtained at a humidity of 55%RH regarded as a value of 100.

TABLE 2-1

| No. | Blue-sensitive sensitizing dye | Inorganic sulfur | Sensitivity | Fog | |
|---|---|---|---|---|---|
| 5 | Comparative dye A | Not added | 100 | 0.10 | Comparative |
| 6 | " | Added | 100 | 0.09 | Comparative |
| 7 | BD-6 | Not added | 148 | 0.10 | Comparative |
| 8 | " | Added | 146 | 0.09 | Invention |

It is found from Table 2-1 that the sensitizing dyes relating to the invention are excellently suitable to highly chloride-containing silver halide emulsions. In addition, fogginess can be lowered almost without damaging the sensitivity by adding inorganic sulfur.

When Samples 1 through 4 each prepared in Example 1 were processes in the same manner, every image was resulted to be seriously lowered in maximum density. It is therefore found that the highly chloride-containing silver halide light-sensitive materials relating to the invention are excellent in rapid processing characteristics.

TABLE 2-2

| No. | Blue-sensitive sensitizing dye | Inorganic sulfur | Sensitivity 30% RH | 55% RH | 80% RH |
|---|---|---|---|---|---|
| 5 | Comparative dye A | Not added | 100 | 85 | 65 |

TABLE 2-2-continued

| No. | Blue-sensitive sensitizing dye | Inorganic sulfur | Sensitivity 30% RH | 55% RH | 80% RH |
|---|---|---|---|---|---|
| 6 | " | Added | 100 | 83 | 62 |
| 7 | BD-6 | Not added | 100 | 88 | 63 |
| 8 | BD-6 | Contained | 100 | 90 | 72 |

Table 2-2 exhibits the sensitivity fluctuations caused by humidity changes in terms of values relative to the sensitivity value obtained at a relative humidity of 30%RH regarded as a value of 100. From this Table, it is found that, though the sensitivity fluctuations are somewhat increased by making use of a highly chloride-containing silver halide emulsion, the combination use of BD-6 and inorganic sulfur is effective in inhibiting sensitivity fluctuations without damaging such effect even with highly chloride-containing silver halide emulsions.

The processing steps and the compositions of processing solutions are as follows.

| [Processing step] | (Temperature) | (Time) |
|---|---|---|
| Color developing | 30° C. | 90 sec. |
| Bleach-fixing | 30° C. | 90 sec. |
| Washing | 30 to 35° C. | 90 sec. |
| Drying | 60 to 68° C. | 60 sec. |
| [Color developer] | | |
| water | | 800 ml |
| Triethanolamine | | 12 ml |
| N,N—diethylhydroxylamine (A 85% aqueous solution) | | 12 ml |
| Potassium chloride | | 2.2 g |
| Potassium sulfite | | 0.2 g |
| N—ethyl-N—β-methanesulfonamidoethyl-3-methyl-4-aminoaniline sulfate | | 5.0 g |
| 1-hydroxyethylidene-1,1-diphosphonate | | 1 g |
| Ethylenediaminetetraacetate | | 2 g |
| Diaminostilbene type water-soluble fluorescent brightening agent | | 2 g |
| Potassium carbonate | | 25 g |
| Add pure water to make | | 1 liter |
| Adjust pH to be | | pH = 10.1 |
| [Bleach-fixer] | | |
| water | | 800 ml |
| Ferric (III) ammonium ethylenediaminetetraacetate | | 65 g |
| Disodium ethylenediaminetetraacetate | | 5 g |
| Ammonium thiosulfate | | 85 g |
| Sodium hydrogensulfite | | 10 g |
| Sodium metabisulfite | | 2 g |
| Sodium chloride | | 10 g |
| N,N—diethylhydroxylamine (A 85% aqueous solution) | | 2 ml |
| Add pure water to make | | 1 liter |
| Adjust pH with dilute sulfuric acid to be | | pH = 5.5 |

Example 3

Em-2 was prepared in the manner taken in Example 2 and was then divided into three parts. The first emulsion was chemically sensitized in the manner taken in Example 2 and was then added with Sensitizing dye BD-13 5 minutes before the chemical sensitization was completed. The resulted matter was divided into two parts. Both parts divided as mentioned above were added with Stabilizer [SB-5] in an amount of $5\times10^{-4}$ mol per mol of silver halides used, at the time of completing the chemical sensitization. Further, one part was added with 0.05 mg of inorganic sulfur per mol of the silver halides used (that is called Sample No. 10), and nothing was added to the other part (that is called No. 9).

The 2nd emulsion was chemically sensitized in the same manner as in the 1st emulsion, except that inorganic sulfur was added in an amount of 0.05 mg per mol of silver halides used one minute before a sulfur sensitizer was added. At the time when the chemical sensitization was completed. Stabilizer [SB-5] was added in an amount of $5\times10^{-4}$ mol to the 2nd emulsion. (The resulted emulsion is called No. 11)

The 3rd emulsion was chemically sensitized in the same manner as in the 2nd emulsion, except that Stabilizer [SB-5] was added in an amount of $10^{-4}$ mol per mol of silver halides used, together with inorganic sulfur. (The resulted emulsion is called No. 12)

Coated samples were prepared in the same manner as in Example 2 and were then exposed to light and processed, so that the characteristics thereof were evaluated.

The sensitivities thereof are expressed by the values relative to that of Sample 9 regarded as a value of 100, and the gradation $\gamma_1$ in the toe portion is expressed by those in the portions of a density from 0.2 to 0.7

The chemical senstizations were carried out in the same manner as in the above-mentioned 4 kinds of samples, except that the chemical sensitizer was replaced by sodium thiosulfate in an amount of $1\times10^{-5}$ mol per mol of silver halides used and aurochloric acid in an amount of $2\times10^{-5}$ mol per mol of silver halides used, so that further 4 kinds of Emulsion called No. 13 through No. 16 were prepared, respectively.

TABLE 3-1

| No. | Before chemical sensitization: Inorganic sulfur added | Before chemical sensitization: Stabilizer [SB-5] added | Inorganic Sulfur added when chemical sensitization completed | Gold sensitization | Sensitivity | $\gamma_1$ | Fog |
|---|---|---|---|---|---|---|---|
| 9 | No | No | No | No | 100 | 1.85 | 0.10 |
| 10 | No | No | Yes | No | 99 | 1.86 | 0.09 |
| 11 | Yes | No | Yes | No | 102 | 1.89 | 0.09 |
| 12 | Yes | Yes | No | No | 103 | 1.93 | 0.07 |
| 13 | No | No | No | Yes | 130 | 1.80 | 0.15 |
| 14 | No | No | Yes | Yes | 130 | 1.81 | 0.10 |
| 15 | Yes | No | No | Yes | 135 | 1.87 | 0.10 |
| 16 | Yes | Yes | No | Yes | 137 | 1.93 | 0.07 |

The time to add inorganic sulfur have not so much effect, however, from the viewpoints of fogginess and the gradation in toe portions, it is somewhat advantageous to add it immediately before commencing a chemical ripening process and to carry out a chemical sensitization in the presence of inorganic sulfur. Particularly with Sample 12 which was chemically sensitized in the presence of inorganic sulfur and Stabilizer [SB-5], the effects were remarkably displayed.

Table 3-2 exhibits the sensitivity changes caused by humidity fluctuations in terms of values relative to the sensitivity value obtained at a humidity of 30%RH regarded as a value of 100.

Samples added with inorganic sulfur displayed the effect of controlling the sensitivity fluctuations. Among those samples, the samples which were chemically sensitized in the presence of inorganic sulfur displayed the great effect. Particularly, the samples which were chemically sensitized in the presence of inorganic sulfur and Stabilizer [II b-5] displayed a greater effect.

When a gold sensitization was carried out, a sensitivity was tremendously increased and the gradation in the toe portions was somewhat softened and fogginess was also increased. However, these defects can be reduced by adding inorganic sulfur. The sensitivity changes caused by humidity fluctuation was also preferably reduced.

TABLE 3-2

| No. | Before chemical sensitization: Inorganic sulfur added | Before chemical sensitization: Stabilizer [SB-5] added | Inorganic Sulfur added when chemical sensitization completed | Gold sensitization | Sensitivity 30% RH | Sensitivity 55% RH | Sensitivity 80% RH |
|---|---|---|---|---|---|---|---|
| 9 | No | No | No | No | 100 | 88 | 62 |
| 10 | No | No | Yes | No | 100 | 90 | 72 |
| 11 | Yes | No | No | No | 100 | 91 | 76 |
| 12 | Yes | Yes | No | No | 100 | 91 | 82 |
| 13 | No | No | No | Yes | 100 | 89 | 61 |
| 14 | No | No | Yes | Yes | 100 | 91 | 75 |
| 15 | Yes | No | No | Yes | 100 | 91 | 78 |
| 16 | Yes | Yes | No | Yes | 100 | 93 | 85 |

Example 4

Em-2 was prepared in the same manner as in Example 2 and was then chemically sensitized in the same manner as in Example 1, except that a stabilizer and inorganic sulfur were added. The resulted emulsion was added with blue-sensitive sensitizing dye 5 minutes before the chemical sensitization was completed, and was then added with a stabilizer and sulfur at the time of completing the chemical sensitization. The evaluation thereof was made in the same manner as in Example 2. The sensitivity thereof obtained is expressed by a value relative to that of Sample 17 regarded as a value of 100, and the sensitivity changes caused by humidity fluctuations are expressed by the values relative to the sensitivity obtained at a humidity of 30%RH regarded as a value of 100.

TABLE 4

| No. | Before chemical sensitization: Inorganic sulfur added | Before chemical sensitization: Stabilizer | After chemical sensitization: Inorganic sulfur added | After chemical sensitization: Stabilizer | Sensitivity | γ1 | Fog | Sensitivity 30% RH | Sensitivity 55% RH | Sensitivity 80% RH | Blue-sensitive sensitizing dye | |
|---|---|---|---|---|---|---|---|---|---|---|---|---|
| 17 | 0 | 0 | 0 | [SB-5] $5 \times 10^{-4}$ mol | 100 | 1.82 | 0.10 | 100 | 86 | 62 | BD-13 | Comp. |
| 18 | 0 | [SB-5] $1 \times 10^{-4}$ mol | 0 | [SB-5] $5 \times 10^{-4}$ mol | 103 | 1.81 | 0.09 | 100 | 88 | 67 | BD-13 | Comp. |
| 19 | 0.1 mg | [SB-5] $1 \times 10^{-4}$ mol | 0 | [SB-5] $5 \times 10^{-4}$ mol | 100 | 1.93 | 0.07 | 100 | 90 | 80 | BD-13 | Inv. |
| 20 | 0.3 mg | [SB-5] $1 \times 10^{-4}$ mol | 0 | [SB-5] $5 \times 10^{-4}$ mol | 102 | 1.90 | 0.07 | 100 | 89 | 78 | BD-13 | Inv. |
| 21 | 0.5 mg | [SB-5] $1 \times 10^{-4}$ mol | 0 | [SB-5] $5 \times 10^{-4}$ mol | 95 | 1.85 | 0.07 | 100 | 90 | 78 | BD-13 | Inv. |
| 22 | 0.1 mg | [SB-5] $1 \times 10^{-4}$ mol | 0.1 mg | [SB-5] $5 \times 10^{-4}$ mol | 102 | 1.93 | 0.07 | 100 | 89 | 80 | BD-13 | Inv. |
| 23 | 0.1 mg | [SB-3] $10^{-4}$ mol | 0 | [SB-3] $5 \times 10^{-4}$ mol | 100 | 1.90 | 0.08 | 100 | 88 | 80 | BD-13 | Inv. |
| 24 | 0.11 mg | [SA-2] $10^{-4}$ mol | 0 | [SA-2] $5 \times 10^{-4}$ mol | 99 | 1.87 | 0.07 | 100 | 87 | 81 | BD-13 | Inv. |
| 25 | 0.1 mg | [SB-5] $2 \times 10^{-4}$ mol | 0 | [SB-5] $5 \times 10^{-4}$ mol | 102 | 1.90 | 0.08 | 100 | 89 | 78 | BD-13 | Inv. |
| 26 | 0.1 mg | [SB-5] $4 \times 10^{-4}$ mol | 0 | [SB-5] $5 \times 10^{-4}$ mol | 89 | 1.88 | 0.07 | 100 | 91 | 83 | BD-13 | Inv. |
| 27 | 0.1 mg | [SB-5] $10^{-4}$ mol | 0 | [SB-5] $5 \times 10^{-4}$ mol | 95 | 1.90 | 0.08 | 100 | 88 | 78 | BD-6 | Inv. |
| 28 | 0.1 mg | 0 | 0 | [SB-5] $5 \times 10^{-4}$ mol | 98 | 1.83 | 0.09 | 100 | 89 | 73 | BD-6 | Inv. |
| 29 | 0.1 mg | [SB-5] $1 \times 10^{-4}$ mol | 0 | [SB-5] $5 \times 10^{-4}$ mol | 108 | 1.92 | 0.07 | 100 | 87 | 80 | BD-33 | Inv. |
| 30 | 0.1 mg | [SB-5] $1 \times 10^{-4}$ mol | 0 | [SB-5] $5 \times 10^{-4}$ mol | 114 | 1.88 | 0.09 | 100 | 91 | 78 | BD-35 | Inv. |
| 31 | 0.1 mg | [Sb-5] $1 \times 10^{-4}$ mol | 0 | [SB-5] $5 \times 10^{-4}$ mol | 93 | 1.89 | 0.10 | 100 | 90 | 81 | BD-1 | Inv. |
| 32 | 0.1 mg | [SB-5] $1 \times 10^{-4}$ mol | 0 | [SB-5] $5 \times 10^{-4}$ mol | 71 | 1.93 | 0.08 | 100 | 83 | 65 | Comparative dye A | Comp. |

*As for the chemical sensitizer, sodium thiosulfate in an amount of $1 \times 10^{-5}$ mol and chloroauric acid in an amount of $2 \times 10^{-5}$ mol each per mol of silver halides used were added.

As is obvious from Table 4, when the sensitizing dyes relating to the invention and inorganic sulfur and, further, a stabilizer are used in combination, a desirable gradation in the toe portion can be obtained and the sensitivity changes caused by humidity fluctuations can also be inhibited. In the chemical sensitization process including the pretreatment and post treatment, if an amount of inorganic sulfur added is too much, there may be an inclination to deteriorate the effects of the stabilizer on the gradation in the toe portions, and if an amount of stabilizer is too much, a desensitization may be caused, however, the sensitivity changes can also be inhibited even in adding ranges mentioned above.

Example 5

Samples were prepared in the same manner as in Sample 13 of Example 3, except that inorganic sulfur was added to a protective layer or emulsion layers, and the evaluations thereof were made similarly.

TABLE 5

| No. | Sulfur added to protect layer (mg/m²) | Sulfur added to emulsion layer (mg/m²) | Sensitivity | γ1 | Fog | Sensitivity 30% RH | 55% RH | 80% RH |
|---|---|---|---|---|---|---|---|---|
| 13 | 0 | 0 | 100 | 1.80 | 0.15 | 100 | 89 | 61 |
| 33 | 0.04 | 0 | 101 | 1.80 | 0.14 | 100 | 90 | 65 |
| 34 | 0.08 | 0 | 100 | 1.78 | 0.14 | 100 | 90 | 65 |
| 35 | 0.15 | 0 | 98 | 1.77 | 0.13 | 100 | 90 | 67 |
| 36 | 0.50 | 0 | 100 | 1.78 | 0.12 | 100 | 90 | 69 |
| 37 | 0 | 0.04 | 100 | 1.80 | 0.14 | 100 | 89 | 67 |
| 38 | 0 | 0.08 | 98 | 1.80 | 0.13 | 100 | 90 | 69 |
| 39 | 0 | 0.15 | 98 | 1.79 | 0.11 | 100 | 91 | 71 |
| 40 | 0 | 0.50 | 96 | 1.74 | 0.11 | 100 | 91 | 71 |

It is understood from Table 5 that the sensitivity changes caused by humidity can be inhibited by adding inorganic sulfur to emulsion layers or a protective layer.

Example 6

Color papers were prepared by making use of the same blue-sensitive emulsion as that used in Sample 13 of Example 3 and the same blue-sensitive emulsions as those used in Samples 16 and 31 each in combinations with a green-sensitive emulsion and a red-sensitive emulsion, using an ordinary method, respectively. When the test prints were tried under the conditions of 25° C. and 30%RH, the high-quality color prints were obtained from both of the color papers by taking a processing time of one minute 30 second in the developing process taken in Example 2. Next, when printed from the light-sensitive material relating to the invention under the same exposure conditions and in the atmosphere of 80%RH and 25° C., a relatively color-balanced print was obtained though the density thereof was somewhat lowered. On the other hand, every blue to purple tinted image was obtained from the comparative samples, so that the images were seriously inferior in quality.

In the comparison of the samples relating to the invention with each other, there is nothing to choose from them. However, it was seen that an emulsion used therein BD-1 having a naphthothiazole nucleus in the parent nuclide had a few yellow stain seemed to be caused from sensitizing dyes. It is, therefore, preferable to use a dye having a benzothiazole nucleus, a sulfoalkyl group and a carboxyalkyl group to serve as a sensitizing dye, from the viewpoint that a stain is hard to be produced.

Example 7

[Preparation of Silver Halide Emulsion Em-A]

The amounts of the additives used in preparing emulsions will be indicated in terms of an amount per mol of a silver halide used, unless otherwise expressly stated.

A silver nitrate solution and a solution containing potassium bromide and potassium iodide were added into an aqueous inert gelatin solution in a double-jet method, taking 150 minutes. In adding them, the temperature and pAg were kept at 50° C. and 8.0, respectively.

Next, a desalting and washing were carried out in an ordinary manners, so that Em-A was obtained, Em-A was comprised of tetradecahedral silver iodobromide grains having a silver iodide content of 4 mol%, an average grain size of 0.6 μm and a variation coefficient of 11.0%.

Em-A was chemically sensitized by adding 4.5 mg of sodium thiosulfate. The chemical sensitization was carried out at 57° C. and 2 g of 4-hydroxy-6-methyl-1,3,3a-7-tetrazaindene, S-16, were added as a stabilizer, taking such a period of time as to obtain the optimum sensitometric characteristics including a sensitivity and gradation. After then, the temperature was lowered, so that the chemical sensitization was completed. Ten minutes before the chemical sensitization was completed, sensitizing dyes were added as shown in Table-1 and, further, 5 minutes before the chemical sensitization was completed, inorganic sulfurs (manufactured by Wako Junyaku Kogyo Co.) were added as shown in Table-1, so that Em-41 through Em-61 were obtained.

[Preparation of Coated Samples]

Each of the emulsions was added with sodium dodecylbenzenesulfonate to serve as a coating aid, gelatin and a hardener, H-1, in an amount of 10 mg per g of the gelatin. The resulted emulsions were coated over to polyethyleneterephthalate supports, respectively, so as to make an amount of silver coated to be 4.0 g/m² and an amount of gelatin to be 5.0 g/m², and protective layers were further coated thereon so as to make an amount of gelatin coated to be 2.0 g/m², respectively. so that Sample Nos. 41 through 61 were prepared.

Each of the samples were exposed to green light through three primary color separation filters by making use of a photosensitometer, Model KS-7 manufactured by Konishiroku Photo Ind. Co., Ltd. and were then processed according to the following processing steps-A. After they were processed, the sensitometric measurements were carried out with densitometer, Model PDA-65 manufactured by Konishiroku Photo Ind. Co., Ltd.

[Raw Product Preservability]

Each of the samples were preserved for one week under the conditions of 40° C. and 80%RH and the sensitometric measurements were carried out to measure the gradation changes. Wherein γa means a value indicating a gradation expressed by the reciprocal number of the difference between the logarithms of exposures of the samples, which are required to obtain densities of 0.3 and 0.8. The greater the value is, the harder the gradation is. Δγa is a difference of γa between a time when an emulsion was used after it was preserved and a time when it was used on the very day. The results thereof are shown in Table-6 below.

Comparative sensitizing dye-B1

-continued

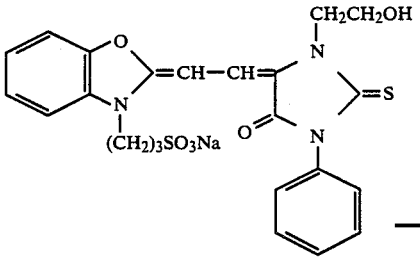

-continued

| | | |
|---|---|---|
| [Fixer] | | |
| Water | 500 | cc |
| Sodium thiosulfate | 240 | g |
| Sodium sulfite, anhydrous | 10 | g |
| Acidic sodium sulfite | 25 | g |
| Add water to make | 1000 | cc |

TABLE 6

| Sample No. | Emulsion | Sensitizing dye, Amt. added mol/AgX mol | Inorganic sulfur, mg/AgX mol | Sensitometry Sensitivity | Sensitometry Fog | Raw sample preservability ΔYa | |
|---|---|---|---|---|---|---|---|
| 41 | Em-41 | — | — | — | 0.03 | 0.06 | Comp. |
| 42 | Em-42 | Comparative dye-B1 ($5 \times 10^{-4}$) | — | 100 | 0.04 | −0.14 | " |
| 43 | Em-43 | Comparative dye-B2 ($5 \times 10^{-4}$) | — | 97 | 0.04 | −0.13 | " |
| 44 | Em-44 | [GD-2] ($5 \times 10^{-4}$) | — | 283 | 0.06 | −0.47 | " |
| 45 | Em-45 | [GD-19] ($5 \times 10^{-4}$) | — | 277 | 0.07 | −0.44 | " |
| 46 | Em-46 | Comparative dye-B1 ($5 \times 10^{-4}$) | 0.2 | 78 | 0.04 | −0.13 | " |
| 47 | Em-47 | Comparative dye-B2 ($5 \times 10^{-4}$) | 0.2 | 60 | 0.04 | −0.13 | " |
| 48 | Em-48 | [GD-2] ($5 \times 10^{-4}$) | 0.2 | 275 | 0.04 | −0.16 | Inv. |
| 49 | Em-49 | [GD-19] ($5 \times 10^{-4}$) | 0.2 | 265 | 0.04 | −0.19 | " |
| 50 | Em-50 | [GD-21] ($5 \times 10^{-4}$) | 0.2 | 238 | 0.05 | −0.16 | " |
| 51 | Em-51 | [GD-23] ($5 \times 10^{-4}$) | 0.2 | 281 | 0.04 | −0.17 | " |
| 52 | Em-52 | [GD-26] ($5 \times 10^{-4}$) | 0.2 | 273 | 0.04 | −0.13 | " |
| 53 | Em-53 | [GD-29] ($5 \times 10^{-4}$) | 0.2 | 252 | 0.05 | −0.16 | " |
| 54 | Em-54 | [GD-30] ($5 \times 10^{-4}$) | 0.2 | 248 | 0.05 | −0.18 | " |
| 55 | Em-55 | [GD-6] ($5 \times 10^{-4}$) | 0.2 | 310 | 0.03 | −0.12 | " |
| 56 | Em-56 | [GD-6] ($2 \times 10^{-4}$) | 0.2 | 240 | 0.03 | −0.11 | " |
| 57 | Em-57 | [GD-6] ($1.5 \times 10^{-3}$) | 0.2 | 312 | 0.04 | −0.14 | " |
| 58 | Em-58 | [GD-6] ($5 \times 10^{-4}$) | 0.02 | 318 | 0.05 | −0.27 | Inv. |
| 59 | Em-59 | [GD-6] ($5 \times 10^{-4}$) | 0.08 | 310 | 0.03 | −0.19 | " |
| 60 | Em-60 | [GD-6] ($5 \times 10^{-4}$) | 1 | 306 | 0.03 | −0.13 | " |
| 61 | Em-61 | [GD-6] ($5 \times 10^{-4}$) | 4 | 296 | 0.05 | −0.13 | " |

*Sensitivity is indicated by a value relative to the sensitivity of Sample 42 regarded as a value of 100.

Comparative sensitizing dye-B2

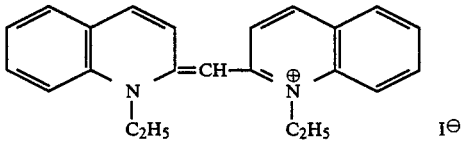

| | | | |
|---|---|---|---|
| [Processing step-A] | | | |
| Developing | 20° C. | 12 | minutes |
| Stopping | 20° C. | 30 | seconds |
| Fixing | 20° C. | 10 | minutes |
| Washing | | 5 | minutes |
| [Composition of Developer] | | | |
| Metol | | 2.5 | g |
| -ascorbic acid | | 10.0 | g |
| Potassium bromide | | 1.0 | g |
| Sodium metaborate | | 35 | g |
| Add water to make | | 1 | liter |
| [Stopping solution] | | | |
| Acetic acid (a 28% solution) | | 48 | cc |
| Add water to make | | 1000 | cc |

As is obvious from Table 6, the sensitizing dyes used in the invention are apt to produce fog and to deteriorate raw product preservability, while a higher sensitivity may be achieved as compared to the comparative dye. In contrast to the above, when these dyes are added with inorganic sulfur, such fog may be inhibited and the raw product preservability may also be improved almost without sacrificing their sensitivity. On the other hand, if inorganic sulfur is added into the comparative dye, they are seriously desensitized.

In the invention, the inorganic sulfur may be added, large and small, however, if the amount added is too small, the effects of the invention may become a little, and if it is too much, a desensitization occurs and fogginess is apt to increase.

EXAMPLE 8

[Preparation of EM-B through F]

A silver nitrate solution and a solution containing potassium bromide and sodium chloride were added into an inert gelatin in a double-jet method while keeping the conditions described in Table 7.

Next, a desalting and washing treatments were carried out in an ordinary method, so that silver chlorobromide emulsions EM-B through F were prepared.

TABLE 7

| EM. | Requirements for preparing AgX pH | pAg | Temp. °C. | AgX characteristics Ave. grain size, μm | Br cont. % | Variation coefficient | Crystal form |
|---|---|---|---|---|---|---|---|
| EM-B | 6.0 | 6.5 | 55 | 0.55 | 60 | 9.8 | Cube |

TABLE 7-continued

| EM. | Requirements for preparing AgX pH | pAg | Temp. °C. | AgX characteristics Ave. grain size, μm | Br cont. % | Variation coefficient | Crystal form |
|---|---|---|---|---|---|---|---|
| EM-C | 6.0 | 6.5 | 55 | 0.55 | 30 | 9.7 | " |
| EM-D | 6.0 | 7.0 | 50 | 0.55 | 10 | 9.0 | " |
| EM-E | 6.0 | 7.3 | 50 | 0.55 | 0.5 | 7.9 | " |
| EM-F* | 6.0 | 7.3 | 50 | 0.55 | 0.5 | 6.8 | " |

*EM-F was prepared by satisfying the requirements for EM-E, except that [GD-16] was added in an amount of $2 \times 10^{-4}$ mol/AgX mol in the form of an ethanol solution, in the course of forming silver halide grains.

Next, the resulted primitive emulsions were added with 3 mg of sodium thiosulfate and, 5 minutes later, $4 \times 10^{-4}$ mol of sensitizing dye [GD-16] were added so as to carry out a chemical sensitization, respectively.

The chemical sensitization was carried out at 55° C. and the compounds indicated in Table 8 were added taking a period of time capable of obtaining the optimum sensitometric characteristics, respectively. After then, the temperature was lowered to complete the chemical sensitization process.

One minute after sodium thiosulfate was added, inorganic sulfur was added as indicated in Table 8, so that Em-62 through Em-77 were prepared, respectively.

[Preparation of Coated Samples]

Each of the resulted emulsions was dissolved in dibutyl phthalate. Magenta coupler, M-4, in an amount of 0.25 mol, sodium dodecylbenzenesulfonate, gelatin and hardner in an amount of 10 mg per g of the gelatin were added into the resulted solution. The solution thus obtained was coated over to a polyethylene-laminated paper so that the amount of silver coated was to be 0.4 g/m$^2$ and the amount of gelatin coated was to be 4.0 g/m$^2$. Further on the above, 3.0 g/m$^2$ of gelatin were coated as a protective layer, so that each of Samples No. 62 through No. 77 was prepared.

The resulted product were exposed to light with a sensitometer, Model KS-7 and were then processed in accordance with the following processing steps-B. After the processing was completed, the sensitometric measurements were carried out with a densitometer, Model PDA-65.

The raw sample preservability tests were carried out in the same manner as in Example 1. In the results thereof, $\gamma_B$ is expressed by a reciprocal number of the logarithmic difference of each exposure to obtain densities of 0.5 and 1.5.

Further, the rapid processing tests were tried in the following manner.

[Rapid Processing Test]

The exposed samples were processed in the following color developing steps-C and the maximum densities, Dmax, thereof were measured.

The results thereof are shown in Table 8.

| [Color Developing Steps-B] | | |
|---|---|---|
| [1] Color developing | 38° C. | 3 min. 30 sec. |
| [2] Bleach-fixing | 33° C. | 1 min. 30 sec. |
| [3] Washing | 25° C. to 30° C. | 3 min. |
| [4] Drying | 75° C. to 80° C. | 2 min., approx. |

| [Composition of Processing Solutions] | |
|---|---|
| (Color developer) | |
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| Hydroxylamine sulfate | 3.0 g |
| Polyphosphoric acid, TPPS | 2.5 g |
| 3-methyl-4-amino-N—ethyl-N—]β-methanesulfonamidoethyl)-aniline sulfate | 5.5 g |
| Fluorescent brightening agent, A 4,4'-diaminostilbene sulfonic acid derivative | 1.0 g |
| Potassium hydroxide | 2.0 g |
| Add water to make a total of | 1 liter |
| Adjust pH to be | pH 10.20 |
| (Bleach-fixer) | |
| Ferric ammonium ethylenediamine-tetraacetate, dihydrate | 60 g |
| Ethylenediaminetetraacetic acid | 3 g |
| Ammonium thiosulfate (A 70% solution) | 100 ml |
| Ammonium sulfite (A 40% solution) | 27.5 ml |
| Adjust pH with potassium carbonate or glacial acetic acid to be | pH 7.1 |
| Add water to make a total of | 1 liter |

| [Processing Step-C] | Temperature | Time |
|---|---|---|
| Color developing | 35 ± 0.3° C. | 15 sec or 30 sec |
| Bleach-fixing | 35 ± 0.5° C. | 45 sec |
| Stabilizing | 30 to 34° C. | 90 sec |
| Drying | 60 to 80° C. | 60 sec |

| (Color developer) | |
|---|---|
| Water | 800 ml |
| Triethanolamine | 10 g |
| N,N—diethylhydroxylamine | 5 g |
| Potassium chloride | 2 g |
| Potassium sulfite | 0.3 g |
| 1-hydroxyethylidine-1,1-diphosphonic acid | 1.0 g |
| Ethylenediaminetetraacetic acid | 1.0 g |
| Disodium catechol-3,5-disulfonate | 1.0 g |
| N—ethyl-N—β-methanesulfonamidoethyl-3-methyl-4-aminoaniline sulfate | 4.5 g |
| Fluorescent brightening agent, a 4,4'-diaminostilbene sulfonic acid derivative | 1.0 g |
| Potassium carbonate | 27 g |
| Add water to make a total of | 1 liter |
| Adjust pH to be | pH 10.10 |
| (Bleach-fixer) | |
| Ferric ammonium ethylenediamine-tetraacetate, dihydrate | 60 g |
| Ethylenediaminetetraacetic acid | 3 g |
| Ammonium thiosulfate (an aqueous 70% solution) | 100 ml |
| Ammonium sulfite (an aqueous 40% solution) | 27.5 ml |
| Adjust pH with potassium carbonate or glacial acetic acid to be | pH 6.2 |
| Add water to make a total of | 1 liter |
| (Stabilizer) | |
| 5-chloro-2-methyl-4-isothiazoline-3-one | 1.0 g |
| Ethylene glycol | 1.0 g |
| 1-hydroxyethilidene-1,1- | |

-continued

| | |
|---|---|
| diphosphonic acid | 2.0 g |
| Ethylenediaminetetraacetic acid | 1.0 g |
| Ammonium hydroxide (an aqueous 20% solution) | 3.0 g |
| Ammonium sulfite | 3.0 g |
| Fluorescent brightening agent, a 4,4'-diaminostilbene sulfonic acid derivative | 1.5 g |
| Add water to make | 1 liter |
| Adjust pH with sulfuric acid or potassium hydroxide to be | pH 7.0 |

Example 9

[Preparation of EM-G through EM-J]

A silver nitrate solution and a solution containing potassium bromide and sodium chloride were added into inert gelatin in a double-jet method. In this stage, the compounds given in Table 9 were added while keeping the temperature, pH and pAg at 50° C., 6.0 and 7.5, respectively. Next, a desalting and washing were carried out, so that EM-G through EM-J were prepared, respectively.

Every one of EM-G to EM-J was an emulsion comprising cubic silver chlorobromide grains having a silver chloride content of 99.9% and an average grain size of 0.45 μm.

TABLE 8

| Sample No. | Emulsion | Primitive emulsion, (Halide composition Cl/Br) | Sensitizing dye (mol/AgX mol) | Inorganic sulfur (mg/AgX AgX mol) | Compound added on completing a chemical sensitization (mol/AgX mol) | Sensitometry Sensitivity | Fog | γβ | Raw product preservability, Δγβ | Rapid processability Developing time 15" | 30" | |
|---|---|---|---|---|---|---|---|---|---|---|---|---|
| 62 | Em-62 | EM-B (40/60) | [GD-16] $5 \times 10^{-4}$ | — | [S-16] 0.01 | 100 | 0.09 | 3.15 | −0.38 | 1.75 | 2.45 | Comp. |
| 63 | Em-63 | EM-B (40/60) | [GD-16] $5 \times 10^{-4}$ | 0.5 | [S-16] 0.01 | 96 | 0.04 | 3.25 | −0.14 | 1.77 | 2.40 | Inv. |
| 64 | Em-64 | EM-C (70/30) | [GD-16] $5 \times 10^{-4}$ | — | [S-16] 0.01 | 102 | 0.10 | 3.08 | −0.39 | 1.95 | 2.55 | Comp. |
| 65 | Em-65 | EM-C (70/30) | [GD-16] $5 \times 10^{-4}$ | 0.5 | [S-16] 0.01 | 97 | 0.04 | 3.22 | −0.14 | 1.92 | 2.56 | Inv. |
| 66 | Em-66 | EM-D (90/10) | [GD-16] $5 \times 10^{-4}$ | — | [S-16] 0.01 | 102 | 0.12 | 2.75 | −0.45 | 2.40 | 2.56 | Comp. |
| 67 | Em-67 | EM-D (90/10) | [GD-16] $5 \times 10^{-4}$ | 0.5 | [S-16] 0.01 | 98 | 0.04 | 3.30 | −0.13 | 2.40 | 2.55 | Inv. |
| 68 | Em-68 | EM-E (99.5/0.5) | [GD-16] $5 \times 10^{-4}$ | — | [S-16] 0.01 | 103 | 0.12 | 2.51 | −0.46 | 2.50 | 2.56 | Comp. |
| 69 | Em-69 | EM-E (99.5/0.5) | [GD-16] $5 \times 10^{-4}$ | 0.5 | [S-16] 0.01 | 100 | 0.04 | 3.27 | −0.15 | 2.51 | 2.55 | Inv. |
| 70 | Em-70 | EM-E (99.5/0.5) | [GD-16] $5 \times 10^{-4}$ | 0.5 | [S-12] 0.001 | 104 | 0.02 | 3.44 | −0.07 | 2.50 | 2.56 | Inv. |
| 71 | Em-71 | EM-E (99.5/0.5) | [GD-16] $5 \times 10^{-4}$ | 0.5 | [S-32] 0.001 | 105 | 0.02 | 3.45 | −0.06 | 2.49 | 2.57 | Inv. |
| 72 | Em-72 | EM-E (99.5/0.5) | [GD-16] $5 \times 10^{-4}$ | 0.5 | [SA-5] 0.001 | 107 | 0.02 | 3.35 | −0.06 | 2.51 | 2.55 | Inv. |
| 73 | Em-73 | EM-E (99.5/0.5) | [GD-16] $5 \times 10^{-4}$ | 0.5 | [SB-8] 0.001 | 104 | 0.02 | 3.39 | −0.07 | 2.52 | 2.56 | Inv. |
| 74 | Em-74 | EM-E (99.5/0.5) | [GD-16] $5 \times 10^{-4}$ | 0.5 | [SC-6] 0.001 | 106 | 0.03 | 3.33 | −0.10 | 2.50 | 2.54 | Inv. |
| 75 | Em-75 | EM-E (99.5/0.5) | [GD-16] $5 \times 10^{-4}$ | 0.5 | [SC-32] 0.001 | 105 | 0.03 | 3.37 | −0.09 | 2.48 | 2.55 | Inv. |
| 76 | Em-76 | EM-F (99.5/0.5) [GD-16] $2 \times 10^{-4}$ mol added | [GD-16] $5 \times 10^{-4}$ | — | [S-16] 0.01 | 117 | 0.14 | 2.60 | −0.40 | 2.50 | 2.55 | Comp. |
| 77 | Em-77 | EM-F (99.5/0.5) [GD-16] $2 \times 10^{-4}$ mol added | [GD-16] $5 \times 10^{-4}$ | 0.5 | [S-16] 0.01 | 113 | 0.14 | 3.34 | −0.10 | 2.50 | 2.56 | Inv. |

*Sensitivity is expressed by a value relative to the sensitivity of Sample No. 62 regarded as a value of 100.

As is obvious from Table 8, when a highly silver chloride containing emulsion is used, a fog reduction and a rapid processability can be achieved. When inorganic sulfur is further used therein, it is possible to make both of the sensitivity obtained by a chemical sensitization and the optimum point between fog and gradation coincide with each other, as well as the fog reduction and emulsion preservability can be improved. These emulsions may therefore be put in practical use as a rapidly processable silver halide emulsion. Furthermore, when a compound having a purine ring or a mercapto compound is used as an inhibitor, the effects of the invention can more remarkably be displayed.

TABLE 9

| EM | Compound added | Amount added/AgX mol | Point of time for adding |
|---|---|---|---|
| EM-G | [SB-5] | $1 \times 10^{-4}$ mol | Silver nitrate solution and Halide solution added at a time |
| EM-H | [SB-5] | $1 \times 10^{-4}$ mol | The same as above |
| | Inorganic sulfur | 0.2 mg | The same as above |
| EM-I | [SB-5] | $1 \times 10^{-4}$ mol | The same as above |
| | $K_2IrCl_6$ | $1 \times 10^{-6}$ mol | This added when a 10% part of silver nitrate used was poured in. |
| EM-J | [SB-5] | $1 \times 10^{-4}$ mol | Silver nitrate solution and Halide solution added at a time |
| | $K_2IrCl_6$ | $1 \times 10^{-6}$ mol | This added when a 60% part of silver nitrate used was poured in. |

Next, a chemical sensitization was carried out in accordance with the following conditions. [SB-5] of $1 \times 10^{-4}$ mol and the chemical sensitizers indicated in Table 10 were added into the primitive emulsions at 55° C., respectively. Five minutes later, $5 \times 10^{-4}$ mol of [GD-9] or [GD-9] and [GD-3] were added to apply a chemical sensitization. [SB-2] of 40 mg was then added, taking a period of time capable of obtaining the optimum sensitometric characteristics, respectively, so that each of the chemical sensitization was completed by lowering the temperature.

In this stage, inoranic sulfur was added respectively at the points of time indicated in Table 10, respectively.

[Preparation of Coated Samples]

The samples were prepared in the same manner as in Example 8, except that the compounds given in Table 10 were added when required in preparing the coating solutions.

Next, the sensitometry and raw product preservability of each sample were evaluated in the same manners as in Example 8, respectively, provided that each sample was processed in the Processing step-C for 45 seconds.

The results thereof are shown in Table 10.

TABLE 1

| Sample No. | Emulsion | Primitive emulsion | Sensitizing dye (mol/AgX mol) | Chemical sensitizer (mg/AgX mol | Inorganic sulfur Amount added (mg/AgX mol) | Inorganic sulfur Time of adding | Additive in preparing coating solution (mg/AgX mol | Sensitometry Sensitivity | Sensitometry Fog | Sensitometry $\gamma\beta$ | Raw product preservability $\Delta\gamma\beta$ | Raw product preservability Value of fog increased |
|---|---|---|---|---|---|---|---|---|---|---|---|---|
| 78 | Em-78 | EM-G | [GD-9] $5 \times 10^{-4}$ | Sodium thiosulfate 2.5 | — | | — | 100 | 0.15 | 2.50 | −0.57 | +0.05 |
| 79 | Em-79 | " | " | " | 0.2 (In starting chemical sensitization) | | — | 98 | 0.04 | 3.17 | −0.11 | +0.04 |
| 80 | Em-80 | " | " | " | 0.2 (In completing chemical sensitization) | | — | 97 | 0.04 | 3.11 | −0.12 | +0.04 |
| 81 | Em-81 | " | " | " | 0.2 (In preparing coating solution) | | Inorganic sulfur 0.2 | 99 | 0.07 | 3.02 | −0.17 | +0.04 |
| 82 | Em-82 | EM-H (Inorganic sulfur added) | " | " | 0.2 (In forming AgX grains) | | — | 98 | 0.05 | 3.06 | −0.14 | +0.04 |
| 83 | Em-83 | IM-I ($K_2IrCl_6$ added) | " | " | 0.2 (In starting chemical sensitization) | | — | 94 | 0.04 | 3.33 | −0.08 | +0.04 |
| 84 | Em-84 | IM-J ($K_2IrCl_6$ added) | " | " | " | | — | 95 | 0.04 | 3.26 | −0.07 | +0.04 |
| 85 | Em-85 | " | " | Chloroauric acid 3 | " | | — | 175 | 0.02 | 3.25 | −0.04 | +0.02 |
| 86 | Em-86 | " | " | Chloroauric acid 15 | " | | — | 195 | 0.02 | 3.17 | −0.03 | +0.01 |
| 87 | Em-87 | " | " | Sodium thiosulfate 2 Chloroauric acid 4 | " | | — | 205 | 0.03 | 3.31 | −0.04 | +0.03 |
| 88 | Em-88 | " | " | " | " | | [SB-5] 100 mg | 211 | 0.02 | 3.36 | −0.04 | +0.02 |
| 89 | Em-89 | " | [GD] $3 \times 10^{-4}$ + [GD-3] $2 \times 10^{-4}$ | " | " | | — | 215 | 0.02 | 3.41 | −0.03 | +0.02 |

*Sample No. 78 is for comparison, No.79–89 are of the Invention.

As is obvious from Table 10, inorganic sulfur is effective whenever it may be added. It is, however, preferable to add it before a chemical sensitization is completed. When a gold sensitizer is used independently or in combination with sodium thiosulfate, it makes sensitivity more higher and improves a raw product preservability to inhibit a fog increase. In addition to the above, when a mercapto compound is further added, the above-mentioned effects may be more promoted, so that a superb light-sensitive material can be obtained.

EXAMPLE 10

The following seven layers were coated in order over to a polyethylene-laminated paper, so that a multilayered silver halide photographic light-sensitive material was prepared. The amounts added will hereinafter indicate an amount added per sq. meter, unless otherwise expressly stated.

Layer 1 . . . A layer containing gelatin of 1.2 g, a blue-sensitive silver chlorobromide emulsion, which has an average grain size of 0.8 μm and a silver bromide content of 0.3 mol%, in an amount of 0.35 g in terms of a metallic silver content, and so forth on, and dioctyl phthalate (hereinafter called DOP) dissolved therein with 0.9 g of yellow coupler YC-1 and 0.015 g of 2,5-di-t-octyl hydroquinone (hereinafter called HQ-1).

Layer 2 . . . A layer containing 0.7 g of gelatin and DOP dissolved therein with 0.06 g of HQ-1.

Layer 3 . . . A layer containing 1.25 g of gelatin, 0.35 g of green-sensitive silver chlorobromide emulsion Em-88, and DOP dissolved therein with 0.53 g of magenta coupler M-3, 0.12 g of [A-1], 0.2 g of [A-2] and 0.015 g of HQ-1.

Layer 4 . . . A layer containing 1.3 g of gelatin and DOP dissolved therein with 0.08 g of HQ-1 and 0.5 g of UV absorbent UV-1.

Layer 5 . . . A layer containing 1.4 g of gelatin, 0.3 g of a red-sensitive silver chlorobromide emulsion which has an average grain size of 0.5 μm and a silver bromide content of 0.1 mol%, and DOP dissolved therein with 0.3 g of cyan coupler CC-1, 0.2 g of CC-2 and 0.02 g of HQ-1.

Layer 6 . . . A layer containing 1.0 g of gelatin and 0.14 g of DOP dissolved therein with 0.032 g of HQ-1 and 0.2 g of UV-1.

Layer 7 . . . A layer containing 0.003 g of silicon dioxide and 0.5 g of gelatin.

[H-1] and [H-2] were also added in the amounts of 5 mg and 10 mg per g of gelatin used, respectively, so as to serve as the hardeners.

Em-90: An emulsion prepared in the same conditions as in Em-78, except that Comparative dye-B1 was used as the sensitizing dye.

A multilayered silver halide color light-sensitive material No. 90 was prepared as mentioned above. Next, Nos. 91 through 93 were also prepared in the same manner as in No. 90, except that the following points were changed.

No. 91 . . . Em-90 that was a green-sensitive emulsion of the 3rd layer of No. 90 was replaced by Em-78.

No. 92 . . . Em-90 that was a green-sensitive emulsion of the 3rd layer of No. 91 was replaced by Em-87.

No. 93 . . . [SB-7] of 0.3 mg was added into the 2nd layer of No. 92, and [SB-7] of 0.2 mg into the 4th later thereof, respectively.

The resulted Samples No. 90 through No. 93 were evaluated in the method described in Example 9. The evaluation results of the 3rd layer, i.e., the green-sensitive layer, will be shown in Table 11.

[A-1]

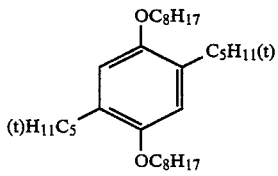

[A-2]

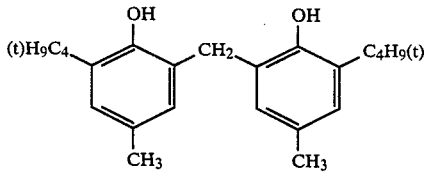

[YC-1]

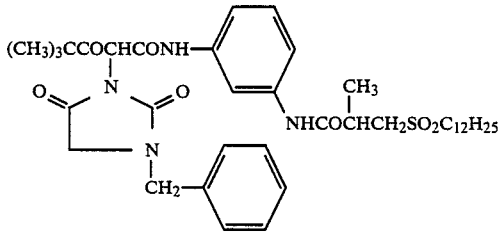

[CC-1]

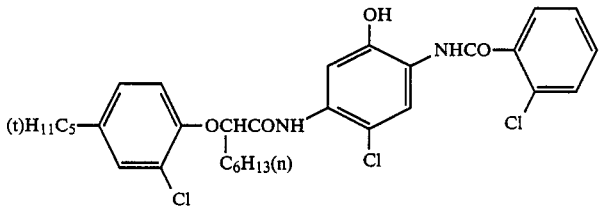

[CC-2]

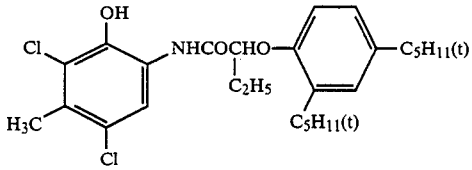

[UV-1]

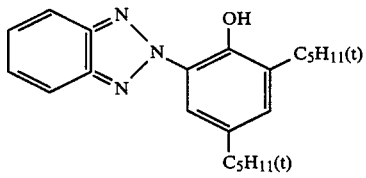

[H-1]

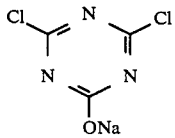

-continued $C(CH_2SO_2CH{=}CH_2)_4$ [H-2]

TABLE 11

| Sample No. | Emulsion | Sensitizing dye (mol/AgXmol) | Inorganic sulfur mg/AgXmol) | Additive to layers 2,4 | Sensitometry Sensitivity | Fog | γB | ΔγB | Raw product preservability Fog value increased | |
|---|---|---|---|---|---|---|---|---|---|---|
| 90 | Em-90 | Comparative dye ($5 \times 10^{-4}$) | — | — | 100 | 0.03 | 3.06 | −0.14 | +0.04 | Comp. |
| 91 | Em-91 | [GD-9] ($5 \times 10^{-4}$) | — | — | 317 | 0.08 | 2.63 | −0.53 | +0.04 | Comp. |
| 92 | Em-97 | [GD-9] ($5 \times 10^{-4}$) | 0.2 | — | 545 | 0.03 | 3.39 | −0.07 | +0.01 | Inv. |
| 93 | Em-97 | [GD-9] ($5 \times 10^{-4}$) | 0.2 | [D-3] | 540 | 0.02 | 3.45 | −0.06 | +0.01 | Inv. |

As is obvious from Table 11, the satisfactory sensitometric characteristics and raw product preservability which are the effects of the invention can be obtained even when a multilayered silver halide color photographic light-sensitive material is prepared by making use of the sensitizing dyes and inorganic sulfur each of the invention.

Example 11

An aqueous silver nitrate solution and an aqueous halide solution that was an aqueous solution prepared by mixing potassium bromide with sodium chloride were added into an aqueous inert gelatin solution in a double-jet method, and mixed up. In the course of the preparation, the temperature, pH and pAg were so controlled as to keep at 50° C., pH 5.5 and pAg=7.8 according to the method described in Japanese Patent O.P.I. Publication No. 45437-1984. Next, a desalting was carried out in an ordinary method, so that EMP-1 was obtained. EMP-1 was a monodisperse emulsion which was comprised of cubic silver chlorobromide grains having an average grain size of 0.4 μm and a silver chloride content of 99.5 mol%. (The variation coefficient thereof was 8.5%)

Next, EMP-1 was added with sodium thiosulfate in an amount of 2 mg per mol of silver halides and chloroauric acid in an amount of 5 mg per mol of silver halides in the presence of SB-1 in an amount of 40 mg per mol of silver halides. The resulted matter was chemically sensitized at 55° C. in the optimum conditions, provided that a spectral sensitization was further carried out with sensitizing dye D-7 in an amount of $7 \times 10^{-5}$ per mol of silver halides in the course of the chemical sensitization, and SB-5 was then added in an amount of 150 mg per mol of silver halides, so that comparative emulsion EMA-1 was obtained.

After then, EMA-2 through EMA-12 were prepared in the same manner as in EMA-1, except that supersensitizer B-2 and α-sulfur were added as shown in the contents of Table 12, provided that the supersensitizer was prepared in the form of an ethanol solution having the supersensitizer content of 0.5 wt% and was then added by taking one minute after RD-7 had been added, and α-sulfur [I] and [II] were added in the form of an ethanol solution having the α-sulfur content of 0.005 wt% and, further, the points of time of adding α-sulfur [I] and [II] were one minute before sodium thiosulfate was added, for the former. and at the same time when SB-5 was added, for the latter, respectively.

TABLE 12

| Emulsion | Sensitizing dye mol/molAgX | Supersensitizer g/molAgX | α-sulfur [I] mg/molAgX | α-sulfur [II] mg/molAgX |
|---|---|---|---|---|
| EMA-1 | RD-7 $7 \times 10^{-5}$ | — | — | — |
| EMA-2 | " | B-2 0.80 | — | — |
| EMA-3 | " | " | 0.05 | — |
| EMA-4 | " | " | 0.2 | — |
| EMA-5 | " | " | 0.4 | — |
| EMA-6 | " | " | — | 0.05 |
| EMA-7 | " | " | — | 0.15 |
| EMA-8 | " | " | — | 0.30 |
| EMA-9 | " | " | 0.02 | 0.02 |
| EMA-10 | " | " | 0.10 | 0.10 |
| EMA-11 | " | " | 0.20 | 0.20 |
| EMA-12 | " | " | 0.50 | 0.50 |

The above-given EMA-1 through EMA-12 were coated over to polyethylene-coated paper in accordance with the following compositions, so that Samples A-1 through A-12 were obtained, respectively.

| | | |
|---|---|---|
| Layer 2 (Protective layer) | Gelatin<br>Hardener (HD-2) | |
| Layer 1 (Red-sensitive layer) | Red-sensitive emulsion<br>Cyan coupler (CC-1) | (EMA-1 through EMA-12) |

-continued

Support (Polyethylene-coated paper

CC-1

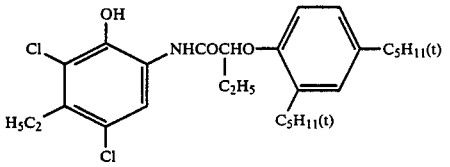

CC-1 was added in the form of a dispersion in the following method.

[Method of dispersing a coupler]

Coupler of 40 g was dissolved in a mixed solvent of 10 ml of a high boiling organic solvent and ethyl acetate, and the resulted solution was added into an aqueous gelatin solution containing sodium dodecylbenzenesulfonate. The resulted solution was then dispersed with a supersonic homogenizer.

The resulted samples A-1 through A-12 were exposed to light through an optical wedge by making use of a photo-sensitometer, Model KS-7 and were then processed in the processing step C of Example 8 provided that the developing time was 45 sec.

With respect to the resulted samples, the red-light reflection densities thereof were measured with a densitometer, Model PDA-65, and the characteristic values which are defined below were obtained.

Sensitivity ($S_8$): A reciprocal value of an exposure necessary to obtain a reflection density of 0.8. The Sensitivity of each sample is expressed by a value relative to the sensitivity of Comparative Sample regarded as a value of 100.

Fog: A red-light reflection density in an unexposed area

The results thereof are shown in Table 13 in terms of the same day characteristics.

Next, the stability on standing of the raw product (hereinafter referred to as 'Raw preservability') was evaluated in the following manner, and the results thereof are shown in Table-2.

[How to evaluate a raw preservability]

The raw preservability of each sample was evaluated with respect to each sensitivity obtained before the samples were preserved and after they were allowed to stand for 10 days at 50° C. and 40% RH (hereinafter referred to as 'After preservation') and the degrees of the fog value variations, that is, $\Delta S_8$ and $\Delta$Fog defined as follows.

$$\Delta S_8\,(\%) = \frac{S_8 \text{ after preservation} - S_8 \text{ before preservation}}{S_8 \text{ before preservation}} \times 100$$

$$\Delta\text{fog} = \text{Fog after preservation} - \text{Fog before preservation}$$

TABLE 13

| Sample | Emulsion | Very same-day characteristics S8 | Very same-day characteristics Fog | Raw preservability (50° C., 10 days) $\Delta S_8$ | Raw preservability (50° C., 10 days) $\Delta$Fog |
|---|---|---|---|---|---|
| A-1 (Comparative) | EMA-1 | 38 | 0.05 | −21% | +0.09 |
| A-2 (Comparative) | EMA-2 | 100 | 0.07 | −38% | +0.19 |
| A-3 (Invention) | EMA-3 | 117 | 0.05 | −19% | +0.05 |
| A-4 (Invention) | EMA-4 | 125 | 0.04 | −14% | +0.05 |
| A-5 (Invention) | EMA-5 | 121 | 0.05 | −11% | +0.06 |
| A-6 (Invention) | EMA-6 | 113 | 0.05 | −15% | +0.05 |
| A-7 (Invention) | EMA-7 | 117 | 0.05 | −12% | +0.04 |
| A-8 (Invention) | EMA-8 | 108 | 0.05 | −9% | +0.05 |
| A-9 (Invention) | EMA-9 | 115 | 0.05 | −12% | +0.04 |
| A-10 (Invention) | EMA-10 | 128 | 0.04 | −8% | +0.03 |
| A-11 (Invention) | EMA-11 | 126 | 0.04 | −7% | +0.03 |
| A-12 (Invention) | EMA-12 | 103 | 0.06 | −5% | +0.03 |

As is obvious from Table 13, in the combination of the sensitizinf dye relating to the invention and a super-sensitizer only, fog is increased and at the same time a raw preservability is deteriorated, a sensitivity may be increased from 38 to 100. On the other hand, in the samples A-3 through A-12 of the invention using inorganic sulfur further added into the above-mentioned combination, not only the sensitivies thereof can be increased, but also fog can be lowered and the raw preservability can further be improved. It is more preferable when inorganic sulfur is added at both of the aforementioned points of time [I] and [III].

Example-12

EMB-1 through EMB-18 were prepared in the same manner as in EMA-1 through EMA-12 of Example 11, except that the kinds and the amounts added of the sensitizing dyes and super-sensitizers of EMP-1 prepared in Example 11 were replaced by those indicated in Table-3 and the method of adding α-sulfur was also changed as indicated in Table 14.

Next, samples B-1 through B-18 were prepared in the same manner as in Example-1, except that EMB-1 through EMB-18 were used as the red-sensitive emulsions. With respect to the resulted samples, the same day characteristics and the raw preservability thereof were evaluated in the same manner as in Example-1. The results thereof are shown in Table 15.

[Comparative sensitizing dyes]

DC-1

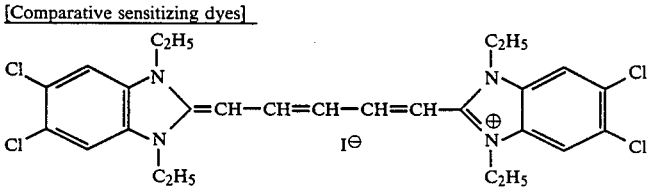

DC-2

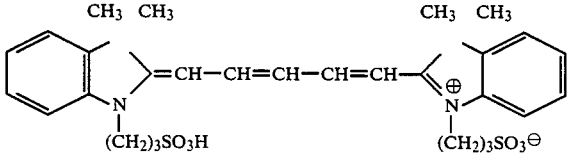

-continued

[Supersensitizer]

SSC-1

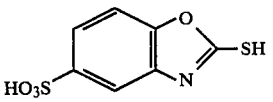

[that is a compound described in 'Photographic Science and Engineering', 12(4), p. 418, 1974.]

TABLE 14

| Emulsion | Sensitizing dye $5 \times 10^{-5}$ mol/mol AgX | Supersensitizer (0.6 g/mol AgX) | α-sulfur [I] (mg/mol AgX) | α-sulfur [II] (mg/mol AgX) |
|---|---|---|---|---|
| EMB- 1 | RD-23 | B-17 | — | — |
| EMB- 2 | " | " | 0.20 | 0.15 |
| EMB- 3 | RD- 2 | " | " | " |
| EMB- 4 | RD- 8 | " | " | " |
| EMB- 5 | RD-18 | " | " | " |
| EMB- 6 | RD-26 | " | " | " |
| EMB- 7 | RD-39 | " | " | " |
| EMB- 8 | RD-33 | " | " | " |
| EMB- 9 | RD-39 | " | " | " |
| EMB-10 | DC-1 | " | — | — |
| EMB-11 | " | " | 0.20 | 0.15 |
| EMB-12 | DC-2 | " | — | — |
| EMB-13 | " | " | 0.20 | 0.15 |
| EMB-14 | RD-23 | B- 1 | " | " |
| EMB-15 | " | B- 9 | " | " |
| EMB-16 | " | B-12 | " | " |
| EMB-17 | " | SSC- 1 | — | — |
| EMB-18 | " | " | 0.20 | 0.15 |

TABLE 15

| Sample | Emulsion | Very same-day characteristics | | Raw preservability (50° C., 10 days | |
|---|---|---|---|---|---|
| | | $S_8$ | Fog | $\Delta S_8$ | ΔFog |
| B-1 (Comparison) | EMB- 1 | 100 | 0.07 | −35% | +0.27 |
| B-2 (Invention) | EMB- 2 | 116 | 0.05 | −7% | +0.04 |
| B-3 (Invention) | EMB- 3 | 119 | 0.05 | −7% | +0.03 |
| B-4 (Invention) | EMB- 4 | 117 | 0.05 | −9% | +0.04 |
| B-5 (Invention) | EMB- 5 | 109 | 0.06 | −11% | +0.06 |
| B-6 (Invention) | EMB- 6 | 120 | 0.05 | −8% | +0.04 |
| B-7 (Invention) | EMB- 7 | 104 | 0.06 | −13% | +0.05 |
| B-8 (Invention) | EMB- 8 | 101 | 0.05 | −15% | +0.06 |
| B-9 (Invention) | EMB- 9 | 97 | 0.06 | −16% | +0.05 |
| B-10 (Comparison) | EMB-10 | 65 | 0.06 | −26% | +0.04 |
| B-11 (Comparison) | EMB-11 | 63 | 0.05 | −25% | +0.05 |
| B-12 (Comparison) | EMB-12 | 32 | 0.06 | −22% | +0.05 |
| B-13 (Comparison) | EMB-13 | 35 | 0.05 | −24% | +0.04 |
| B-14 (Invention) | EMB-14 | 121 | 0.05 | −9% | +0.03 |
| B-15 (Invention) | EMB-15 | 118 | 0.05 | −10% | +0.04 |
| B-16 (Invention) | EMB-16 | 113 | 0.05 | −7% | +0.04 |
| B-17 (Comparison) | EMB-17 | 91 | 0.05 | −23% | +0.03 |
| B-18 (Invention) | EMB-18 | 98 | 0.05 | −15% | +0.03 |

As is obvious from Table 15, in the case that the combinations of the sensitizing dyes relating to the invention and supersensitizers are further combined with inorganic sulfur, a high sensitization and excellent raw preservabilit can be employed in every case. However, in the case of using sensitizing dyes other than those of the invention and super sensitizers, the sensitivity and raw perservability thereof were both unsatisfactory. Among the sensitizing dyes relating to the invention, those represented by Formula [IIIa] or [IVa] in which $Y_{21}$ and $Y_{22}$ represent sulfur atoms are excellent in sensitivity and raw perservability. Further, it is also preferable from the viewpoints of sensitivity and raw perservability when using, as a supersensitizer, the polycondensation product of the compound represented by Formula [V] and hexamethylenetetramine or the compound represented by Formula [VII].

Example 13

EMP-2 and EMP-4 through EMP-8 were prepared in the same manner as in EMP-1 of Example-1, except that the composition of the aqueous halide solution and the adding flow rates of the aqueous silver nitrate solution and the aqueous halide solution and further, silver halide grains were formed while controlling the pAg values so as to be the values indicated in Table 16, respectively.

Next, EMP-3 having a relatively broarder grain size distribution was prepared in the same manner as in EMP-2, except that the pAg was not controlled and the adding flow rate thereof was changed when EMP-2 was prepared.

Further, the above-mentioned EMP-2 through EMP-8 were chemically and optically sensitized at 55° C. and under the optimum conditions by making use of the following additives. At that time, the stabilizer shown in Table 17 and α-sulfur in the form of a 0.005% ethanol solution were added thereinto, so that EMC-1 through EMC-10 were obtained, respectively.

| [additives] | |
|---|---|
| SA | 30 (mg/mol AgX) |
| α-sulfur | 0.20 (mg/mol AgX) |
| Sodium thiosulfate | 2 (mg/mol AgX) |
| Chloroaurate | (The amount shown in Table 17) |
| Sensitizing dye (RD-21) | $6 \times 10^{-5}$ (mol/mol AgX) |
| Supersensitizer (B-17) | 0.5 (g/mol AgX) |

Samples C-1 through C-10 were prepared in the same amnner as in Example 11, except that the above-given EMC-1 through WMC-10 were used and, further, the very same-day characteristics and raw preservability thereof were evaluated in the same manner as in Example 11, respectively. The results thereof are shown in Table 18.

TABLE 16

| Emulsion No. | pAg A set value) | Grain form | Average grain size (μm) | Variation coefficient | Composition of AgX AgCl (mol %) | AgBr (mol %) |
|---|---|---|---|---|---|---|
| EMP-2 | 7.5 | Cube | 0.43 | 0.072 | 100 | 0 |
| EMP-3 | Left unchecked | " | 0.44 | 0.173 | 100 | 0 |
| EMP-4 | 7.5 | " | 0.43 | 0.075 | 99 | 1 |
| EMP-5 | " | " | 0.45 | 0.071 | 93 | 7 |
| EMP-6 | " | " | 0.43 | 0.077 | 80 | 20 |
| EMP-7 | 6.5 | " | 0.44 | 0.076 | 50 | 50 |
| EMP-8 | 5.5 | " | 0.45 | 0.079 | 100 | 0 |

TABLE 17

| Red-sensitive emulsion | Un-sensitized emulsion | AgCl content, (mol %) | Chlorauric acid (mg/mol AgX) | Additives added when stopping chemical sensitization: Stabilizer, (mg/mol AgX) | α-sulfur, (mg/mol AgX) |
|---|---|---|---|---|---|
| EMC-1 | EMP-2 | 100 | 10.0 | SB-5 (150) | — |
| EMC-2 | EMP-2 | 100 | 10.0 | SB-5 (150) | 0.20 |
| EMC-3 | EMP-2 | 100 | 10.0 | S-16 (150) | 0.20 |
| EMC-4 | EMP-2 | 100 | — | SB-5 (150) | 0.20 |
| EMC-5 | EMP-3 | 100 | 10.0 | SB-5 (150) | 0.20 |
| EMC-6 | EMP-4 | 99 | 10.0 | SB-5 (150) | 0.20 |
| EMC-7 | EMP-5 | 93 | 10.0 | SB-5 (150) | 0.20 |
| EMC-8 | EMP-6 | 80 | 10.0 | SB-5 (150) | 0.20 |
| EMC-9 | EMP-7 | 50 | 10.0 | SB-5 (150) | 0.20 |
| EMC-10 | EMP-8 | 100 | 10.0 | SB-5 (150) | 0.20 |

TABLE 18

| Sample | Red-sensitive emulsion | Very same-day characteristics: $S_8$ | Fog | Raw preservability (50° C., 10 days): $\Delta S_8$ | $\Delta$Fog |
|---|---|---|---|---|---|
| C-1 (Comparison) | EMC- 1 | 100 | 0.07 | −34% | +0.17 |
| C-2 (Invention) | EMC- 2 | 117 | 0.04 | −9% | +0.03 |
| C-3 (Invention) | EMC- 3 | 103 | 0.06 | −13% | +0.12 |
| C-4 (Invention) | EMC- 4 | 101 | 0.05 | −17% | +0.06 |
| C-5 (Invention) | EMC- 5 | 114 | 0.06 | −12% | +0.09 |
| C-6 (Invention) | EMC- 6 | 123 | 0.04 | −7% | +0.03 |
| C-7 (Invention) | EMC- 7 | 114 | 0.05 | −13% | +0.04 |
| C-8 (Invention) | EMC- 8 | 105 | 0.05 | −17% | +0.04 |
| C-9 (Invention) | EMC- 9 | 102 | 0.05 | −19% | +0.03 |
| C-10 (Invention) | EMC-10 | 103 | 0.05 | −21% | +0.03 |

As is obvious from Table 18, the effects of the invention can be enjoyed, regardless of the composition of silver halides. It is particularly preferable when the silver chloride content is relatively higher, because the effects of the invention become greater and the characteristics such as $S_8$ and $\Delta S_8$ can excellently be obtained.

The effects of the invention may also be obtained even if a gold-sensitization is not applied, however, from the viewpoints of sensitivity and raw preservability, it is advantageous to apply such a gold-sensitization.

Example 14

Multilayered silver halide light-sensitive materials D1 through D5 were so prepared as to have the structures shown in Table 19, by making use of EMA-1, EMA-2, EMA-4, EMA-7 and EMA-10 each prepared in Example-1 as the red-sensitive emulsions, respectively.

TABLE 19

| Layer | Structure |
|---|---|
| Layer 7 | Gelatin (1.0 g/m$^2$), HD-1 (100 mg/m$^2$) |
| Layer 6 | UV absorbent (UV-1, 0.3 g/m$^2$)<br>Gelatin (0.7 g/m$^2$) |

TABLE 19-continued

| Layer | Structure |
|---|---|
| Layer 5 | Red-sensitive emulsion,<br>(Amt. of silver ctd.: 0.20 g/m$^2$)<br>Cyan coupler CC-3 (0.15 g/m$^2$)<br>Cyan coupler CC-4 (0.25 g/m$^2$)<br>Dibutyl phthalate (0.2 g/m$^2$)<br>Gelatin (1.0 g/m$^2$) |
| Layer 4 | UV absorbent (UV-1, 0.7 g/m$^2$)<br>Gelatin (1.3 g/m$^2$) |
| Layer 3 | Green-sensitive silver chlorobromide emulsion,<br>(Silver bromide content: 0.5 mol %,)<br>(Amt. of silver ctd.: 0.30 g/m$^2$)<br>Magenta coupler MC-1 (0.4 g/m$^2$)<br>Dibutyl phthalate (0.2 (g/m$^2$)<br>Gelatin (1.5 g/m$^2$) |
| Layer 2 | Gelatin (1.0 g/m$^2$)<br>HQ-1 (0.1 g/m$^2$) |
| Layer 1 | Blue-sensitive silver chlorobromide emulsion,<br>(Silver bromide content: 0.5 mol %,)<br>(Amt. of silver ctd.: 0.35 g/m$^2$)<br>Yellow coupler YC-3 (0.9 g/m$^2$)<br>Dibutyl phthalate (0.03 g/m$^2$)<br>Gelatin (2.0 g/m$^2$) |
| Support | Polyethylene-coated paper |

YC-3
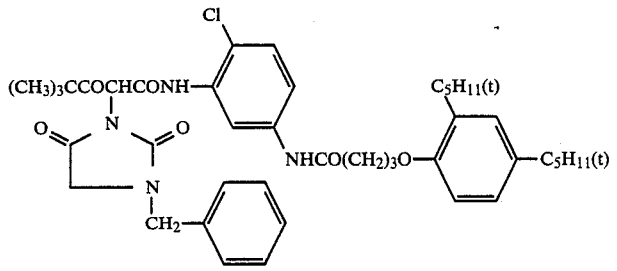
MC-1
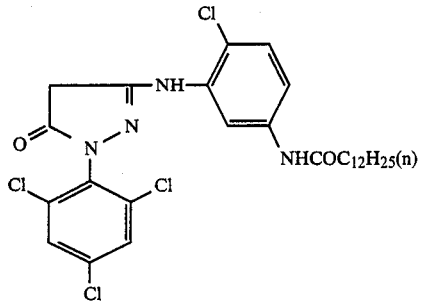
CC-3
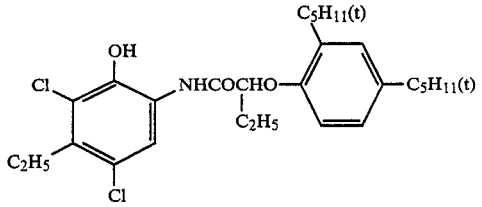
CC-4
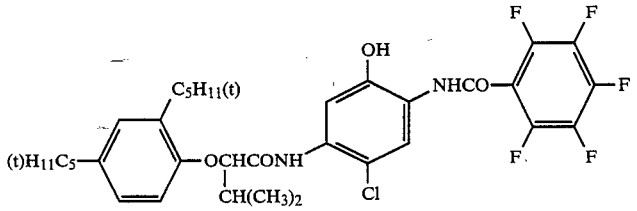
[Hardeners]
HD-1
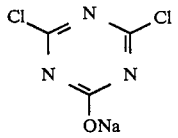
HD-3
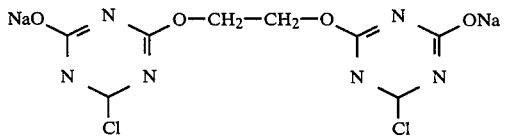
$CH_3C(CH_3OCH_2SO_2CH{=}CH_2)_3$ HD-4
HD-5
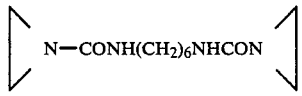
[Raw preservability improvers] (From Exemplified compounds)
VIII-1
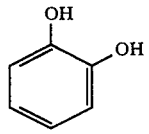

-continued

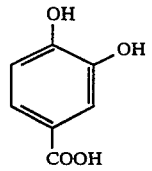

VIII-5

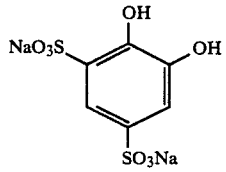

VIII-17

Next, Samples D-6 through D-9 were prepared in the same manner as in Sample D-5, except that the hardener added into the 7th layer of Sample D-5 was changed to those indicated in Table-9, respectively, and Samples D-9 through D-12 were prepared in the same manner as in Sample D-5, except that the compound represented by Formula [VIII] was added into the 5th layer of Sample D-5 as shown in Table 20, respectively.

With respect to Samples D-1 through D-12, the very same-day characteristics and raw preservability thereof were evaluated in the same manner as in Example-1, respectively.

The results thereof are shown in Table 20, below.

TABLE 20

| Sample | Red sensitive emulsion | Hardener (mg/m²) | Compound of Formula [VIII] ($5 \times 10^{-5}$ mol/m²) | Very same-day characteristics $S_8$ | Very same-day characteristics Fog | Raw preservability (50° C., 10 days) $\Delta S_8$ (%) | Raw preservability (50° C., 10 days) ΔFog |
|---|---|---|---|---|---|---|---|
| D-1 (Comp.) | EMA-1 | HD-1 (100) | — | 32 | 0.06 | −18 | +0.07 |
| D-2 (Comp.) | EMA- 2 | " | — | 100 | 0.07 | −34 | +0.17 |
| D-3 (Inv.) | EMA- 4 | " | — | 123 | 0.04 | −11 | +0.04 |
| D-4 (Inv.) | EMA- 7 | " | — | 114 | 0.05 | −10 | +0.03 |
| D-5 (Inv.) | EMA-10 | " | — | 118 | 0.04 | − 8 | +0.03 |
| D-6 (Inv.) | " | HD-3 (100) | — | 115 | 0.04 | − 9 | +0.03 |
| D-7 (Inv.) | " | HD-4 (100) | — | 129 | 0.06 | − 3 | +0.06 |
| D-8 (Inv.) | " | HD-5 (100) | — | 115 | 0.06 | −10 | +0.06 |
| D-9 (Inv.) | " | HD-1 (50) HD-4 (80) | — | 121 | 0.04 | − 5 | +0.04 |
| D-10 (Inv.) | " | HD-1 (100) | VIII-1 | 129 | 0.04 | − 4 | +0.03 |
| D-11 (Inv.) | " | " | VIII-5 | 133 | 0.04 | − 3 | +0.01 |
| D-12 (Inv.) | " | " | VIII-17 | 142 | 0.04 | − 1 | +0.01 |

As is obvious from Table 20, the effects of the invention can similarly be obtained also in such a multilatered system as a multilayered silver halide light-sensitive material. Particularly when using the compounds represented by Formula [HDA] or [HDB] as hardeners, an excellent raw preservability ($\Delta S_8$ and ΔFog) may be displayed. Further, when using the compounds represented by Formula [VIII], more excellent raw preservability can be displayed.

What is claimed is:

1. A silver halide photographic light-sensitive material comprising a support having thereon photographic component layers including at least one silver halide emulsion layer wherein said at least one silver halide emulsion layer contains a compound selected from the group of compounds represented by formulas I, II, III, IV and V, and provided that at least one of said photographic component layers is added with elementary sulfur,

I

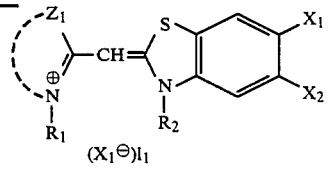

wherein $Z_1$ represents a group of atoms necessary to complete a benzothiazole nucleus or a naphthothiazole nucleus; $X_1$ and $X_2$ each represent a hydrogen atom, a halogen atom, an alkyl group,an alkoxy group, an aryl group or a hydroxyl group; $R_1$ and $R_2$ each represent an alkyl group; $X_1^-$ represents an anion; and $l_1$ is an integer of 0 or 1:

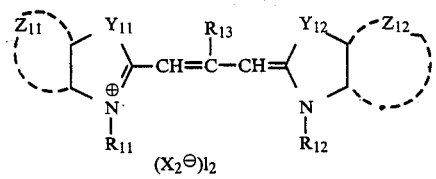

II wherein $Z_{11}$ and $Z_{12}$ each represent a group of atoms necessary to complete a benzene ring or a naphthalene ring; $R_{11}$ and $R_{12}$ each represent an alkyl, alkenyl, or aryl group; $R_{13}$ represents a hydrogen atom or an alkyl group having 1 to 3 carbon atoms; $Y_{11}$ and $Y_{12}$ each represent an oxygen atom, a sulfur atom, a selenium atom, a tellurium atom, an N—$R_{14}$ group or a N—$R_{15}$ group, wherein $R_{14}$ and $R_{15}$ each represent a hydrogen atom, an alkyl, alkenyl, or aryl group; $X_2^-$ represents an anion; and $l_2$ is an integer of 0 or 1:

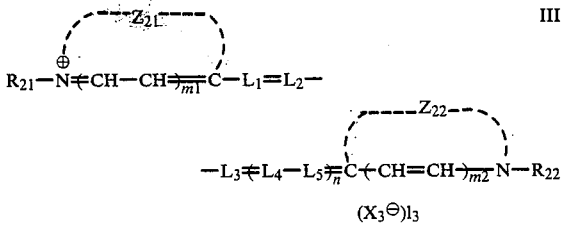

III

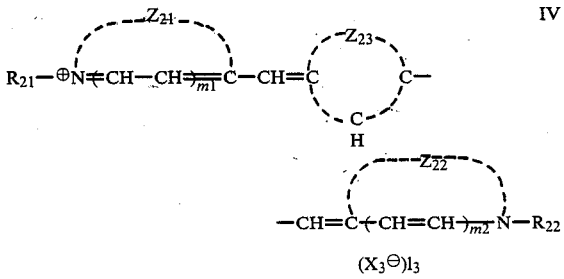

IV wherein $R_{21}$ and $R_{22}$ each represent an alkyl group or an aryl group; $L_1$, $L_2$, $L_3$, $L_4$ and $L_5$ each represent a methine group; $Z_{21}$ and $Z_{22}$ each represent an atom or a group necessary to complete an oxazole ring, a quinoline ring, a thiazole ring or a selenazole ring; $Z_{23}$ represents a group of hydrogen and carbon atoms necessary to complete a six-member ring; $X_3^-$ represents an anion $m_1$, $m_2$, n and $l_3$ each are an integer of 0 or 1, provided that n is 1 when the ring completed by $Z_{21}$ or $Z_{22}$ is an oxazole, thiazole or selenazole ring and that $l_3$ is 0 when a compound produces an intra-molecular salt: and

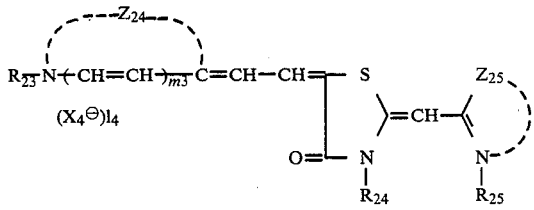

V wherein $Z_{24}$ represents a group of atoms necessary to complete a quinoline ring; $Z_{25}$ represents a group of atoms necessary to complete a thiazole ring, a benzothiazole ring, a naphthothiazole ring, a benzoxazole ring, a naphthoxazole ring, a benzoseleazole ring or a naphthoselenazole ring; $R_{23}$, $R_{24}$ and $R_{25}$ each represent an alkyl group; $X_4^-$ represents an acid anion; and $m_3$ and $l_4$ each are an integer of 0 or 1, respectively.

2. The material of claim 1, wherein said compound represented by Formula I is a compound represented by Formula Ia

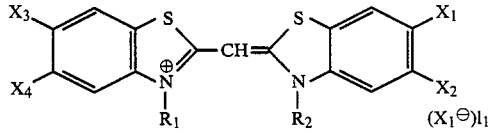

Ia wherein $X_1$, $X_2$, $X_3$ and $X_4$ each represent a hydrogen atom, a halogen atom, an alkyl group, an alkoxy group, a hydroxyl group or an aryl group; and $R_1$, $R_2$, $X_1^-$ and $l_1$ are the same as in Formula I.

3. The material of claim 1, wherein said at least one silver halide emulsion layer contains said compound represented by Formula I in an amount of from $1\times10^{-4}$ to $2\times10^{-3}$ mol per mol of silver halide.

4. The material of claim 3, wherein said at least one silver halide emulsion layer contains said compound represented by Formula I in an amount of from $2\times10^{-4}$ to $1\times10^{-3}$ mol per mol of silver halide.

5. The material of claim 1, wherein $Y_{11}$ and $Y_{12}$ of Formula II each represent an oxygen atom.

6. The material of claim 1, wherein said at least one silver halide emulsion layer contains said compound represented by Formula II in an amount of from $2\times10^{-6}$ to $1\times10^{-2}$ mol per mol of silver halide.

7. The material of claim 6, wherein said at least one silver halide emulsion layer contains said compound represented by Formula II in an amount of from $5\times10^{-6}$ to $5\times10^{-3}$ mol per mol of silver halide.

8. The material of claim 1, wherein said compound represented by Formula III is a compound represented by Formula IIIa,

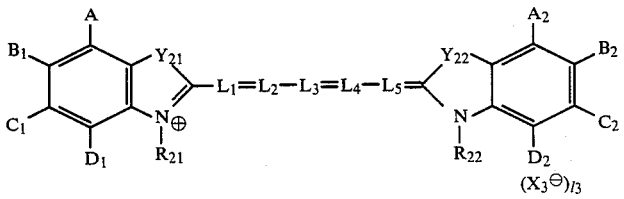

IIIa wherein $Y_{21}$ and $Y_{22}$ each represent an oxygen atom, a sulfur atom or a selenium atom; $R_{21}$ and $R_{22}$ each represent a lower alkyl group; $A_1$, $A_2$, $B_1$, $B_2$, $C_1$, $C_2$, $D_1$ and $D_2$ each represent a hydrogen atom, a halogen atom, an alkyl group, an alkoxy group, a phenyl group, a cyano group, a nitro group or an alkoxycarbonyl group, provided that at least one combination of $A_1$ and $B_1$, $B_1$ and $C_1$, $C_1$ and $D_1$, $A_2$ and $B_2$, $B_2$ and $C_2$, and $C_2$ and $D_2$ may be condensed to complete a benzene ring; and $R_{21}$, $R_{22}$, $L_1$, $L_2$, $L_3$, $L_4$, $L_5$, $X_3^-$ and $l_3$ are the same as in Formula III.

9. The material of claim 1, wherein said compound represented by Formula IV is a compound represented by the Formula IVa,

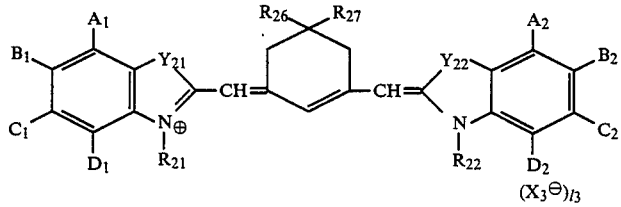

IVa wherein $R_{26}$ and $R_{27}$ each represent a lower alkyl group; and $Y_{21}$, $Y_{22}$, $R_{21}$, $R_{22}$, $A_1$, $A_2$, $B_1$, $B_2$, $C_1$, $c_2$, $D_1$, $D_2$, $X_3^-$ and $l_3$ are the same as in Example IIIa.

10. The material of claim 1, wherein said at least one silver halide emulsion layer contains a compound represented by Formula III, IV or V and a supersensitizer.

11. The material of claim 10, wherein said supersensitizer is a condensation polymer of a compound represented by the Formula VI and hexamethylenetetraamine or a compound represented by the Formula VII:

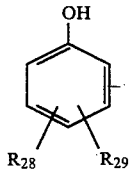

VI wherein $R_{28}$ and $R_{29}$ each represent a hydrogen atom, a hydroxyl group, a carboxyl group, a halogen atom, an alkyl group having 1 to 5 carbon atoms, or an alkoxy group;

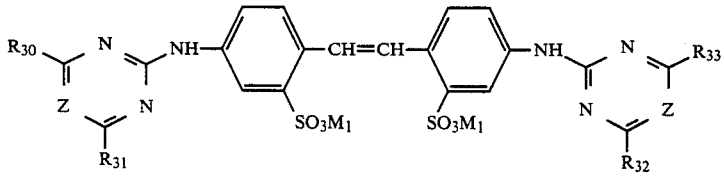

VII wherein —Z= represents —CH= or —N=; $R_{30}$, $R_{31}$, $R_{32}$ and $R_{33}$ each represent a hydrogen atom, a halogen atom, a sulfonic acid group including the salt thereof, or a mono-valent organic group; and $M_1$ represents a mono-valent cation.

12. The material of claim 10, wherein said at least one silver halide emulsion layer contains said compound represented by Formula III, IV or V in an amount of from $1\times10^{-6}$ to $1\times10^{-3}$ mol per mol of silver halide.

13. The material of claim 12, wherein said at least one silver halide emulsion layer contains said compound represented by Formula III, IV or V in an amount of from $5\times10^{-6}$ or $5\times10^{-4}$ mol per mol of silver halide.

14. The material of claim 10, wherein said at least one silver halide emulsion layer contains said supersensitizer in an amount of from $1\times10^{-2}$ to 10 g per mol of silver halide.

15. The material of claim 14, wherein said at least one silver halide emulsion layer contains said supersensitizer in an amount of from $5\times10^{-2}$ to 5 g per mol of silver halide.

16. The material of claim 1, wherein said at least one of said photographic component layers added with said elementary sulfur is said at least one silver halide emulsion layer.

17. The material of claim 1, wherein said at least one of said photographic component layers added with said elementary sulfur is a non-light-sensitive layer.

18. The material of claim 16, wherein an amount of said elementary sulfur added to said at least one silver halide emulsion layer is from $1\times10^{-5}$ to 10 mg per mol of silver halide.

19. The material of claim 18, wherein an amount of said elementary sulfur added to said at least one silver halide emulsion layer is from $1\times10^{-3}$ to 5 mg per mol of silver halide.

20. The material of claim 16, wherein said at least one silver halide emulsion layer is added with said elementary sulfur before completion of a chemical sensitization of a silver halide emulsion contained in said at least one silver halide emulsion layer.

21. The material of claim 20, wherein said elementary sulfur is separately added to the step of starting the chemical sensitization and in the step of completing the chemical sensitizatoin of said silver halide emulsion.

22. The material of claim 21, wherein an amount of said elementary sulfur added in the step of completing the chemical sensitization of said silver halide emulsion is $1\times10^{-5}$ to 9.9 mg per mol of silver halide.

23. The material of claim 22, wherein an amount of said elementary sulfur added in the step of completing the chemical sensitization of said silver halide emulsion is $1\times10^{3}$ to 4.9 mg per mol of silver halide.

24. The material of claim 21, wherein a total amount of said separately added elementary sulfur is from $2\times10^{-5}$ to 10 mg per mol of silver halide.

25. The material of claim 24, wherein a total amount of said separately added elementary sulfur is from $2\times10^{-3}$ to 5 mg per mol of silver halide.

26. The material of claim 1, wherein silver halide grains contained in said at least one silver halide emulsion layer comprise not less than 90 mol% of silver chloride.

27. The material of claim 26, wherein said silver halide grains, comprise not less than 95 mol% of silver chloride.

28. The material of claim 27, wherein said silver halide grains are consisting essentially of silver chloride or silver chlorobromide containing not less than 5 mol% of silver bromide.

29. The material of claim 1, wherein said at least one silver halide emulsion layer further contains a compound represented by Formula $S_o$,

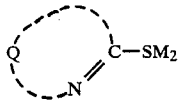

$S_o$ wherein Q represents a group of atoms necessary to complete a five- or six-member heterocyclic ring or a five- or six-member heterocyclic ring condensed with a benzene ring; $M_2$ represents a hydrogen atom or a cation.

* * * * *